US010504640B2

(12) United States Patent
Wang et al.

(10) Patent No.: US 10,504,640 B2
(45) Date of Patent: Dec. 10, 2019

(54) IRON NITRIDE MATERIALS AND MAGNETS INCLUDING IRON NITRIDE MATERIALS

(71) Applicants: Regents of the University of Minnesota, Minneapolis, MN (US); Jian-Ping Wang, Shoreview, MN (US); Yanfeng Jiang, Minneapolis, MN (US)

(72) Inventors: Jian-Ping Wang, Shoreview, MN (US); Yanfeng Jiang, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 919 days.

(21) Appl. No.: 14/900,944

(22) PCT Filed: Jun. 24, 2014

(86) PCT No.: PCT/US2014/043902

§ 371 (c)(1),
(2) Date: Dec. 22, 2015

(87) PCT Pub. No.: WO2014/210027

PCT Pub. Date: Dec. 31, 2014

(65) Prior Publication Data

US 2016/0141082 A1 May 19, 2016

Related U.S. Application Data

(60) Provisional application No. 61/840,213, filed on Jun. 27, 2013, provisional application No. 61/840,248,
(Continued)

(51) Int. Cl.
*H01F 1/047* (2006.01)
*H01F 1/08* (2006.01)
(Continued)

(52) U.S. Cl.
CPC ..... *H01F 1/047* (2013.01); *B22F 9/04* (2013.01); *C22C 38/00* (2013.01); *C22C 38/001* (2013.01);
(Continued)

(58) Field of Classification Search
CPC ... B22F 2999/00; B22F 1/0085; H01F 41/026
(Continued)

(56) References Cited

U.S. PATENT DOCUMENTS 5,032,947 A 7/1991 Li et al.
5,068,147 A 11/1991 Hori et al.
(Continued)

FOREIGN PATENT DOCUMENTS

CN 1156516 A 8/1997
CN 1621549 A 6/2005
(Continued)

OTHER PUBLICATIONS

NPL: machine translation of JP 2013069926A (Year: 2013).*
(Continued)

*Primary Examiner* — Jie Yang
(74) *Attorney, Agent, or Firm* — BakerHostetler

(57) ABSTRACT

The disclosure describes magnetic materials including iron nitride, bulk permanent magnets including iron nitride, techniques for forming magnetic materials including iron nitride, and techniques for forming bulk permanent magnets including iron nitride.

39 Claims, 22 Drawing Sheets

Related U.S. Application Data filed on Jun. 27, 2013, provisional application No. 61/840,221, filed on Jun. 27, 2013, provisional application No. 61/935,516, filed on Feb. 4, 2014.

(51) Int. Cl.
*B22F 9/04* (2006.01)
*H01F 41/02* (2006.01)
*C22C 38/00* (2006.01)

(52) U.S. Cl.
CPC ..... *H01F 1/086* (2013.01); *H01F 41/0266* (2013.01); *B22F 2998/10* (2013.01); *B22F 2999/00* (2013.01); *C22C 2202/02* (2013.01)

(58) Field of Classification Search
USPC ..... 148/101
See application file for complete search history.

(56) References Cited

U.S. PATENT DOCUMENTS

| | | | |
|---|---|---|---|
| 5,137,588 | A | 8/1992 | Wecker et al. |
| 5,330,554 | A | 7/1994 | Koyano et al. |
| 5,449,417 | A | 9/1995 | Shimizu et al. |
| 6,139,765 | A | 10/2000 | Kitazawa et al. |
| 6,217,672 | B1 | 4/2001 | Zhang |
| 6,319,485 | B1 | 11/2001 | Nagatomi et al. |
| 6,457,629 | B1 | 10/2002 | White |
| 6,778,358 | B1 | 8/2004 | Jiang et al. |
| 6,841,259 | B1 | 1/2005 | Takahashi et al. |
| 7,238,439 | B2 | 7/2007 | Sasaki et al. |
| 9,242,295 | B2 * | 1/2016 | Liu ..... B22F 1/0018 |
| 10,068,689 | B2 * | 9/2018 | Wang ..... B32B 15/011 |
| 2002/0117102 | A1 | 8/2002 | Takahashi et al. |
| 2002/0191354 | A1 | 12/2002 | Yoshikawa et al. |
| 2002/0197530 | A1 | 12/2002 | Tani et al. |
| 2005/0123754 | A1 | 6/2005 | Masada et al. |
| 2005/0208320 | A1 | 9/2005 | Masada et al. |
| 2006/0105170 | A1 | 5/2006 | Dobson et al. |
| 2006/0112873 | A1 | 6/2006 | Uchida et al. |
| 2008/0166584 | A1 | 7/2008 | Deligianni et al. |
| 2009/0042063 | A1 | 2/2009 | Inoue et al. |
| 2009/0087688 | A1 | 4/2009 | Masaki |
| 2010/0035086 | A1 | 2/2010 | Inoue et al. |
| 2010/0104767 | A1 | 4/2010 | Sskuma et al. |
| 2010/0288964 | A1 | 11/2010 | Pirich et al. |
| 2011/0059005 | A1 | 3/2011 | Sankar et al. |
| 2011/0074531 | A1 | 3/2011 | Yamashita et al. |
| 2012/0090543 | A1 | 4/2012 | Cheong |
| 2012/0145944 | A1 | 6/2012 | Komuro et al. |
| 2012/0153212 | A1 | 6/2012 | Liu |
| 2013/0126775 | A1 | 5/2013 | Abe et al. |
| 2013/0140076 | A1 | 6/2013 | Lee et al. |
| 2014/0001398 | A1 | 1/2014 | Takahashi et al. |
| 2014/0008446 | A1 | 1/2014 | Carr |
| 2014/0290434 | A1 | 10/2014 | Matthiesen |
| 2014/0299810 | A1 | 10/2014 | Wang et al. |
| 2015/0380135 | A1 | 12/2015 | Wang et al. |
| 2015/0380158 | A1 | 12/2015 | Brady et al. |
| 2016/0042846 | A1 | 2/2016 | Wang et al. |
| 2016/0042849 | A1 | 2/2016 | Wang et al. |
| 2016/0141082 | A1 | 5/2016 | Wang et al. |
| 2016/0189836 | A1 | 6/2016 | Takahaski et al. |

FOREIGN PATENT DOCUMENTS

| | | | |
|---|---|---|---|
| CN | 101071667 | | 11/2007 |
| CN | 102576591 | A | 7/2012 |
| CN | 103339694 | A | 10/2013 |
| CN | 103827986 | A | 5/2014 |
| CN | 105849834 | A | 6/2014 |
| EP | 0509361 | A2 | 10/1992 |
| EP | 0633581 | A1 | 1/1995 |
| EP | 0994493 | A2 | 4/2000 |
| EP | 1548760 | A2 | 6/2005 |
| EP | 1675133 | A2 | 6/2006 |
| EP | 2492927 | A1 | 8/2012 |
| EP | 2666563 | A1 | 11/2013 |
| EP | 2696356 | A1 | 2/2014 |
| JP | S61143557 | A | 7/1986 |
| JP | S61157634 | A | 7/1986 |
| JP | S62232101 | A | 10/1987 |
| JP | S63132701 | A | 6/1988 |
| JP | H02173209 | A | 7/1990 |
| JP | H02212320 | A | 8/1990 |
| JP | H03100124 | A | 4/1991 |
| JP | H04217305 | A | 8/1992 |
| JP | H05269503 | A | 10/1993 |
| JP | H05311390 | A | 11/1993 |
| JP | H05326239 | A | 12/1993 |
| JP | H0696947 | A | 4/1994 |
| JP | H06267722 | A | 9/1994 |
| JP | H06311390 | A | 11/1994 |
| JP | 2000176513 | A | 6/2000 |
| JP | 2001135508 | A | 5/2001 |
| JP | 2001176715 | A | 6/2001 |
| JP | 2002334695 | A | 11/2002 |
| JP | 2004319923 | A | 11/2004 |
| JP | 2005183932 | A | 7/2005 |
| JP | 2007070669 | A | 3/2007 |
| JP | 2007273038 | A | 10/2007 |
| JP | 2008071425 | A * | 3/2008 |
| JP | 2008311518 | A | 12/2008 |
| JP | 2009259402 | A | 11/2009 |
| JP | 2012246174 | A | 12/2012 |
| JP | 2013069926 | A | 4/2013 |
| JP | 2013080922 | A | 5/2013 |
| JP | 2013102122 | A | 5/2013 |
| KR | 1020120091091 | A | 8/2012 |
| TW | 272293 | B | 3/1996 |
| TW | 1303072 | B | 11/2008 |
| TW | 201249564 | A | 12/2012 |
| TW | 201447934 | A | 12/2014 |
| WO | WO 2011049080 | A1 | 4/2011 |
| WO | WO 2012159096 | A2 | 11/2012 |
| WO | WO 2013026007 | A2 | 2/2013 |
| WO | WO 2013042721 | A1 | 3/2013 |
| WO | WO 2013090895 | A1 | 6/2013 |
| WO | WO 2014124135 | A2 | 8/2014 |
| WO | WO 2014210027 | A1 | 12/2014 |
| WO | 2015148810 | A1 | 10/2015 |
| WO | 2016022685 | A1 | 2/2016 |
| WO | 2016022711 | A1 | 2/2016 |
| WO | 2016122712 | A1 | 8/2016 |
| WO | 2016122971 | A1 | 8/2016 |
| WO | 2016122987 | A1 | 8/2016 |

OTHER PUBLICATIONS

NPL: machine translation of JP 2008071425A (Year: 2008).*

Slater, "Electronic Structure of Alloys," Journal of Applied Physics, vol. 8, No. 6, Jun. 1937, 8 pp.

Kikkawa et al., "Fine Fe16N2 powder prepared by low-temperature nitridation," Materials Research Bulletin, vol. 43, ScienceDirect, Feb. 19, 2008, 8 pp.

Zayak et al., "First-principles investigations of homogenous lattice-distortive strain and shuffles in Ni2MnGA," Journal of Physics: Condensed Matter, vol. 15, No. 2, Jan. 22, 2003, 8 pp.

Bogaerts et al., "Monte Carlo simulation of an analytical glow discharge: motion of electrons, ions and fast neutrals in the cathode dark space," Spectrochimica Acta, vol. 50B, No. 1, Jan. 1995, 20 pp.

Gagnoud et al., "Electromagnetic Modelling of Induction Melting Devices in Cold Crucible," IEEE Transactions on Magnetics, vol. 24, No. 1, Jan. 1988, 5 pp.

Sakuma, "Electronic and Magnetic Structure of Iron Nitride, Fe16N2 (invited)," Journal of Applied Physics, vol. 79, No. 8, Apr. 15, 1996, 8 pp.

Resta, "Ab initio study of tetragonal variants in Ni2MnGa alloy," Journal of Physics: Condensed Matter, vol. 14, No. 20, May 27, 2002, 14 pp.

(56) References Cited

OTHER PUBLICATIONS

Becke, "Density-Functional Exchange-Energy Approximation With Correct Asymptotic Behavior," Physical Review A General Physics, vol. 38, No. 6, Sep. 15, 1988, 4 pp.
Floris et al., "Vibrational Properties of MnO and NiO from DFT + U-Based Density Functional Perturbation Theory," Physical Review B Condensed Matter, vol. 84, Oct. 2011, 6 pp.
Liechtenstein et al., "Density-Functional Theory and Strong Interactions: Orbital Ordering in Mott-Hubbard Insulators," Physical Review B Condensed Matter, vol. 52, No. 8, Aug. 15, 1995, 5 pp.
Vasil'Ev et al., "Structural and Magnetic Phase Transitions in Shape-Memory Alloys Ni2+xMn1—xGa," Physical Review B: Condensed Matter and Materials Physics, vol. 59. No. 2, Jan. 1, 1999, pp. 1113-1120.
Sozinov et al., "Crystal Structures and Magnetic Anisotropy Properties of Ni—Mn—Ga Martensitic Phases With Giant Magnetic-Field-Induced Strain," IEEE Transactions on Magnetics, vol. 38, No. 5, Sep. 2002, pp. 2814-2816.
Zayak et al., "Switchable Ni—Mn—Ga Heusler nanocrystals," Journal of Applied Physics vol. 104, No. 7, Oct. 2008, 6 pp.
Likhachev et al., "Modeling the Strain Response, Magneto-Mechanical Cycling Under the External Stress, Work Output and Energy Losses in Ni—Mn—Ga," Mechanics of Materials, vol. 38, May 2006, pp. 551-563.
Morisako et al., "Magnetic Anisotropy and Soft Magnetism of Iron Nitride Thin Films Prepared by Facing-Target Sputtering," Journal of Applied Physics, vol. 69, No. 8, Apr. 15, 1991, pp. 5619-5621.
Jordan et al., "Magnetic Fluid Hyperthermia (MFH): Cancer Treatment with AC Magnetic Field Induced Excitation of Biocompatible Superparamagnetic Nanoparticles," Journal of Magnetism and Magnetic Materials vol. 201, Jul. 1, 1999 pp. 413-419.
Chakrabarti et al., "Influence of Ni Doping on the Electronic Structure of Ni2MnGa," Physical Review B vol. 72, Aug. 5, 2005, 4 pp.
Kirby et al., "Anomalous ferromagnetism in TbMnO3 thin films," Journal of Applied Physics, vol. 105, No. 7, Apr. 2009, 5 pp.
"2014 Titans of Technology—Jian-Ping Wang," Minneapolis/St. Paul Business Journal, Sep. 19, 2014, 18 pp.
Brady et al., "The Formation of Protective Nitride Surfaces for PEM Fuel Cell Metallic Bipolar Plates," Journal of the Minerals, Aug. 2006, pp. 50-57.
Himmetoglu, et al., "First-Principles Study of Electronic and Structural Properties of CuO," Physical Review B. vol. 84, Sep. 14, 2011, 8 pp.
Wedel et al., "Low Temperature Crystal Structure of Ni—Mn—Ga Alloys," Journal of Alloys and Compounds, vol. 290, Aug. 30, 1999 pp. 137-143.
Min, "Enhancement of Fe Magnetic Moments in Ferromagnetic Fe16B2, Fe16C2, and Fe16N2," International Journal of Modern Physics B. vol. 7, No. 1-3, Jan. 1993, pp. 729-732.
Bozorth, "Atomic Moments of Ferromagnetic Alloys," The Physical Review, vol. 79, No. 5, Sep. 1, 1950. pp. 887.
Rong et al., "Fabrication of Bulk Nanocomposite Magnets VIa Severe Plastic Deformation and Warm Compaction," Applied Physics Letters, vol. 96, No. 10, Mar. 8, 2010, 3 pp.
Lorenz et al., "Precise Determination of the Bond Percolation Thresholds and Finite-Size Scaling Corrections for the sc, fcc, and bcc Lattices," Physical Review E, vol. 57, No. 1, Jan. 1998, pp. 230-236.
Majkrzak, "Polarized Neutron Reflectometry," Physica B: Condensed Matter, vol. 173, No. 1 & 2, Aug. 1991, 16 pp.
Opeil et al., "Combined Experimental and Theoretical Investigation of the Premartensitic Transition in Ni2MnGa," Physical Review Letters, vol. 100, Apr. 25, 2008, 4 pp.
Gao et al., "Quantitative Correlation of Phase Structure With the Magnetic Moment in rf Sputtered Fe—N Films," Journal of Applied Physics, vol. 73, No. 10, May 15, 1993, pp. 6579-6581.
Ortiz et al., "Epitaxial Fe16N2 Films Grown by Sputtering," Applied Physics Letters, vol. 65. No. 21, Nov. 21, 1994, pp. 2737-2739.
Cheng et al., "Tempering of Iron-Carbon-Nitrogen Martensites," Metallurgical Transactions A: Physical Metallurgy and Materials Science, vol. 23A, No. 4, Apr. 1992, pp. 1129-1145.
Chikazumi, "Physics of Ferromagnetism," Oxford Science Publications, Ed. 2, 1999, pp. 199-203. (Applicant points out, in accordance with MPEP 609.04(a), that the year of publication, 1999, is sufficiently earlier than the effective U.S. filing date, Jun. 27, 2013, so that the particular month of publication is not in issue.).
Wehrenberg et al., "Shock Compression Response of α"-Fe16N2 Nanoparticles," Journal of Applied Physics, vol. 111, No. 8, Apr. 23, 2012, 8 pp.
Ceperley et al., "Ground State of the Electron Gas by a Stochastic Method," Physical Review Letters, vol. 45, No. 7, Aug. 18, 1980, pp. 566-569.
Borsa et al., "Phase Identification of Iron Nitrides and Iron Oxy-Nitrides with Mössbauer Spectroscopy," Hyperfine Interactions, vol. 151/152, Dec. 2003, pp. 31-48.
Cook, "Strain Induced Martensite Formation in Stainless Steel," Metallurgical Transactions A, vol. 18A, No. 2, Feb. 1987, pp. 201-210.
Sun et al., "Epitaxial Single Crystal Fe16N2 Films Grown by Facing Targets Sputtering," Journal of Applied Physics, vol. 79, No. 8, Apr. 15, 1996, pp. 5440-5442.
Ping et al., "Partitioning of Ga and Co Atoms in a Fe3B/Nd2Fe14B Nanocomposite Magnet," Journal of Applied Physics, vol. 83, No. 12, Jun. 15, 1998, pp. 7769-7775.
Scherlis et al., "Simulation of Heme Using DFT + U: A Step Toward Accurate Spin-State Energetics," The Journal of Physical Chemistry, vol. 111, No. 25, Apr. 21, 2007, pp. 7384-7391.
Jugovic et al., "A Review of Recent Developments in the Synthesis Procedures of Lithium Iron Phosphate Powders," Journal of Power Sources, vol. 190, Feb. 6, 2009, pp. 538-544.
Fullerton et al., "Structure and Magnetic Properties of Exchange-Spring Sm—Co/Co Superlattices," Applied Physics Letters vol. 72, No. 3, Jan. 19, 1998, pp. 380-382.
Van Voorthuysen et al., "Low-Temperature Extension of the Lehrer Diagram and the Iron-Nitrogen Phase Diagram," Metallurgical and Materials Transactions A: Physical Metallurgy and Materials Science, vol. 33A, No. 8, Aug. 2002, pp. 2593-2598.
Kita et al., "Magnetic Properties of Core-Shell Type Fe16N2 Nanoparticles," Journal of Magnetism and Magnetic Materials, vol. 310, Nov. 21, 2006, pp. 2411-2413.
Kneller et al., "The Exchange-Spring Magnet: A New Material Principle for Permanent Magnets," IEEE Transaction on Magnetics, vol. 27, No. 4, Jul. 1991, pp. 3588-3600.
Lavernia et al., "The Rapid Solidification Processing of Materials: Science, Principles, Technology, Advances, and Applications," Journal of Material Science, vol. 45, Dec. 1, 2009, pp. 287-325.
Casoli et al., "Exchange-Coupled FePt/Fe Bilayers with Perpendicular Magnetization," IEEE Transactions on Magnetics, vol. 41, No. 10, Oct. 2005, pp. 3877-3879.
Zhou et al., "Phase Separation in LixFePO4 Induced by Correlation Effects," Physical Review B, vol. 69, May 12, 2004, 4 pp.
Zhou et al., "First-Principles Prediction of Redox Potentials in Transition-Metal Compounds with LDA+U," Physical Review B. vol. 70, Dec. 20, 2004, 8 pp.
Zhou et al., "The Li Intercalation Potential of LiMPO4 and LiMSiO4 Olivines with M=Fe, Mn, Co, Ni," Electrochemistry Communications, vol. 6, Sep. 25, 2004, pp. 1144-1148.
Zhou et al., "Configurational Electronic Entropy and the Phase Diagram of Mixed-Valence Oxides: The Case of LixFePO4," Physical Review Letters, vol. 97, Oct. 13, 2006, 4 pp.
Herzer, "Grain Size Dependence of Coercivity and Permeability in Nanocrystalline Ferromagnets," IEEE Transactions on Magnetics, vol. 26, No. 5, Sep. 1990, pp. 1397-1402.
Ludtka et al., "In Situ Evidence of Enhanced Transformation Kinetics in a Medium Carbon Steel Due to a High Magnetic Field," Scripta Materialia, vol. 51, Apr. 20, 2004, pp. 171-174.
Felcher, "Neutron Reflection as a Probe of Surface Magnetism," Physical Review B: Condensed Matter, vol. 24, No. 3, Aug. 1, 1981, pp. 1595-1598.

(56) References Cited

OTHER PUBLICATIONS

Speich et al., "Elastic Constants of Binary Iron-Base Alloys," Metallurgical Transactions, vol. 3, No. 8, Aug. 1972, pp. 2031-2037.
Fernando et al., "Magnetic Moment of Iron in Metallic Environments," Physical Review B, vol. 61, No. 1, Jan. 1, 2000, pp. 375-381.
Felcher, "Magnetic Depth Profiling Studies by Polarized Neutron Reflection," Physica B: Condensed Matter, vol. 192, Nos. 1 & 2, Oct. 1993, pp. 137-149.
Gaunt, "The Magnetic Properties of Platinum Cobalt Near the Equiatomic Composition Part II. Mechanism of Magnetic Hardening," The Philosophical Magazine, vol. 13, No. 123, Mar. 1966, pp. 579-588.
Takahashi et al., "α"-Fe16N2 Problem—Giant Magnetic Moment or Not," Journal of Magnetism and Magnetic Materials, vol. 208, No. 3, Jan. 11, 2000, pp. 145-157.
Shokrollahi et al., "Soft Magnetic Composite Materials (SMCs)," Journal of Materials Processing Technology, vol. 189, Feb. 20, 2007, pp. 1-12.
Sugita et al., "Magnetic and Electrical Properties of Single-Phase, Single-Crystal Fe16N2 Films Epitaxially Grown by Molecular Beam Epitaxy (Invited)," Journal of Applied Physics, vol. 79, No. 8, Apr. 15, 1996, pp. 5576-5581.
Takahashi et al., "Perpendicular Uniaxial Magnetic Anisotropy of Fe16N2(001) Single Crystal Films Grown by Molecular Beam Epitaxy," IEEE Transactions on Magnetics, vol. 35, No. 5, Sep. 1999, pp. 2982-2984.
Tanaka et al., "Electronic Band Structure and Magnetism of Fe16N2 Calculated by the FLAPW Method," Physical Review B: Condensed Matter and Materials Physics, vol. 62, No. 22, Dec. 1, 2000, pp. 15042-15046.
Zeng et al., "Exchange-Coupled Nanocomposite Magnets by Nanoparticle Self-Assembly," Nature, vol. 420, No. 6914, Nov. 28, 2002, pp. 395-398.
Du, "A Reevaluation of the Fe—N and Fe—C—N Systems," Journal of Phase Equilibria, vol. 14, No. 6, Aug. 24, 1993, pp. 682-693.
Jiang et al., "The Thermostability of the Fe16N2 Phase Deposited on a GaAs Substrate by Ion-Bean-Assisted Deposition," Journal of Physical Condensed Matter, vol. 6, Mar. 17, 1994, pp. L279-L282.
Jan et al., "Monte Carlo Simulations of Spin-1/2 Micelle and Microemulsion Models," Journal De Physique, vol. 49, No. 4, Apr. 1988, pp. 623-633.
Nelson, "Epitaxial Growth From the Liquid State and Its Application to the Fabrication of Tunnel and Laser Diodes," RCA Review, vol. 24, No. 4, Dec. 1963, pp. 603-615.
Shinno et al., "Effects of Film Thickness on Formation Processes of Fe16N2 in Nitrogen Ion-Implanted Fe Films," Surface and Coatings Technology vol. 103-104, May 1998, pp. 129-134.
Takahashi et al., "Ferromagnetic Resonance Studies of Fe16N2 Films with a Giant Magnetic Moment," Journal of Applied Physics, vol. 73, No. 10, May 15, 1993, pp. 6060-6062.
Shimba et al., "Preparation of Iron Nitride Fe16N2 Nanoparticles by Reduction of Iron Nitrate," J. Japan Inst. Metals, vol. 74, No. 3, 2010, 5 pp. (Applicant points out, in accordance with MPEP 609.04(a), that the year of publication, 2010, is sufficiently earlier than the effective U.S. filing date, Jun. 27, 2013, so that the particular month of publication is not in issue.).
Hook et al., "Magnetic Order," Solid State Physics, Ed. 2, Ch. 8, 1991, pp. 219-252. (Applicant points out, in accordance with MPEP 609.04(a), that the year of publication, 1991, is sufficiently earlier than the effective U.S. filing date, Jun. 27, 2013, so that the particular month of publication is not in issue.).
Hsu et al., "First-Principles Study for Low-Spin LaCoO3 with a Structurally Consistent Hubbard U," Physical Review B, vol. 79, Mar. 31, 2009, 9 pp.
Hsu et al., "Spin-State Crossover and Hyperfine Interactions of Ferric Iron in MgSiO3 Perovskite," Physical Review Letters, vol. 106, Mar. 18, 2011, 4 pp.
Mccurrie, "Chapter 3: The Structure and Properties of Alinco Permanent Magnet Alloys," Handbook of Ferromagnetic Materials, vol. 3, 1982, 82 pp. (Applicant points out, in accordance with MPEP 609.04(a), that the year of publication, 1982, is sufficiently earlier than the effective U.S. filing date, Jun. 27, 2013, so that the particular month of publication is not in issue.).
Kulik et al., "Density Functional Theory in Transition-Metal Chemistry: A Self-Consistent Hubbard U Approach," Physical Review Letters, vol. 97, Sep. 8, 2006, 4 pp.
Bae et al., "Cost Effective Parallel-Branch Spiral Inductor with Enhanced Quality Factor and Resonance Frequency," Electronics and Telecommunications Research Institute, 2007, pp. 87-90. (Applicant points out, in accordance with MPEP 609.04(a), that the year of publication, 2007, is sufficiently earlier than the effective U.S. filing date, Jun. 27, 2013, so that the particular month of publication is not in issue.).
Galanakis et al., "Spin-Polarization and Electronic Properties of Half-Metallic Heusler Alloys Calculated from First Principles," Journal of Physics: Condensed Matter, vol. 19, No. 31, Jul. 3, 2007 (online), 16 pp.
Al-Omari et al., "Magnetic Properties of Nanostructured CoSm/FeCo Films," Physical Review B, vol. 52, No. 5, Aug. 1, 1995, pp. 3441-3447.
Mazin et al., "Insulating Gap in FeO: Correlations and Covalency," Physical Review B, vol. 55, No. 19, May 15, 1997, pp. 12822-12825.
Solovyev et al., "Corrected Atomic Limit in the Local-Density Approximation and the Electronic Structure of d Impurities in Rb," Physical Review B, vol. 50, No. 23, Dec. 15, 1994, pp. 16861-16871.
Campos et al., "Evaluation of the Diffusion Coefficient of Nitrogen in Fe4N1-x Nitride Layers During Microwave Post-Discharge Nitriding," Applied Surface Science, vol. 249, Dec. 30, 2004, pp. 54-59.
Issakov et al., "Fast Analytical Parameters Fitting of Planar Spiral Inductors," 2008 IEEE International Conference on Microwaves, Communications, Antennas and Electronic Systems, May 13-14, 2008, 10 pp.
Borchers et al., "Observation of Antiparallel Magnetic Order in Weakly Coupled Co/Cu Multilayers," Physical Review Letters, vol. 82, No. 13, Mar. 29, 1999, pp. 2796-2799.
Takahashi et al., "Structure and Magnetic Moment of α"-Fe16N2 Compound Films: Effect of Co and H on Phase Formation (Invited)," Journal of Applied Physics, vol. 79, No. 8, Apr. 15, 1996, pp. 5564-5569.
Buschbeck et al., "Full Tunability of Strain Along the fcc-bcc Bain Path in Epitaxial Films and Consequences for Magnetic Properties," Physical Review Letters, vol. 103, Nov. 20, 2009, 4 pp.
Chakhalian et al., "Magnetism at the Interface Between Ferromagnetic and Superconducting Oxides," Nature Physics, vol. 2, Apr. 1, 2006, pp. 244-248.
Cui et al., "Phase Transformation and Magnetic Anisotropy of an Iron-Palladium Ferromagnetic Shape-Memory Alloy," Acta Materialia, vol. 52, No. 1, Jan. 5, 2004, 35-47.
Davies et al., "Anisotropy Dependence of Irreversible Switching in Fe/SmCo and FeNi/FePt Exchange Spring Magnet Films," Applied Physics Letters, vol. 86, No. 26, Jun. 27, 2005, 3 pp.
Herbst et al., "Neodymium-Iron-Boron Permanent Magnets," Journal of Magnetism and Magnetic Materials, vol. 100, Nos. 1-3, Nov. 1991, pp. 57-78.
Fidler et al., "Recent Developments in Hard Magnetic Bulk Materials," Journal of Physics: Condensed Matter, vol. 16, Jan. 23, 2004, pp. 455-470.
Haenl et al., "Room-Temperature Ferroelectricity in Strain SrTiO3," Nature, vol. 430, Aug. 12, 2004, pp. 758-761.
Hoppler et al., "Giant Superconductivity-Induced Modulation of the Ferromagnetic Magnetization in a Cuprate-Manganite Superlattice," Nature Materials, vol. 8, Apr. 2009, pp. 315-319.
Coey, "The Magnetization of Bulk α"-Fe16N2 (Invited)," Journal of Applied Physics, vol. 76, No. 19, Nov. 15, 1994, pp. 6632-6636.
Coey et al., "The Magnetization of α"-Fe16N2," Journal of Physics: Condensed Matter, vol. 6, Sep. 27, 1993, pp. 23-28.
Coey, "Magic Moments in Magnetism," Physics World, vol. 6, No. 8, Aug. 1993, pp. 25-26.

(56) References Cited

OTHER PUBLICATIONS

Qiu et al., "Tuning the Crystal Structure and Magnetic Properties of FePt Nanomagnets," Advanced Materials, vol. 19, Jun. 6, 2007, pp. 1703-1706.
Wang, "FePt Magnetic Nanoparticles and Their Assembly for Future Magnetic Media," Proceedings of the IEEE, vol. 96, No. 11, Nov. 2008, pp. 1847-1863.
Qiu et al., "Monodispersed and Highly Ordered L10 FePt Nanoparticles Prepared in the Gas Phase," Applied Physics Letters, vol. 88, May 9, 2006, 3 pp.
Qiu et al., "In Situ Magnetic Field Alignment of Directly Ordered L10 FePt Nanoparticles," Applied Physics Letters, vol. 89, Nov. 29, 2006, 3 pp.
Liu et al., "High Energy Products in Rapidly Annealed Nanoscale Fe/Pt Multilayers," Applied Physics Letters, vol. 72, No. 4, Jan. 26, 1998, pp. 483-485.
Wang et al., "Fabrication of Fe16N2 Films by Sputtering Process and Experimental Investigation of Origin of Giant Saturation Magnetization in Fe16N2," IEEE Transactions on Magnetics, vol. 48, No. 5, May 2012, pp. 1710-1717.
Shi et al., "Diamond-Like Carbon Films Prepared by Facing-Target Sputtering," Thin Solid Films, vols. 420-421, Dec. 2, 2002, pp. 172-175.
Zhou et al., "Permanent-Magnet Properties of Thermally Processed FePt and FePt—Fe Multilayer Films," IEEE Transactions on Magnetics, vol. 38, No. 5, Sep. 2002, pp. 2802-2804.
Maclaren, "Role of Alloying on the Shape Memory Effect in Ni2MnGa," Journal of Applied Physics, vol. 91, No. 10, May 15, 2002, pp. 7801-7803.
Perdew et al., "Self-Interaction Correction to Density-Functional Approximations for Many-Electron Systems," Physical Review B, vol. 23, No. 10, May 15, 1981, pp. 5048-5079.
Jiang et al., "Improving Exchange-Spring Nanocomposite Permanent Magnets," Applied Physics Letters, vol. 85, No. 22, Nov. 29, 2004, pp. 5293-5295.
Dong et al., "Shape Memory and Ferromagnetic Shape Memory Effects in Single-Crystal Ni2MnGa Thin Films," Journal of Applied Physics, vol. 95, No. 5, Mar. 1, 2004, pp. 2593-2600.
Bland et al., "Ferromagnetic Moments in Metastable Magnetic Films by Spin-Polarized-Neutron Reflection," Physical Review Letters, vol. 58, No. 12, Mar. 23, 1987, pp. 1244-1247.
Bland et al., "Layer Selective Magnetometry in Ultrathin Magnetic Structures by Polarised Neutron Reflection," Journal of Magnetism and Magnetic Materials, vol. 165, Jun. 1997, pp. 46-51.
Ji et al., "Elemental Specific Study on FeCo—Au nanoparticles," Bulletin of the American Physical Society, APS Meeting 2010, vol. 55, No. 2, Mar. 15-19, 2010, 1 pp.
Coey, "Permanent Magnet Applications" Journal of Magnetism and Magnetic Materials, vol. 248, Apr. 24, 2002, pp. 441-456.
Zhang et al., "Polarizer angular dependence of spin transfer oscillation in magnetic tunnel junction," Bulletin of the American Physical Society, APS Meeting 2010, vol. 55, No. 2, Mar. 15-19, 2010, 1 pp.
Kronmüller et al., "Micromagnetic Analysis of the Magnetic Hardening Mechanisms in Re—Fe—B Magnets," Journal De Physique, C8, No. 12, Tome 49, Dec. 1988, 6 pp.
Tang et al., "Formation of Nanocrystalline Fe—N—B—Cu Soft Magnetic Ribbons," Journal of Non-Crystalline Solids, vol. 337, Sep. 9, 2003, pp. 276-279.
Chen et al., "Modeling of On-Chip Differential Inductors and Transformers/Baluns," IEEE Transactions on Electron Devices, vol. 54, No. 2, Feb. 2007, pp. 369-371.
Ji et al., "N Site Ordering Effect on Partially Ordered Fe16N2," Applied Physics Letters, vol. 98, No. 9, Feb. 28, 2011, 3 pp.
Ji et al., "Epitaxial High Saturation Magnetization FeN Thin Films on Fe(001) Seeded GaAs(001) Single Crystal Wafer Using Facing Target Sputterings," Journal of Applied Physics, vol. 109, No. 7, Apr. 2011, 6 pp.
Ji et al., "Theory of Giant Saturation Magnetization in α"-Fe16N2: Role of Partial Localization in Ferromagnetism of 3d Transition Metals," New Journal of Physics, vol. 12, Jun. 17, 2010, 8 pp.
Cho, "The Best Refrigerator Magnet Ever?," Science/AAAD News, Science Now, Mar. 19, 2010, retrieved from the internet http://news.sciencemag.org/physics/2010/03/best-refrigerator-magnet-ever?sms_ss=email, 2 pp.
Ji et al., "Perpendicular Magnetic Anisotropy and High Spin-Polarization Ratio in Epitaxial Fe—N Thin Films," Physical Review B, vol. 84, Dec. 14, 2011, 8 pp.
Ziegler, "SRIM—The Stopping and Range of Ions in Matter," retrieved from , http://srim.org/ on Oct. 13, 2016, 4 pp.
Jiang et al., "FeN Foils by Nitrogen Ion-Implantation," Journal of Applied Physics, vol. 115, Mar. 12, 2014, 3 pp.
Jiang et al., "9 T High Magnetic Field Annealing Effects on FeN Bulk Sample," Journal of Applied Physics, vol. 115, Mar. 13, 2014, 3 pp.
"International Energy Outlook 2013," U.S. Energy Information Administration, Jul. 2013, 312 pp.
Croat, "Current Status of Rapidly Solidified Nd—Fe—B Permanent Magnets," IEEE Transactions on Magnetics, vol. 25, No. 5, Sep. 1989, pp. 3550-3554.
Perdew et al., "Generalized Gradient Approximation Made Simple," Physical Review Letters, vol. 77, No. 18, Oct. 28, 1996, pp. 3865-3868.
Guo et al., "A Broadband and Scalable Model for On-Chip Inductors Incorporating Substrate and Conductor Loss Effects," IEEE Radio Frequency Integrated Circuits Symposium, Jun. 12-14, 2005, pp. 593-596.
Jack, "The Occurrence and the Crystal Structure of α"-Iron Nitride; a New Type of Interstitial Alloy Formed During the Tempering of Nitrogen-Martensite," Proceedings of the Royal Society of London, vol. 208, Sep. 24, 1951, pp. 216-224.
Jack, "The Iron-Nitrogen System: the Preparation and the Crystal Structures of Nitrogen-Austenite (γ) and Nitrogen-Martensite (⊕')*," Proceedings of the Royal Society of London, Mar. 13, 1951, pp. 200-217.
Yamanaka et al., "Humidity Effects in Fe16N2 Fine Powder Preparation by Low-Temperature Nitridation," Journal of Solid State Chemistry, vol. 183, Aug. 4, 2010, pp. 2236-2241.
Frisk, "A New Assessment of the Fe—N Phase Diagram" Calphad, vol. 11, No. 2, 1987, pp. 127-134. (Applicant points out, in accordance with MPEP 609.04(a), that the year of publication, 1987, is sufficiently earlier than the effective U.S. filing date, Jun. 27, 2013, so that the particular month of publication is not in issue.).
Nakajima et al., "Large Magnetization Induced in Single Crystalline Iron Films by High-Dose Nitrogen Implantation," Applied Physics Letters, vol. 56, No. 1, Jan. 1, 1990, pp. 92-94.
Nakajima et al., "Nitrogen-Implantation-Induced Transformation of Iron to Crystalline Fe16N2 in Epitaxial Iron Films," Applied Physics Letters, vol. 54, No. 25, Jun. 19, 1989, pp. 2536-2538.
Nakajima et al., "Formation of Ferromagnetic Iron Nitrides in Iron Thin Films by High-Dose Nitrogen Ion Implantation," Journal of Applied Physics, vol. 65, No. 11, Jun. 1, 1989, pp. 4357-4361.
Kaneko et al., "Fe—Cr—Co Ductile Magnet With (BH)max = 8 MGOe," AIP Conference Proceedings, 1976, 2 pp. (Applicant points out, in accordance with MPEP 609.04(a), that the year of publication, 1976, is sufficiently earlier than the effective U.S. filing date, Jun. 27, 2013, so that the particular month of publication is not in issue.).
Strnat, "Modern Permanent Magnets for Applications in Electro-Technology," Proceedings of the IEEE, vol. 78, No. 6, Jun. 1990, pp. 923-946.
Strnat et al., "Bonded Rare Earth-Cobalt Permanent Magnets," Proceedings of the 12th Rare Earth Research Conference, vol. 1, Jul. 18-22, 1976, 11 pp.
Strnat et al., "Rare Earth-Cobalt Permanent Magnets," Journal of Magnetism and Magnetic Materials, vol. 100, Nos. 1-3, Nov. 1991, pp. 38-56.
Yang et al., "The Effect of Strain Induced by Ag Underlayer on Saturation Magnetization of Partially Ordered Fe16N2 Thin Films," Applied Physics Letters, vol. 103, Dec. 12, 2013, 4 pp.

(56) References Cited

OTHER PUBLICATIONS

Lewis et al., "Perspectives on Permanent Magnetic Materials for Energy Conversion and Power Generation," Metallurgical and Materials Transactions A, vol. 44A, Jan. 2013, 19 pp.
Pauling, "The Nature of the Interatomic Forces in Metals," Physical Review, vol. 54, Dec. 1, 1938, pp. 899-904.
Davison et al., "Shock Compression of Solids," Physics Reports, vol. 55, No. 4, Apr. 1979, pp. 255-379.
Liu et al., "Nanocomposite Exchange-Spring Magnet Synthesized by Gas Phase Method: From Isotropic to Anisotropic," Applied Physics Letters, vol. 98, Jun. 3, 2011, 3 pp.
Liu et al., "Discovery of localized states of Fe 3D electrons in Fe16N2 and Fe8N films: An evidence of the existence of giant saturation magnetization," arXiv: 0909.4478, Sep. 2009, 13 pp.
Amato et al., "Exchange-Spring Behavior of Hard/Soft Magnetic Multilayers: Optimization Study of the Nanostructure," Physica B: Condensed Matter, vol. 275, Nos. 1-3, Jan. 2000, pp. 120-123.
Tijssens et al., "Towards an Improved Continuum Theory for Phase Transformations," Materials Science and Engineering, vol. 378, Sep. 23, 2003, pp. 453-458.
Komuro et al., "Epitaxial Growth and Magnetic Properties of Fe16N2 Films with High Saturation Magnetic Flux Density (Invited)," Journal of Applied Physics, vol. 67, No. 9, May 1, 1990, pp. 5126-5130.
Brady et al., "Alloy Design of Intermetallics for Protective Scale Formation and for use as Precursors for Complex Ceramic Phase Surfaces," Intermetallics, vol. 12, Apr. 1, 2004, pp. 779-789.
Brady et al., "Pre-Oxidized and Nitrided Stainless Steel Alloy Foil for Proton Exchange Membrane Fuel Cell Bipolar Plates: Part 1. Corrosion, Interfacial Contact Resistance, and Surface Structure," Journal of Power Sources, vol. 195, Mar. 20, 2010, pp. 5610-5618.
"Annual Energy Outlook 2015, with projects to 2040," U.S. Energy Information Administration, Apr. 2015, 154 pp.
Kim et al., "New Magnetic Material Having Ultrahigh Magnetic Moment," Applied Physics Letters, vol. 20, No. 12, Jun. 15, 1972, pp. 492-494.
Zhuge et al., "Preparation and Property of Iron Nitrides by Ball Mill Method," Journal of Functional Materials, vol. 31, No. 5, 2000, pp. 471-472 (Abstract Only (on last page)) (Applicant points out, in accordance with MPEP 609.04(a), that the year of publication, 2000, is sufficiently earlier than the effective U.S. filing date, Jun. 27, 2013, so that the particular month of publication is not in issue.).
Takahashi et al., "Magnetic Moment of α"-Fe16N2 Films (Invited)," Journal of Applied Physics, vol. 76, No. 10, Nov. 15, 1994, pp. 6642-6647.
Takahashi et al., "Structure and Magnetic Moment of Fe16N2 Sputtered Film," Journal of Magnetism and Magnetic Materials, vol. 174, Nos. 1-2, Oct. 1, 1997, pp. 57-69.
Takahashi et al., "Magnetocrystalline Anisotropy for α'-Fe—C and α'-Fe—N Films," IEEE Transactions on Magnetics, vol. 37, No. 4, Jul. 2001, pp. 2179-2181.
Mühlethaler et al., "Improved Core-Loss Calculation for Magnetic Components Employed in Power Electronic Systems," IEEE Transactions on Power Electronics, vol. 27, No. 2, Feb. 2012, pp. 964-973.
Watanabe et al., "Perpendicular Magnetization of Epitaxial FePt(001) Thin Films with High Squareness and High Coercive Force," Japanese Journal of Applied Physics, vol. 35, No. 10A, Oct. 1, 1996, pp. 1264-1267.
Zhang et al., "Thermal Stability of Partially Ordered Fe16N2 Film on Non-Magnetic Ag Under Layer," Journal of Applied Physics, vol. 115, No. 17A, Mar. 20, 2014, 3 pp.
Uijttewaal et al., "Understanding the Phase Transitions of the Ni2MnGa Magnetic Shape Memory System from First Principles," Physical Review Letters, vol. 102, Jan. 23, 2009, 4 pp.
Pugaczowa-Michalska et al., "Electronic Structure and Magnetic Properties of Ni2MnGa1—xGex and Disordered Ni2MnSn Heusler Alloys," Acta Physica Polonica A, vol. 115, No. 1, Jan. 2009, pp. 241-243.
Brewer et al., "Magnetic and Physical Microstructure of Fe16N2 Films Grown Epitaxially on Si(001)," Journal of Applied Physics, vol. 81, No. 8, Apr. 15, 1997, pp. 4128-4130.
Abdellateef et al., "Magnetic Properties and Structure of the α"-Fe16N2 Films," Journal of Magnetism and Magnetic Materials, vol. 256, Nos. 1-3, Jan. 11, 2003, pp. 214-220.
Brewer et al., "Epitaxial Fe16N2 Films Grown on Si(001) by Reactive Sputtering," Journal of Applied Physics, vol. 79, No. 8, Apr. 15, 1996, pp. 5321-5323.
Van Genderen et al., "Atom Probe Analysis of the First Stage of Tempering of Iron-Carbon-Nitrogen Martensite," Zeitschrift Für Metallkunde, vol. 88, No. 5, May 1997, pp. 401-409.
Takahashi et al., "Impurity effect of carbon on structure and saturation magnetization of Fe—N films," Journal of Magnetism and Magnetic Materials, vol. 210, Sep. 1, 1999, pp. 333-340.
Huang et al., "Magnetism of α'-FeN Alloys and α"-(Fe16N2) Fe Nitrides," Journal of Magnetism and Magnetic Materials, vol. 135, Nov. 30, 1993, pp. 226-230.
Huang et al., "Spin-Density Distribution in Ferromagnetic α"-Fe16N2," Physical Review B: Condensed Matter, vol. 51, No. 5, Feb. 1, 1995, pp. 3222-3225.
Cococcioni et al., "Linear Response Approach to the Calculation of the Effective Interaction Parameters in the LDA+U Method," Physical Review B, vol. 71, Jan. 18, 2005, 16 pp.
Takahashi, "Discovery of Fe16N2 with Giant Magnetic Moment and Its Future View," IEEE Translation Journal on Magnetics in Japan, vol. 6, No. 12, Dec. 1991, pp. 1024-1038.
Zhang et al., "Strain Effect of Multilayer FeN Structure on GaAs Substrate," Journal of Applied Physics, vol. 113, No. 17, Apr. 10, 2013, 3 pp.
"New Compound Opens Way to EV Magnet without Rare Earths," Nikkei.com Morning Edition, Mar. 4, 2011, 1 pp.
Coey et al., "Magnetic nitrides," Journal of Magnetism and Magnetic Materials, vol. 200, Mar. 10, 1999, pp. 405-420.
Tomioka et al., "Iron Nitride Powder Produced as Substitute for Rare Metal," Nikkei Technology, Mar. 7, 2011, 2 pp.
Ji et al., "Direct Observation of Giant Saturation Magnetization in Fe16N2," arXiv: 1211.0553, Nov. 2012, 27 pp.
Zheng et al., "Iron Nitride Thin Films Deposited by Chloride Assisted Plasma Enhanced Chemical Vapour Deposition: Facile Stoichiometry Control and Mechanism Study," Journal of Applied Physics D: Applied Physics, vol. 42, No. 18, Sep. 21, 2009, 9 pp.
Ji et al., "Strain Induced Giant Magnetism in Epitaxial Fe16N2 Thin Film," Applied Physics Letters, vol. 102, Feb. 21, 2013, 4 pp.
Lanska et al., "Composition and Temperature Dependence of the Crystal Structure of Ni—Mn—Ga Alloys," Journal of Applied Physics, vol. 95, No. 12, Jun. 15, 2004, pp. 8074-8078.
Takahashi et al., "Growth Mechanism of FeN Films by Means of an Atmospheric Pressure Halide Chemical Vapor Deposition," Materials Chemistry and Physics, vol. 65, Jan. 18, 2000. pp. 113-116.
Ji et al., "Growth and Depth-Dependence of Saturation Magnetization of Iron Nitride Thin Films on MgO Substrate," Spin, vol. 2, No. 1, Mar. 2012, 4 pp.
"Nanocrystalline soft magnetic material, FINEMET," Materials Magic, Hiatchi Metals, Apr. 2005, 12 pp.
Gutfleisch et al., "Magnetic Materials and Devices for the 21st Century: Stronger, Lighter, and More Energy Efficient," Advanced Materials, vol. 23, 2011, Dec. 15, 2010, pp. 821-842.
Ferguson et al., "The Tempering of Fe—C—N Martensite" Scripta Metallurgica, vol. 18, No. 11, Nov. 1984, pp. 1189-1194.
Brown et al., "The Crystal Structure and Phase Transitions of the Magnetic Shape Memory Compound Ni2MnGa," Journal of Physics: Condensed Matter, vol. 14, No. 43, Oct. 18, 2002, pp. 10159-10171.
Bruno, "Tight-Binding Approach to the Orbital Magnetic Moment and Magnetocrystalline Anisotropy of Transition-Metal Monolayers," Physical Review B, vol. 39, No. 1, Jan. 1, 1989, pp. 865-868.
Blöchl, "Projector Augmented-Wave Method," Physical Review B, vol. 50, No. 24, Dec. 15, 1994, pp. 17953-17979.
Entel et al., "Ab Initio Modeling of Martensitic Transformation (MT) in Magnetic Shape Memory Alloys," Journal of Magnetism and Magnetic Materials, vol. 310, Nov. 27, 2006, pp. 2761-2763.

(56) References Cited

OTHER PUBLICATIONS

Hohenberg et al., "Inhomogeneous Electron Gas," Physical Review, vol. 136, No. 3B, Nov. 9, 1964, pp. 864-871.
Sit et al., "Realistic Quantitative Descriptions of Electron Transfer Reactions: Diabatic Free-Energy Surfaces from First-Principles Molecular Dynamics," Physical Review Letters, vol. 97, Jul. 11, 2006, 4 pp.
Paseka et al., "Structure and Magnetic Properties of Ball-Milled Iron Nitride Powders," Journal of Alloys and Compounds, vol. 274, Mar. 10, 1998, pp. 248-253.
Giannozzi et al., "Quantum ESPRESSO: A Modular and Open-Source Software Project for Quantum Simulations of Materials," Journal of Physics: Condensed Matter, vol. 21, Sep. 1, 2009, pp. 1-19.
Tong et al., "Low Temperature Wafer Direct Bonding," Journal of Microelectromechanical Systems, vol. 3, No. 1, Mar. 1994, pp. 29-35.
Fan et al., "Ferromagnetism at the Interfaces of Antiferromagnetic FeRh Epilayers," Physical Review B, vol. 82, Nov. 12, 2010, 5 pp.
Yao et al., "Formation and Magnetic Properties of Fe16N2 Films Prepared by Ion-Beam-Assisted Deposition," Journal of Magnetism and Magnetic Materials, vol. 177-181, Jan. 1998, pp. 1291-1292.
Skomski et al., "Giant Energy Product in Nanostructured Two-Phase Magnets," Physical Review B, vol. 48, No. 21, Dec. 1, 1993, pp. 15812-15816.
Tickle et al., "Magnetic and Magnetomechanical Properties of Ni2MnGa," Journal of Magnetism and Magnetic Materials, vol. 195, No. 3, Jun. 11, 1999, pp. 627-638.
Sabiryanov et al., "Electronic Structure and Magnetic Properties of Hard/Soft Multilayers," Journal of Magnetism and Magnetic Materials, vol. 177-181, Pt. 2, Jan. 1998, pp. 989-990.
Metzger et al., "Magnetism of α"-Fe16N2 (Invited)," Journal of Applied Physics, vol. 76, No. 10, Nov. 15, 1994, pp. 6626-6631.
Kardonina et al., "Transformations in the Fe—N System," Metal Science and Heat Treatment, vol. 52, Nos. 9-10, Oct. 2010, pp. 5-15.
Chu et al., "Opportunities and Challenges for a Sustainable Energy Future," Nature, vol. 488, No. 7411, Aug. 16, 2012, pp. 294-303.
Blundell et al., "Polarized Neutron Reflection as a Probe of Magnetic Films and Multilayers," Physical Review B, vol. 46, No. 6, Aug. 1, 1992, pp. 3391-3400.
Zhang et al., "Energy Barriers and Hysteresis in Martensitic Phase Transformations," Acta Materialia, vol. 57, Jul. 17, 2009, pp. 4332-4352.
Kikkawa et al., "Particle Size Dependence in Low Temperature Nitridation Reaction for Fe16N2," Journal of Alloys and Compounds, vol. 449, Dec. 21, 2006 (online), pp. 7-10.
Okamoto et al., "Crystal Distortion and the Magnetic Moment of Epitaxially Grown α"-Fe16N2," Journal of Magnetism and Magnetic Materials, vol. 208, Jul. 12, 1999, pp. 102-114.
Roy et al., "Depth Profile of Uncompensated Spins in an Exchange Bias System," Physical Review Letters, vol. 95, Jul. 21, 2005, 4 pp.
Uchida et al., "Magnetocrystalline Anisotropy Energies of Fe16N2 and Fe16C2," Journal of Magnetism and Magnetic Materials, vol. 310, Nov. 15, 2006, pp. 1796-1798.
Wang et al., "Properties of a New Soft Magnetic Material," Nature, vol. 407, Sep. 14, 2000, pp. 150-151.
Dudarev et al., "Electron-Energy-Loss Spectra and the Structural Stability of Nickel Oxide: An LSDA+U Study," Physical Review B, vol. 57, No. 3, Jan. 15, 1998, pp. 1505-1509.
Kart et al., "DFT Studies on Structure, Mechanics and Phase Behavior of Magnetic Shape Memory Alloys: Ni2MnGa," Physica Status Solidi, vol. 205, No. 5, Mar. 20, 1998, pp. 1026-1035.
Barman et al., "Structural and Electronic Properties of Ni2MnGa," Physical Review B, vol. 72, Nov. 8, 2005, 7 pp.
Atiq et al., "Preparation and the Influence of Co, Pt and Cr Additions on the Saturation Magnetization of α"-Fe16N2 Thin Films," Journal of Alloys and Compounds, vol. 479, Feb. 23, 2009, pp. 755-758.
Okamoto et al., "Characterization of Epitaxially Grown Fe—N Films by Sputter Beam Method," Journal of Applied Physics, vol. 79, No. 3, Feb. 1, 1996, pp. 1678-1683.
Sugita et al., "Magnetic and Mössbauer Studies of Single-Crystal Fe16N2 and Fe—N Martensite Films Epitaxially Grown by Molecular Beam Epitaxy (Invited)," Journal of Applied Physics, vol. 76, No. 10, Nov. 15, 1994, pp. 6637-6641.
Sugita et al., "Giant Magnetic Moment and Other Magnetic Properties of Epitaxially Grown Fe16N2 Single-Crystal Films (Invited)," Journal of Applied Physics, vol. 70, No. 10, Nov. 15, 1991, pp. 5977-5982.
Toops et al., "Pre-Oxidized and Nitrided Stainless Steel Alloy Foil for Proton Exchange Membrane Fuel Cell Bipolar Plates. Part 2: Single-Cell Fuel Evaluation of Stamped Plates," Journal of Power Sources, vol. 195, Mar. 19, 2010, pp. 5619-5627.
Klemmer et al., "Magnetic Hardening and Coercivity Mechanisms in L1 Ordered FePd Ferromagnets," Scripta Metallurgica et Materialia, vol. 33, Nos. 10-11, Dec. 1, 1995, pp. 1793-1805.
Ohtani et al., "Magnetic Properties of Mn—Al—C Permanent Magnet Alloys," IEEE Transactions on Magnetics, vol. MAG-13, No. 5, Sep. 1977, pp. 1328-1330.
Osaka et al., "A Soft Magnetic CoNiFe Film With High Saturation Magnetic Flux Density and Low Coercivity," Nature, vol. 392, Apr. 23, 1998, pp. 796-798.
Schrefl et al., "Exchange Hardening in Nano-Structured Two-Phase Permanent Magnets," Journal of Magnetism and Magnetic Materials, vol. 127, Jul. 12, 1993, pp. 273-277.
Kakeshita et al., "Effect of Magnetic Fields on Athermal and Isothermal Martensitic Transformations in Fe—Ni—Mn Alloys," Materials Transactions, vol. 34, No. 5, Dec. 9, 1992, pp. 415-422.
Koyano et al., "Magnetization of α' Iron Nitride Produced Through the fcc→bct Martensitic Transformation in High Magnetic Field," Journal of Applied Physics, vol. 100, No. 3, Aug. 1, 2006, 5 pp.
Oku et al., "Small-Angle Polarized Neutron Scattering Study of Spherical Fe16N2 Nano-Particles for Magnetic Recording Tape," Physica B, vol. 404, Sep. 1, 2009, pp. 2575-2577.
Shimoda et al., "High-Energy Cast Pr—Fe—B Magnets," Journal of Applied Physics, vol. 64, No. 10, Nov. 15, 1988, pp. 5290-5292.
Weber et al., "Search for Giant Magnetic Moments in Ion-Beam-Synthesized α"-Fe16N2," Thin Solid Films, vol. 279, Nos. 1-2, Jun. 1996, pp. 216-220.
Watanabe et al., "A New Challenge: Grain Boundary Engineering for Advanced Materials by Magnetic Field Application," Journal of Materials Science, vol. 41, No. 23, Oct. 24, 2006 (online), pp. 7747-7759.
Takahashi et al., "Preparation of FeN Thin Films by Chemical Vapor Deposition Using a Chloride Source," Materials Letters, vol. 42, No. 6, Mar. 2000, pp. 380-382.
Stern et al., "Electronic and Structural Properties of Fe3Pd—Pt Ferromagnetic Shape Memory Alloys," Journal of Applied Physics, vol. 91, No. 10, May 15, 2002, pp. 7818-7820.
Qian et al., "NiZn Ferrite Thin Films Prepared by Facing Target Sputtering," IEEE Transactions Magnetics, vol. 33, No. 5, Sep. 1997, pp. 3748-3750.
Takahashi et al., "New Soft Magnetic Material of α'-Fe—C With High Bs," Journal of Magnetism and Magnetic Materials, vol. 239, Nos. 1-3, Feb. 1, 2002, pp. 479-483.
Inoue et al., "Enhancement of the Formation of Fe16N2 on Fe Films by Co Additions (Invited)," Journal of Applied Physics, vol. 76, No. 10, Nov. 15, 1994, pp. 6653-6655.
Tsuchiya et al., "Spin Transition in Magnesiowüstite in Earth's Lower Mantle," Physical Review Letters, vol. 94, May 18, 2006, 4 pp.
Liu et al., "Nucleation Behavior of Bulk Ni—Cu Alloy and Pure Sb in High Magnetic Fields," Journal of Crystal Growth, vol. 321, Mar. 2, 2011, pp. 167-170.
Liu et al., "Effects of High Magnetic Fields on Solidification Microstructure of Al—Si Alloys," Journal of Material Science, vol. 46, Oct. 22, 2010, pp. 1628-1634.
Okunev et al., "The Low-Temperature Electric Conductivity of YBaCuO and LaSrMnO Dielectric Films Obtained by a Pulsed Laser Sputter Deposition Technique," Technical Physics Letters, vol. 26, No. 10, May 6, 2000, pp. 903-906.
Anisimov et al., "Density-Functional Calculation of Effective Coulomb Interactions in Metals," Physical Review B, vol. 43, No. 10, Apr. 1, 1991, pp. 7570-7574.

(56) References Cited

OTHER PUBLICATIONS

Anisimov et al., "Band-Structure Description of Mott Insulators (NiO, MnO, FeO, CoO)," Journal of Physics: Condensed Matter, vol. 2, No. 17, Apr. 30, 1990, pp. 3973-3987.
Anisimov et al., "First-Principles Calculations of the Electronic Structure and Spectra of Strongly Correlated Systems: the LDA+U Method," Journal of Physics: Condensed Matter, vol. 9, No. 4, Jan. 27, 1997, pp. 767-808.
Anisimov et al., "Band Theory and Mott Insulators: Hubbard U Instead of Stoner I," Physical Review B, vol. 44, No. 3, Jul. 15, 1991, pp. 943-954.
Campo et al., "Extended DFT + U + V Method With On-Site and Inter-Site Electronic Interactions," Journal of Physics: Condensed Matter, vol. 22, Jan. 19, 2010 (online), 12 pp.
Nimura et al., "Facing Targets Sputtering System for Depositing Co—Cr Perpendicular Magnetic Recording Media," Journal of Vacuum Science Technology, vol. 5, No. 1, Jan. 1987, pp. 109-110.
Lauter et al., "Highlights from the Magnetism Reflectometer at the SNS," Physica B, vol. 404, Sep. 1, 2009, pp. 2543-2546.
Godlevsky et al., "Soft Tetragonal Distortions in Ferromagnetic Ni2MnGa and Related Materials from First Principles," Physical Review B, vol. 63, Mar. 2, 2001, 5 pp.
Hou et al., "SmCo5/Fe Nanocomposites Synthesized from Reductive Annealing of Oxide Nanoparticles," Applied Physics Letters, vol. 91, Oct. 12, 2007, 3 pp.
Zhang et al., "Shift of the Eutectoid Point in the Fe—C Binary System by a High Magnetic Field," Journal of Physics D: Applied Physics, vol. 40, Oct. 19, 2007, pp. 6501-6506.
Pickett et al., "Reformulation of the LDA + U Method for a Local-Orbital Basis," Physical Review B, vol. 58, No. 3, Jul. 15, 1998, pp. 1201-1209.
Kohn et al., "Self-Consistent Equations Including Exchange and Correlation Effects," Physical Review, vol. 140, No. 4A, Nov. 15, 1965, pp. 1133-1138.
Gong et al., "Mechanically Alloyed Nanocomposite Magnets," Journal of Applied Physics, vol. 75, No. 10, May 15, 1994, pp. 6649-6651.
Li et al., "Effect of Assistant rf Field on Phase Composition of Iron Nitride Film Prepared by Magnetron Sputtering Process," Journal of Vacuum Science & Technology A, vol. 24, No. 1, Dec. 23, 2005 (online), pp. 170-173.
Liu et al., "Nanocrystalline Soft Magnetic Ribbon with α"-Fe16N2 Nanocrystallites Embedded in Amorphous Matrix," Journal of Magnetism and Magnetic Materials, vol. 320, Jun. 10, 2008, pp. 2752-2754.
Wallace et al., "Enhanced Fe Moment in Nitrogen Martensite and Fe16N2 (Invited)," Journal of Applied Physics, vol. 76, No. 10, Nov. 15, 1994, pp. 6648-6652.
Wang et al., "Searching, Fabricating and Characterizing Magnetic Materials With Giant Saturation Magnetization," TMRC 2014, Aug. 11, 2014, 2 pp.
Wang et al., "Growth, Structural, and Magnetic Properties of Iron Nitride Thin Films Deposited by dc Magnetron Sputtering," Applied Surface Science, vol. 220, May 20, 2003, pp. 30-39.
Yamamoto et al., "Formation of Fe16N2 in Deformed Iron by Ion Implantation Method," Proceedings of 1998 International Conference on Ion Implantation Technology, Jun. 22-26, 1998, 4 pp.
Rui et al., "In-Cluster-Structured Exchange-Coupled Magnets with High Energy Densities," Applied Physics Letters, vol. 89, Sep. 19, 2006, 3 pp.
Bao et al., "Synthesis and Properties of α"-Fe16N2 in Magnetic Particles," Journal of Applied Physics, vol. 75, No. 10, May 15, 1994, pp. 5870-5872.
Gao et al., "Exchange-coupling interaction and effective anisotropy in nanocomposite permanent materials," Chinese Science Bulletin, vol. 47, No. 14, Jul. 2002, 4 pp.
Grhvisditch et al., "Exchange-spring systems: Coupling of hard and soft ferromagnets as measured by magnetization and Brillouin light scattering (Invited)," Journal of Applied Physics, vol. 85, No. 8, Apr. 15, 1999, 5 pp.
Stäblein, "Chapter 7: Hard Ferrites and Plastoferrites," Handbook of Ferromagnetic Materials, vol. 3, 1982, 162 pp. (Applicant points out, in accordance with MPEP 609.04(a), that the year of publication, 1982, is sufficiently earlier than the effective U.S. filing date, June 27, 2013, so that the particular month of publication is not in issue.).
Murata et al., "Physical Properties of Steel and Nitrogen," Japan, Agne Gijutsu Center Inc., Dec. 15, 2005, 8 pp.
First Examination Report from counterpart Australian Application No. 2014302668, dated Feb. 1, 2016, 3 pp.
Second Examination Report from counterpart Australian Application No. 2014302668, dated Sep. 8, 2016, 3 pp.
Notice of Allowance from counterpart Canadian Application No. 2916483, dated Jul. 29, 2016, 1 pp.
Office Action from counterpart Canadian Application No. 2916483, dated Jan. 14, 2016, 4 pp.
Communication pursuant to Rules 161(2) and 162 EPC from counterpart European Application No. 14817055.8, dated Mar. 2, 2016, 2 pp.
Notice of Reasons for Rejection, and translation thereof, from counterpart Japanese Application No. 2015-563077, dated Sep. 13, 2016, 17 pp.
Notice of Allowance, and translation thereof, from counterpart Korean Application No. 10-2016-7001572, dated Jul. 6, 2016, 4 pp.
Office Action, and translation thereof, from counterpart Korean Application No. 10-2016-7001572, dated Apr. 7, 2016, 11 pp.
Office Action and Search Report, and translation thereof, from counterpart Taiwan Application No. 103122395, dated May 8, 2015, 12 pp.
Second Office Action, and translation thereof, from counterpart Taiwan Application No. 103122395, dated Mar. 7, 2016, 8 pp.
International Preliminary Report on Patentability from International Application No. PCT/US2014/043902, dated Jun. 15, 2015, 6 pp.
International Search Report and Written Opinion of International Application No. PCT/US2014/043902, dated Oct. 17, 2014, 12 pp.
Response to Examination Report dated Feb. 1, 2016, from counterpart Australian Application No. 2014302668, filed Aug. 30, 2016, 17 pp.
Response to Office Action dated Jan. 14, 2016, from counterpart Canadian Application No. 2916483, filed Jul. 13, 2016, 10 pp.
Reply to Written Opinion dated Oct. 17, 2014, from International Application No. PCT/US2014/043902, filed Apr. 27, 2015, 3 pp.
Response to Communication pursuant to Rules 161(2) and 162 EPC dated Mar. 2, 2016, from counterpart European Application No. 14817055.8, filed Sep. 2, 2016, 13 pp.
U.S. Appl. No. 15/129,439, by Wang et al., filed Sep. 27, 2016.
U.S. Appl. No. 62/107,733, by Wang et al., filed Jan. 26, 2015.
U.S. Appl. No. 62/107,748, by Wang et al., filed Jan. 26, 2015.
U.S. Appl. No. 62/035,245, by Wang et al., filed Aug. 8, 2014.
U.S. Appl. No. 62/035,230, by Wang et al., filed Aug. 8, 2014.
U.S. Appl. No. 62/107,700, by Wang et al., filed Jan. 26, 2015.
U.S. Appl. No. 61/840,221, by Wang et al., filed Jun. 27, 2013.
U.S. Appl. No. 61/840,248 by Wang et al., filed Jun. 27, 2013.
Tanaka, Study on Crystal Structure and Electronic State of Ferromagnetic Nitride a"-Fei6N2, Ouka, Japan, Osaka University, 1999, Jan. 1.
Tanaka, English Translation of Study on Crystal Structure and Electronic State of Ferromagnetic Nitride a-Fei6N2, Ouka, Japan, Osaka University, 1999, Jan. 1.
Jack, The synthesis, structure, and characterization of a"-FeI6N2, Journal of Applied Physics, United States of America, the American Institute of Physics, Nov. 15, 1994, 76, 6620.
Grimsditch et al., Exchange-Spring Systems: Coupling of Hard and Soft Ferromagnets as Measured by Magnetization and Brillouin Light Scattering (invited), Journal of Applied Physics., vol. 85, Apr. 15, 1999, pp. 5901-5904.
Tsubakino et al., "Formation of Fe16N2 in Iron Sheet by an Ion Implantation Method," Materials Chemistry and Physics 54, Elsevier, Jul. 1998, pp. 301-304.
Tsubakino et al., "High Resolution Transmission Electron Microscopic Study of the Formation of Fe16N2 in Bulk Iron by Ion Implantation," Material Letters 26, Elsevier, Feb. 1996, pp. 155-159.

(56) References Cited

OTHER PUBLICATIONS

Response to Exam Report dated Sep. 8, 2016, from counterpart Australian application No. 2014302668 filed Nov. 8, 2016, 4 pp.
Coey et al., "The Magnetization of a"- Fe16N2," Journal of Physics: Condensed Matter, vol. 6, 2004, pp. 23-28, Per MPEP 609.09(a), Applicant points out that the year of publication is sufficently earlier than the effective U.S. filing date and any foreign priority date so that the particular month of publication is not in issue.
Examination Report from counterpart Australian Application No. 2014302668, dated Sep. 8, 2016, 3 pp.
Amended Claims, and translation thereof, from counterpart Japanese Application No. 2015563077, filed Dec. 13, 2016, 22 pp.

* cited by examiner

IRON NITRIDE MATERIALS AND MAGNETS INCLUDING IRON NITRIDE MATERIALS

This application is a national stage entry under 35 U.S.C. § 371 of International Application No. PCT/US2014/043902, filed Jun. 24, 2014, which claims the benefit of U.S. Provisional Patent Application No. 61/840,213, entitled, "TECHNIQUES FOR FORMING IRON NITRIDE WIRE AND CONSOLIDATING THE SAME," and filed Jun. 27, 2013; U.S. Provisional Patent Application No. 61/840,221, entitled, "TECHNIQUES FOR FORMING IRON NITRIDE MATERIAL," and filed Jun. 27, 2013; U.S. Provisional Patent Application No. 61/840,248, entitled "TECHNIQUES FOR FORMING IRON NITRIDE MAGNETS," and filed Jun. 27, 2013; and U.S. Provisional Patent Application No. 61/935,516, entitled "IRON NITRIDE MATERIALS AND MAGNETS INCLUDING IRON NITRIDE MATERIALS," and filed Feb. 4, 2014. The entire contents of International Application No. PCT/US2014/043902; U.S. Provisional Patent Application Nos. 61/840,213; 61/840,221; 61/840,248; and 61/935,516 are incorporated herein by reference for all purposes.

GOVERNMENT INTEREST

This invention was made with Government support under contract number DE-AR0000199 awarded by DOE, Office of ARPA-E. The Government has certain rights in this invention.

TECHNICAL FIELD

The disclosure relates to magnetic materials and techniques for forming magnetic materials.

BACKGROUND

Permanent magnets play a role in many electromechanical systems, including, for example, alternative energy systems. For example, permanent magnets are used in electric motors or generators, which may be used in vehicles, wind turbines, and other alternative energy mechanisms. Many permanent magnets in current use include rare earth elements, such as neodymium, which result in high energy product. These rare earth elements are in relatively short supply, and may face increased prices and/or supply shortages in the future. Additionally, some permanent magnets that include rare earth elements are expensive to produce. For example, fabrication of NdFeB and ferrite magnets generally includes crushing material, compressing the material, and sintering at temperatures over 1000° C., all of which contribute to high manufacturing costs of the magnets. Additionally, the mining of rare earth can lead to severe environmental deterioration.

SUMMARY

The disclosure describes magnetic materials including iron nitride, bulk permanent magnets including iron nitride, techniques for forming magnetic materials including iron nitride, and techniques for forming magnets including iron nitride. Bulk permanent magnets including $Fe_{16}N_2$ may provide an alternative to permanent magnets that include a rare earth element, as $Fe_{16}N_2$ has high saturation magnetization, high magnetic anisotropy constant, and high energy product.

In some examples, the disclosure describes techniques for forming powder including iron nitride using milling of iron-containing raw materials with a nitrogen source, such as an amide- or hydrazine-containing liquid or solution. The amide-containing liquid or solution acts as a nitrogen donor, and, after completion of the milling and mixing, a powder including iron nitride is formed. In some examples, the powder including iron nitride may include one or more iron nitride phases, including, for example, $Fe_8N$, $Fe_{16}N_2$, $Fe_2N_6$, $Fe_4N$, $Fe_3N$, $Fe_2N$, FeN, and $FeN_x$ (where x is in the range of from about 0.05 to about 0.5). The powder including iron nitride may be subsequently used in a technique for forming a permanent magnet including iron nitride.

In some examples, the disclosure describes techniques for forming magnetic materials including at least one $Fe_{16}N_2$ phase domain. In some implementations, the magnetic materials may be formed from a material including iron and nitrogen, such as a powder including iron nitride or a bulk material including iron nitride. In such examples, a further nitriding step may be avoided. In other examples, the magnetic materials may be formed from an iron-containing raw material (e.g., powder or bulk), which may be nitridized as part of the process of forming the magnetic materials. The iron nitride-containing material then may be melted and subjected to a continuous casting, quenching and pressing process to form workpieces including iron nitride. In some examples, workpieces include a dimension that is longer, e.g., much longer, than other dimensions of the workpiece. This dimension of the workpiece may be referred to as the "long dimension" of the workpiece. Example workpieces with a dimension longer than other dimensions include fibers, wires, filaments, cables, films, thick films, foils, ribbons, sheets, or the like.

In other examples, workpieces may not have a dimension that is longer than other dimensions of the workpiece. For example, workpieces can include grains or powders, such as spheres, cylinders, flecks, flakes, regular polyhedra, irregular polyhedra, and any combination thereof. Examples of suitable regular polyhedra include tetrahedrons, hexahedrons, octahedron, decahedron, dodecahedron and the like, non-limiting examples of which include cubes, prisms, pyramids, and the like.

The casting process can be conducted in a gaseous environment, such as, for example, air, a nitrogen environment, an inert environment, a partial vacuum, a full vacuum, or any combination thereof. The casting process can be at any pressure, for example, between about 0.1 GPa and about 20 GPa. In some examples, the casting and quenching process can be assisted by a straining field, a temperature field, a pressure field, a magnetic field, an electrical field, or any combination thereof. In some examples, the workpieces may have a dimension in one or more axis, such as a diameter or thickness, between about 0.1 mm and about 50 mm, and may include at least one $Fe_8N$ phase domain. In some examples, the workpieces may have a dimension in one or more axis, such as a diameter or thickness, between about 0.01 mm and about 1 mm, and may include at least one $Fe_8N$ phase domain.

The workpieces including at least one $Fe_8N$ phase domain may subsequently be strained and post-annealed to form workpieces including at least one $Fe_{16}N_2$ phase domain. The workpieces including at least one $Fe_8N$ phase domain may be strained while being annealed to facilitate transformation of the at least one $Fe_8N$ phase domain into at least one $Fe_{16}N_2$ phase domain. In some examples, the strain exerted on the workpiece may be sufficient to reduce the dimension of the workpiece in one or more axis to less than about 0.1 mm. In some examples, to assist the stretching process, roller and pressure can be applied at the same time, or separately, to reduce workpiece dimension in one or more axis. The temperature during the straining process can be between about −150° C. and about 300° C. In some examples, a workpiece including at least one $Fe_{16}N_2$ phase domain may consist essentially of one $Fe_{16}N_2$ phase domain.

In some examples, the disclosure describes techniques for combining a plurality of workpieces including at least one $Fe_{16}N_2$ phase domain into a magnetic material. Techniques for joining the plurality of workpieces including at least one $Fe_{16}N_2$ phase domain include alloying the workpieces using at least one of Sn, Cu, Zn, or Ag to form an iron alloy at the interface of the workpieces; using a resin filled with Fe or other ferromagnetic particles to bond the workpieces together; shock compression to press the workpieces together; electrodischarge to join the workpieces; electromagnetic compaction to join the workpieces; and any combination of such processes.

In some examples, the disclosure describes techniques for forming a magnetic material from an iron nitride powder. The iron nitride powder may include one or more different iron nitride phases (e.g., $Fe_8N$, $Fe_{16}N_2$, $Fe_2N_6$, $Fe_4N$, $Fe_3N$, $Fe_2N$, FeN, and $FeN_x$ (where x is in the range of from about 0.05 to about 0.5)). The iron nitride powder may be mixed alone or with pure iron powder to form a mixture including iron and nitrogen in an 8:1 atomic ratio. The mixture then may be formed into a magnetic material via one of a variety of methods. For example, the mixture may be melted and subjected to a casting, quenching, and pressing process to form a plurality of workpieces. In some examples, the mixture may also be subjected to a shear field. In some examples, a shear field may aid in aligning one or more iron nitride phase domains (e.g., aligning one or more <001> crystal axes of unit cells of the iron nitride phase domains). The plurality of workpieces may include at least one $Fe_8N$ phase domain. The plurality of workpieces then may be annealed to form at least one $Fe_{16}N_2$ phase domain, sintered and aged to join the plurality of workpieces, and, optionally, shaped and magnetized to form a magnet. As another example, the mixture may be pressed in the presence of a magnetic field, annealed to form at least one $Fe_{16}N_2$ phase domain, sintered and aged, and, optionally, shaped and magnetized to form a magnet. As another example, the mixture may be melted and spun to form an iron nitride-containing material. The iron nitride-containing material may be annealed to form at least one $Fe_{16}N_2$ phase domain, sintered and aged, and, optionally, shaped and magnetized to form a magnet.

In some examples, FeN workpieces may be sintered, bonded, or both sintered and bonded together directly to form bulk magnet. Sintering, bonding, or both may be combined with application of an external magnetic field with constant or varying frequencies (e.g. a pulsed magnetic field) before or during bonding process, to align FeN workpieces orientation and to bond the FeN workpieces together. In this way, an overall magnetic anisotropy can be imparted to the FeN workpieces.

In some examples, the disclosure describes an iron nitride-containing magnetic material that additionally includes at least one ferromagnetic or nonmagnetic dopant. In some examples, at least one ferromagnetic or nonmagnetic dopant may be referred to as a ferromagnetic or nonmagnetic impurity. The ferromagnetic or nonmagnetic dopant may be used to increase at least one of the magnetic moment, magnetic coercivity, or thermal stability of the magnetic material formed from the mixture including iron and nitrogen. Examples of ferromagnetic or nonmagnetic dopants include Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, Ta, and combinations thereof. In some examples, more than one (e.g., at least two) ferromagnetic or nonmagnetic dopants may be includes in the mixture including iron and nitrogen. In some examples, the ferromagnetic or nonmagnetic dopants may function as domain wall pinning sites, which may improve coercivity of the magnetic material formed from the mixture including iron and nitrogen.

In some examples, the disclosure describes an iron nitride-containing magnetic material that additionally includes at least one phase stabilizer. The at least one phase stabilizer may be an element selected to improve at least one of $Fe_{16}N_2$ volume ratio, thermal stability, coercivity, and erosion resistance. When present in the mixture, the at least one phase stabilizer may be present in the mixture including iron and nitrogen at a concentration between about 0.1 at. % and about 15 at. %. In some examples in which at least two phase stabilizers at present in the mixture, the total concentration of the at least two phase stabilizers may be between about 0.1 at. % and about 15 at. %. The at least one phase stabilizer may include, for example, B, Al, C, Si, P, O, Co, Cr, Mn, S, and combinations thereof.

In one example, the disclosure describes a method including heating a mixture including iron and nitrogen to form a molten iron nitride-containing material and casting, quenching, and pressing the molten iron nitride-containing material to form a workpiece including at least one $Fe_8N$ phase domain.

In another example, the disclosure describes a method including disposing a plurality of workpieces including at least one $Fe_{16}N_2$ phase domain adjacent to each other with respective long axes of the plurality of workpieces being substantially parallel to each other, and disposing at least one of Sn, Cu, Zn, or Ag on a surface of at least one workpiece of the plurality of workpieces including at least one $Fe_{16}N_2$ phase domain. In accordance with this example, the method also may include heating the plurality of workpieces including at least one $Fe_{16}N_2$ phase domain and the at least one of Sn, Cu, Zn, or Ag under pressure to form an alloy between Fe and the at least one of Sn, Cu, Zn, or Ag at the interfaces between adjacent workpieces of the plurality of workpieces including at least one $Fe_{16}N_2$ phase domain.

In a further example, the disclosure describes a method including disposing a plurality of workpieces including at least one $Fe_{16}N_2$ phase domain adjacent to each other with respective long axes of the plurality of workpieces being substantially parallel to each other, and disposing a resin about the plurality of workpieces including at least one $Fe_{16}N_2$ phase domain, wherein the resin includes a plurality particles of ferromagnetic material. In accordance with this example, the method also may include curing the resin to bond the plurality of workpieces including at least one $Fe_{16}N_2$ phase domain using the resin.

In an additional example, the disclosure describes a method including disposing a plurality of workpieces including at least one $Fe_{16}N_2$ phase domain adjacent to each other with respective long axes of the plurality of workpieces being substantially parallel to each other, and disposing a plurality particles of ferromagnetic material about the plurality of workpieces including at least one $Fe_{16}N_2$ phase domain. In accordance with this example, the method also may include joining the plurality of workpieces including at least one $Fe_{16}N_2$ phase domain using a compression shock.

In another example, the disclosure describes a method including disposing a plurality of workpieces including at least one $Fe_{16}N_2$ phase domain adjacent to each other with respective long axes of the plurality of workpieces being substantially parallel to each other, and disposing a plurality particles of ferromagnetic material about the plurality of workpieces including at least one $Fe_{16}N_2$ phase domain. In accordance with this example, the method also may include joining the plurality of workpieces including at least one $Fe_{16}N_2$ phase domain using an electromagnetic pulse.

In an additional example, the disclosure describes a method including milling, in a bin of a rolling mode milling apparatus, a stirring mode milling apparatus, or a vibration mode milling apparatus, an iron-containing raw material in the presence of a nitrogen source to generate a powder including iron nitride.

In a further example, the disclosure describes a rolling mode milling apparatus comprising a bin configured to contain an iron-containing raw material and a nitrogen source and mill the iron-containing raw material in the presence of the nitrogen source to generate a powder including iron nitride.

In another example, the disclosure describes a vibration mode milling apparatus comprising a bin configured to contain an iron-containing raw material and a nitrogen source and mill the iron-containing raw material in the presence of the nitrogen source to generate a powder including iron nitride.

In a further example, the disclosure describes a stirring mode milling apparatus comprising a bin configured to contain an iron-containing raw material and a nitrogen source and mill the iron-containing raw material in the presence of the nitrogen source to generate a powder including iron nitride.

In an additional example, the disclosure describes a method including mixing an iron nitride-containing material with substantially pure iron to form a mixture including an iron atom-to-nitrogen atom ratio of about 8:1, and forming a magnetic material comprising at least one $Fe_{16}N_2$ phase domain from the mixture.

In another example, the disclosure describes a method comprising adding at least one ferromagnetic or nonmagnetic dopant into an iron nitride-containing material, and forming a magnet including at least one $Fe_{16}N_2$ phase domain from the iron-nitride containing material including the at least one ferromagnetic or nonmagnetic dopant.

In a further example, the disclosure describes a method comprising adding at least one phase stabilizer for body-center-tetragonal (bct) phase domains into an iron nitride material, and forming a magnet including at least one $Fe_{16}N_2$ phase domain from the iron-nitride containing material including the at least one phase stabilizer for bct phase domains.

The details of one or more examples are set forth in the accompanying drawings and the description below. Other features, objects, and advantages will be apparent from the description and drawings, and from the claims.

BRIEF DESCRIPTION OF DRAWINGS

The summary, as well as the following detailed description, is further understood when read in conjunction with the appended drawings. For the purpose of illustrating the disclosure, there are shown in the drawings examples; however, the disclosure is not limited to the specific techniques, compositions, and devices disclosed. In addition, the drawings are not necessarily drawn to scale. In the drawings.

DETAILED DESCRIPTION

Figure 1:
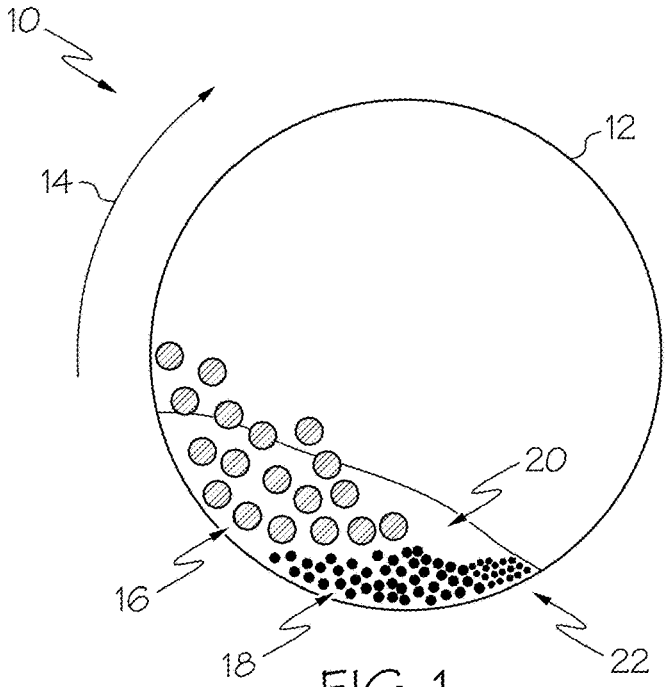
FIG. 1 is a conceptual diagram illustrating a first milling apparatus that may be used to mill an iron-containing raw material with a nitrogen source.

The present disclosure may be understood more readily by reference to the following detailed description taken in connection with the accompanying figures and examples, which form a part of this disclosure. It is to be understood that this disclosure is not limited to the specific devices, methods, applications, conditions or parameters described and/or shown herein, and that the terminology used herein is for the purpose of describing particular examples and is not intended to be limiting of the claims. When a range of values is expressed, another example includes from the one particular value and/or to the other particular value. Similarly, when values are expressed as approximations, by use of the antecedent "about," it will be understood that the particular value forms another example. All ranges are inclusive and combinable. Further, a reference to values stated in a range includes each and every value within that range.

It is to be appreciated that certain features of the disclosure which are, for clarity, described herein in the context of separate examples, may also be provided in combination in a single example. Conversely, various features of the disclosure that are, for brevity, described in the context of a single example, may also be provided separately or in any subcombination.

The disclosure describes magnetic materials including iron nitride, bulk permanent magnets including iron nitride, techniques for forming magnetic materials including iron nitride, and techniques for forming bulk permanent magnets including iron nitride. Bulk permanent magnets including $Fe_{16}N_2$ iron nitride phase may provide an alternative to permanent magnets that include a rare earth element, as $Fe_{16}N_2$ has high saturation magnetization, high magnetic anisotropy constant, and, therefore high, energy product. The high saturation magnetization and magnetic anisotropy constants result in a magnetic energy product that may be higher than rare earth magnets in some examples. Bulk $Fe_{16}N_2$ permanent magnets made according to the techniques described herein may have desirable magnetic properties, including an energy product of as high as about 130 MGOe when the $Fe_{16}N_2$ permanent magnet is anisotropic. In examples in which the $Fe_{16}N_2$ magnet is isotropic, the energy product may be as high as about 33.5 MGOe. The energy product of a permanent magnetic is proportional to the product of remanent coercivity and remanent magnetization. For comparison, the energy product of $Nd_2Fe_{14}B$ permanent magnet may be as high as about 60 MGOe. A higher energy product can lead to increased efficiency of the permanent magnet when used in motors, generators, or the like. Additionally, permanent magnets that include a $Fe_{16}N_2$ phase may not include rare earth elements, which may reduce a materials cost of the magnet and may reduce an environmental impact of producing the magnet.

Without being limited by any theory of operation, it is believed that $Fe_{16}N_2$ is a metastable phase, which competes with other stable phases of Fe—N. Hence, forming bulk magnetic materials and bulk permanent magnets including $Fe_{16}N_2$ may be difficult. Various techniques described herein may facilitate formation of magnetic materials including $Fe_{16}N_2$ iron nitride phase. In some examples, the techniques may reduce a cost of forming magnetic materials including $Fe_{16}N_2$ iron nitride phase, increase a volume fraction of $Fe_{16}N_2$ iron nitride phase in the magnetic material, provide greater stability of the $Fe_{16}N_2$ iron nitride phase within the magnetic material, facilitate mass production of magnetic materials including $Fe_{16}N_2$ iron nitride phase, and/or improve magnetic properties of the magnetic materials including $Fe_{16}N_2$ iron nitride phase compared to other techniques for forming magnetic materials including $Fe_{16}N_2$ iron nitride phase.

The bulk permanent FeN magnets described herein may possess anisotropic magnetic properties. Such anisotropic magnetic properties are characterized as having a different energy product, coercivity and magnetization moment at different relative orientations to an applied electric or magnetic field. Accordingly, the disclosed bulk FeN magnets may be used in any of a variety of applications (e.g., electric motors) to impart into such applications low energy loss and high energy efficiency.

In some examples, the disclosure describes techniques for forming powder including iron nitride using milling of iron-containing raw materials with a nitrogen source, such as an amide- or hydrazine-containing liquid or solution. The amide-containing or hydrazine-containing liquid or solution acts as a nitrogen donor, and, after completion of the milling and mixing, a powder including iron nitride is formed. In some examples, the powder including iron nitride may include one or more iron nitride phases, including, for example, $Fe_8N$, $Fe_{16}N_2$, $Fe_2N_6$, $Fe_4N$, $Fe_3N$, $Fe_2N$, FeN, and FeN (where x is in the range of from about 0.05 to about 0.5). The powder including iron nitride may be subsequently used in a technique for forming a bulk permanent magnet including $Fe_{16}N_2$ iron nitride.

In some examples, the disclosure describes techniques for forming magnetic materials including at least one $Fe_{16}N_2$ phase domain. In some implementations, the magnetic materials may be formed from a material including iron and nitrogen, such as a powder including iron nitride or a bulk material including iron nitride. In such examples, a further nitriding step may be avoided. In other examples, the magnetic materials may be formed from an iron-containing raw material (e.g., powder or bulk), which may be nitridized as part of the process of forming the magnetic materials. The iron nitride containing material then may be melted and subjected to a casting, quenching and pressing process to form workpieces including iron nitride. In some examples, the workpieces may have a dimension in at least one axis between about 0.1 mm and about 50 mm, and may include at least one $Fe_8N$ phase domain. In some examples, such as when the workpiece includes a wire or ribbon, the wire or ribbon may have a diameter or thickness, respectively, between about 0.1 mm and about 50 mm.

In some examples, workpieces include a dimension that is longer, e.g., much longer, than other dimensions of the workpiece. Example workpieces with a dimension longer than other dimensions include fibers, wires, filaments, cables, films, thick films, foils, ribbons, sheets, or the like. In other examples, workpieces may not have a dimension that is longer than other dimensions of the workpiece. For example, workpieces can include grains or powders, such as spheres, cylinders, flecks, flakes, regular polyhedra, irregular polyhedra, and any combination thereof. Examples of suitable regular polyhedra include tetrahedrons, hexahedrons, octahedron, decahedron, dodecahedron and the like, non-limiting examples of which include cubes, prisms, pyramids, and the like.

In some examples, the casting process can be conducted in air, in a nitrogen environment, an inert environment, a partial vacuum, a full vacuum, or any combination thereof. In some examples, the pressure during casting can be between about 0.1 GPa and about 20 GPa. In some implementations, the casting and quenching process can be assisted by a straining field, a shear field, a temperature field, a pressure field, an electrical field, a magnetic field, or any combination thereof can be applied to assist the casting process.

In some examples, the quenching process includes heating the workpieces to a temperature above 650° C. for between about 0.5 hour and about 20 hours. In some examples, the temperature of the workpieces may be dropped abruptly below the martensite temperature of the workpiece alloy (Ms). For example, for $Fe_{16}N_2$, the martensite temperature (Ms) is about 250° C. The medium used for quenching can include a liquid, such as water, brine (with a salt concentration between about 1% and about 30%), a non-aqueous fluid such as an oil, or liquid nitrogen. In other examples, the quenching medium can include a gas, such as nitrogen gas with a flow rate between about 1 standard cubic centimeters per minute (sccm) and about 1000 sccm. In other examples, the quenching medium can include a solid, such as salt, sand, or the like. In some implementations, an electrical field or a magnetic field can be applied to assist the quenching process.

The workpieces including at least one $Fe_8N$ phase domain may subsequently be strained and post-annealed to form workpieces including at least one $Fe_{16}N_2$ phase domain. The workpieces including at least one $Fe_8N$ phase domain may be strained while being annealed to facilitate transformation of the at least one $Fe_8N$ phase domain into at least one $Fe_{16}N_2$ phase domain. In some examples, the strain exerted on the workpiece may be sufficient to reduce the dimension of the workpiece in one or more axis to less than about 0.1 mm. In some examples, such as when the workpiece includes a wire or ribbon, the strain exerted on the wire or ribbon may be sufficient to reduce the diameter or thickness, respectively of the wire or ribbon to less than about 0.1 mm. In some examples, to facilitate the reduction of the dimension of the workpiece in one or more dimension, a roller may be used to exert a pressure on the workpiece. In some examples, the temperature of the workpiece may be between about −150° C. and about 300° C. during the straining process. In some examples, a workpiece including at least one $Fe_{16}N_2$ phase domain may consist essentially of one $Fe_{16}N_2$ phase domain, which can further be oriented along the long direction of the workpiece (e.g., one or more <001> crystal axes of unit cells of the iron nitride phase domains may be oriented along the long direction of the workpiece).

In some examples, the disclosure describes techniques for combining a plurality of workpieces including at least one $Fe_{16}N_2$ phase domain into a bulk magnetic material. In some examples, the plurality of workpieces including at least one $Fe_{16}N_2$ phase domain may each include one or more <001> crystalline axes substantially parallel perpendicular to a long axis of the respective workpiece. The long axes of the plurality of workpieces including at least one $Fe_{16}N_2$ phase domain may be disposed substantially parallel to each other, so that the <001> crystalline axes in the workpieces may be substantially parallel. This may provide high magnetic anisotropy, which may lead to high energy product. Techniques for joining the plurality of workpieces including at least one $Fe_{16}N_2$ phase domain include alloying the workpieces using at least one of Sn, Cu, Zn, or Ag to form an iron alloy at the interface of the workpieces; using a resin filled with Fe or other ferromagnetic particles to bond the workpieces together; shock compression to press the workpieces together; or electrodischarge to join the workpieces; and/or electro-magnetic compaction to join the workpieces.

In some examples, the disclosure describes a technique for forming a magnetic material from an iron nitride powder. The iron nitride powder may include one or more different iron nitride phases (e.g., $Fe_8N$, $Fe_{16}N_2$, $Fe_2N_6$, $Fe_4N$, $Fe_3N$, $Fe_2N$, FeN, and $FeN_x$ (where x is between about 0.05 and 0.5)). The iron nitride powder may be mixed alone or with pure iron powder to form a mixture including iron and nitrogen in an 8:1 atomic ratio. The mixture then may be formed into a magnetic material via one of a variety of methods. For example, the mixture may be melted and subjected to a casting, quenching, and pressing process to form a plurality of workpieces. The plurality of workpieces may include at least one $Fe_8N$ phase domain. The plurality of workpieces then may be annealed to form at least one $Fe_{16}N_2$ phase domain, sintered and aged to join the plurality of workpieces, and, optionally, shaped and magnetized to form a magnet. As another example, the mixture may be pressed in the presence of a magnetic field, annealed to form at least one $Fe_{16}N_2$ phase domain, sintered and aged, and, optionally, shaped and magnetized to form a magnet. As another example, the mixture may be melted and spun to form an iron nitride-containing material. The iron nitride-containing material may be annealed to form at least one $Fe_{16}N_2$ phase domain, sintered and aged, and, optionally, shaped and magnetized to form a magnet.

In some examples, the disclosure describes an iron nitride-containing magnetic material that additionally includes at least one ferromagnetic or nonmagnetic dopant. In some examples, at least one ferromagnetic or nonmagnetic dopant may be referred to as a ferromagnetic or nonmagnetic impurity. The ferromagnetic or nonmagnetic dopant may be used to increase at least one of the magnetic moment, magnetic coercivity, or thermal stability of the magnetic material formed from the mixture including iron and nitrogen. Examples of ferromagnetic or nonmagnetic dopants include Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, Ta, and combinations thereof. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms. In some examples, the mixture including iron and nitrogen may include more than one (e.g., at least two) ferromagnetic or nonmagnetic dopants. In some examples, the ferromagnetic or nonmagnetic dopants may function as domain wall pinning sites, which may improve coercivity of the magnetic material formed from the mixture including iron and nitrogen.

In some examples, the disclosure describes an iron nitride-containing magnetic material that additionally includes at least one phase stabilizer. The at least one phase stabilizer may be an element selected to improve at least one of $Fe_{16}N_2$ volume ratio, thermal stability, coercivity, and erosion resistance. When present in the mixture, the at least one phase stabilizer may be present in the mixture including iron and nitrogen at a concentration between about 0.1 at. % and about 15 at. %. In some examples in which at least two phase stabilizers at present in the mixture, the total concentration of the at least two phase stabilizers may be between about 0.1 at. % and about 15 at. %. The at least one phase stabilizer may include, for example, B, Al, C, Si, P, O, Co, Cr, Mn, S, and combinations thereof. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms.

FIG. 1 is a conceptual diagram illustrating a first milling apparatus that may be used to mill an iron-containing raw material with a nitrogen source. First milling apparatus 10 may be operated in rolling mode, in which the bin 12 of first milling apparatus 10 rotates about a horizontal axis, as indicated by arrow 14. As bin 12 rotates, milling spheres 16 move within bin 12 and, over time, crush iron-containing raw material 18. In addition to iron-containing raw material 18 and milling spheres 16, bin 12 encloses a nitrogen source 20.

In the example illustrated in FIG. 1, milling spheres 16 may include a sufficiently hard material that, when contacting iron-containing raw material 18 with sufficient force, will wear iron-containing raw material 18 and cause particles of iron-containing raw material 18 to, on average, have a smaller size. In some examples, milling spheres 16 may be formed of steel, stainless steel. or the like. In some examples, the material from which milling spheres 16 are formed may not chemically react with iron-containing raw material 18 and/or nitrogen source 20. In some examples, milling spheres 16 may have an average diameter between about 5 millimeters (mm) and about 20 mm.

Iron-containing raw material 18 may include any material containing iron, including atomic iron, iron oxide, iron chloride, or the like. In some examples, iron-containing raw material 18 may include substantially pure iron (e.g., iron with less than about 10 atomic percent (at. %) dopants or impurities). In some examples, the dopants or impurities may include oxygen or iron oxide. Iron-containing raw material 18 may be provided in any suitable form, including, for example, a powder or relatively small particles. In some examples, an average size of particles in iron containing raw material 18 may be less than about 100 micrometers (μm).

Nitrogen source 20 may include ammonium nitrate ($NH_4NO_3$) or an amide-containing material, such as a liquid amide or a solution containing an amide, or hydrazine or a solution containing hydrazine. Amides include a C—N—H bond and hydrazine includes an N—N bond. Ammonium nitrate, amides and hydrazine may serve as a nitrogen donor for forming the powder including iron nitride. Example amides include carbamide ($(NH_2)_2CO$; also referred to as urea), methanamide (Formula 1), benzamide (Formula 2), and acetamide (Formula 3), although any amide may be used.

Formula 1

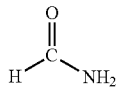

Formula 2

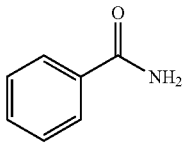

Formula 3

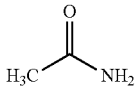

In some examples, amides may be derived from carboxylic acids by replacing the hydroxyl group of a carboxylic acid with an amine group. Amides of this type may be referred to as acid amides.

In some examples, bin 10 also may enclose a catalyst 22. Catalyst 22 may include, for example, cobalt (Co) particles and/or nickel (Ni) particles. Catalyst 22 catalyzes the nitriding of the iron-containing raw material 18. One possible conceptualized reaction pathway for nitriding iron using a Co catalyst is shown in Reactions 1-3, below. A similar reaction pathway may be followed when using Ni as the catalyst 22.

Reaction 1

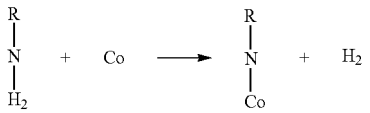

Reaction 2

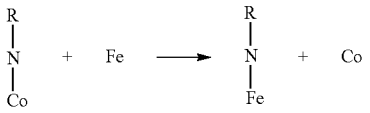

-continued

Reaction 3

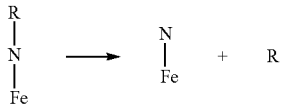

Hence, by mixing sufficient amide and catalyst 22, iron-containing raw material 18 may be converted to iron nitride containing material.

Figure 2:
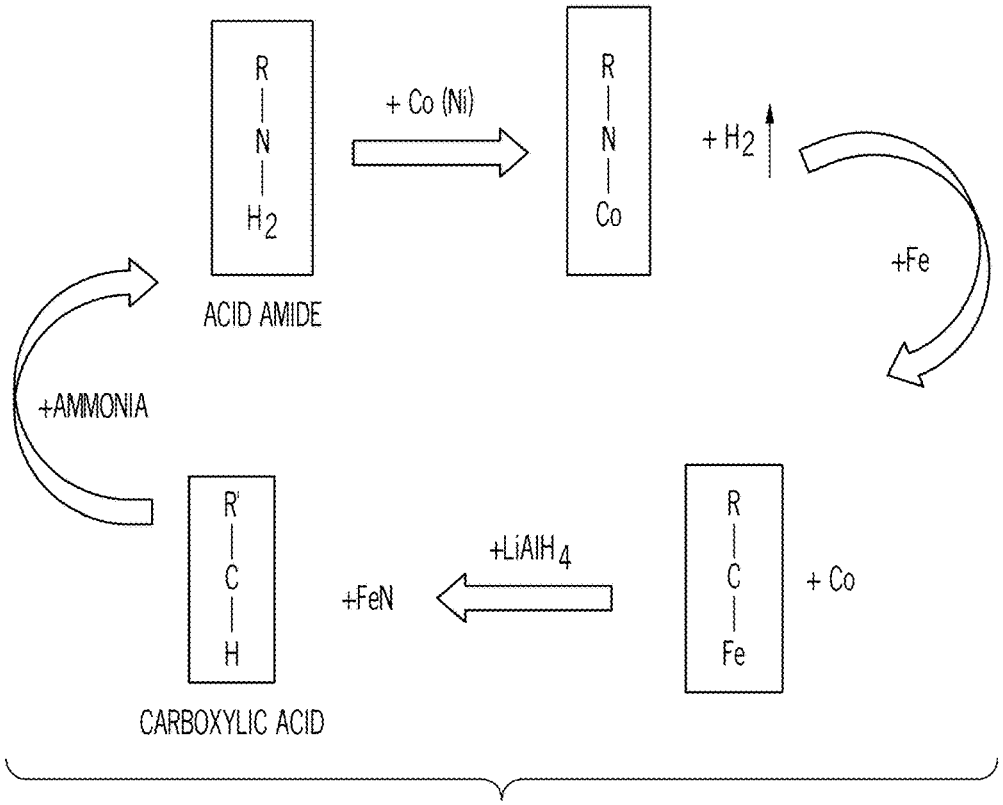
FIG. 2 is a conceptual flow diagram illustrating an example reaction sequence for forming an acid amide from a carboxylic acid, nitriding iron, and regenerating the acid amide from the hydrocarbon remaining after nitriding the iron.

FIG. 2 is a conceptual flow diagram illustrating an example reaction sequence for forming an acid amide from a carboxylic acid, nitriding iron, and regenerating the acid amide from the hydrocarbon remaining after nitriding the iron. By utilizing the reaction sequence shown in FIG. 2, the catalyst 22 and portions of the nitrogen source 20 (e.g., aside from the nitrogen in the amide) may be recycled and reduce waste from the process. As shown in FIG. 2, a carboxylic acid may be reacted with ammonia at a temperature of about 100° C. to form an acid amide and evolve water. The acid amide then may be reacted with catalyst 22 (e.g., Co and/or Ni) to evolve hydrogen and bond the catalyst to the nitrogen. This compound then may react with iron to form an organic iron nitride and liberate the catalyst. Finally, the organic iron nitride may be reacted with $LiAlH_4$ to regenerate the carboxylic acid and form iron nitride.

Returning now to FIG. 1, bin 12 of milling apparatus 10 may be rotated at a rate sufficient to cause mixing of the components in bin 12 (e.g., milling spheres 16, iron-containing raw material 18, nitrogen source 20, and catalyst 22) and cause milling spheres 16 to mill iron-containing raw material 18. In some examples, bin 12 may be rotated at a rotational speed of about 500 revolutions per minute (rpm) to about 2000 rpm, such as between about 600 rpm and about 650 rpm, about 600 rpm, or about 650 rpm. Further, to facilitate milling of iron-containing raw material 18, in some examples, the mass ratio of the total mass of milling spheres 16 to the total mass of iron-containing raw material 18 may be about 20:1. Milling may be performed for a predetermined time selected to allow nitriding of iron-containing raw material 18 and milling of iron-containing raw material 18 (and nitridized iron containing material) to a predetermined size distribution. In some examples, milling may be performed for a time between about 1 hour and about 100 hours, such as between about 1 hour and about 20 hours, or about 20 hours. In some examples, the milling apparatus 10 may be stopped for about 10 minutes after each 10 hours of milling to allow milling apparatus 10, iron-containing raw material 18, nitrogen source 20, and catalyst 22 to cool.

Figure 3:
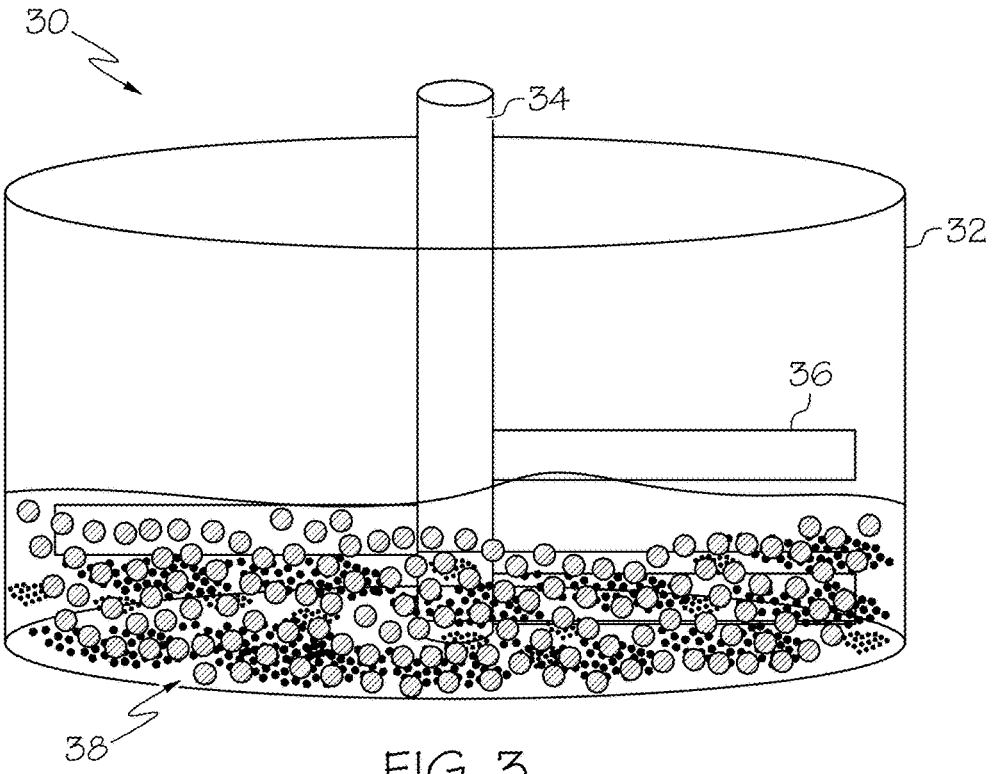
FIG. 3 is a conceptual diagram illustrating another example milling apparatus for nitriding an iron-containing raw material.

In other examples, the milling process may be performed using a different type of milling apparatus. FIG. 3 is a conceptual diagram illustrating another example milling apparatus for nitriding an iron-containing raw material. The milling apparatus illustrated in FIG. 3 may be referred to as a stirring mode milling apparatus 30. Stirring mode milling apparatus includes a bin 32 and a shaft 34. Mounted to shaft 34 are a plurality of paddles 36, which stir contents of bin 32 as shaft 34 rotates. Contained in bin 32 is a mixture 38 of milling spheres, iron-containing raw material; a nitrogen source, such as an amide-containing or hydrazine-containing liquid or solution; and a catalyst. The milling spheres, iron-containing raw material, nitrogen source, and catalyst may be the same as or substantially similar to milling spheres 16, iron-containing raw material 18, nitrogen source 20, and catalyst 22 described with reference to FIG. 1.

Stirring mode milling apparatus 30 may be used to nitridize the iron-containing raw material 18 in similar manner as milling apparatus 10 illustrated in FIG. 1. For example, shaft 34 may be rotated at a rate between about 500 rpm and about 2000 rpm, such as between about 600 rpm and about 650 rpm, about 600 rpm, or about 650 rpm. Further, to facilitate milling of the iron-containing raw material, in some examples, the mass ratio of the milling spheres to the iron-containing raw material may be about 20:1. Milling may be performed for a predetermined time selected to allow nitriding of iron-containing raw material and milling of iron-containing raw material (and nitridized iron containing material) to a predetermined size distribution. In some examples, milling may be performed for a time between about 1 hour and about 100 hours, such as between about 1 hour and about 20 hours, or about 20 hours. In some examples, the milling apparatus 10 may be stopped for about 10 minutes after each 10 hours of milling to allow milling apparatus 10, iron-containing raw material 18, nitrogen source 20, and catalyst 22 to cool.

Figure 4:
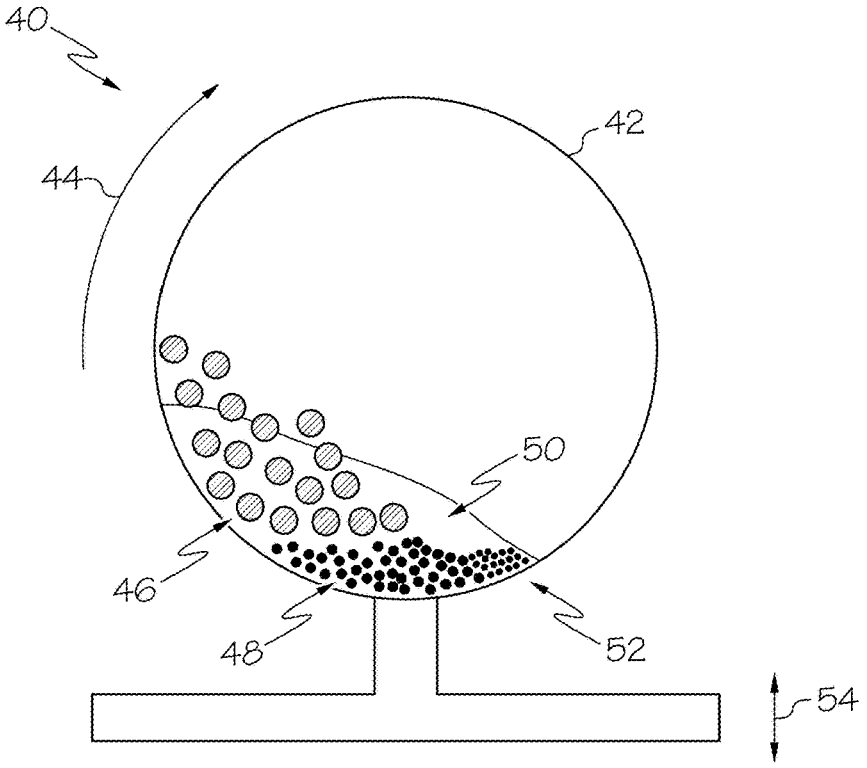
FIG. 4 is a conceptual diagram illustrating another example milling apparatus for nitriding an iron-containing raw material.

FIG. 4 is a conceptual diagram illustrating another example milling apparatus for nitriding an iron-containing raw material. The milling apparatus illustrated in FIG. 4 may be referred to as a vibration mode milling apparatus 40. As shown in FIG. 4, vibration mode milling apparatus may utilize both rotation of bin 42 about a horizontal axis (indicated by arrow 44) and vertical vibrating motion of bin 42 (indicated by arrow 54) to mill the iron-containing raw material 48 using milling spheres 46. As shown in FIG. 4, bin 42 contains a mixture of milling spheres 46, iron-containing raw material 48, nitrogen source 50, and catalysts 52. Milling spheres 46, iron-containing raw material 48, nitrogen source 50, and catalysts 52 may be the same or substantially similar to milling spheres 16, iron-containing raw material 18, nitrogen source 20, and catalyst 22 described with reference to FIG. 1.

Vibration mode milling apparatus 40 may be used to nitridize the iron-containing raw material 18 in similar manner as milling apparatus 10 illustrated in FIG. 1. For example, shaft 34 may be rotated at a rate between about 500 rpm and about 2000 rpm, such as between about 600 rpm and about 650 rpm, about 600 rpm, or about 650 rpm. Further, to facilitate milling of the iron-containing raw material, in some examples, the mass ratio of the milling spheres to the iron-containing raw material may be about 20:1. Milling may be performed for a predetermined time selected to allow nitriding of iron-containing raw material and milling of iron-containing raw material (and nitridized iron containing material) to a predetermined size distribution. In some examples, milling may be performed for a time between about 1 hour and about 100 hours, such as between about 1 hour and about 20 hours, or about 20 hours. In some examples, the milling apparatus 10 may be stopped for about 10 minutes after each 10 hours of milling to allow milling apparatus 10, iron-containing raw material 18, nitrogen source 20, and catalyst 22 to cool.

Regardless of the type of milling used to form iron nitride powder, the iron nitride powder may include at least one of FeN, $Fe_2N$ (e.g., $\xi$-$Fe_2N$), $Fe_3N$ (e.g., $\epsilon$-$Fe_3N$), $Fe_4N$ (e.g., $\gamma'$-$Fe_4N$), $Fe_2N_6$, $Fe_8N$, $Fe_{16}N_2$, and $FeN_x$, (where x is between about 0.05 and about 0.5). Additionally, the iron nitride powder may include other materials, such as pure iron, cobalt, nickel, dopants, or the like. In some examples, the cobalt, nickel, dopants, or the like may be at least partially removed after the milling process using one or more suitable techniques. In some examples, the iron nitride powder may be used in subsequent processes to form a magnetic material, such as a permanent magnet, including an iron nitride phase, such as $Fe_{16}N_2$. Milling an iron-containing raw material in the presence of a nitrogen source, such as ammonium nitrate or an amide- or hydrazine-containing liquid or solution, may be a cost-effective technique for forming an iron-nitride containing material. Further, milling an iron-containing raw material in the presence of a nitrogen source, such as ammonium nitrate or an amide- or hydrazine-containing liquid or solution, may facilitate mass production of iron nitride-containing material, and may reduce iron oxidation.

In some examples, prior to milling the iron-containing raw material in the presence of a nitrogen source, an iron precursor may be converted to the iron-containing raw material using a milling technique and/or a melting spinning technique. In some examples, the iron precursor may include at least one of Fe, $FeCl_3$, $Fe_2O_3$, or $Fe_3O_4$. In some implementations, the iron nitride precursor may include particles with an average diameter of, for example, greater than about 0.1 mm (100 μm).

When the iron precursor is milled, any of the milling techniques described above may be utilized, including rolling mode milling, stirring mode milling, and vibration mode milling. In some examples, the iron precursor may be milled in the presence of at least one of calcium (Ca), aluminum (Al), or sodium (Na). The at least one of Ca, Al and/or Na may react with oxygen (molecular oxygen or oxygen ions) present in the iron precursor, if any. The oxidized at least one of Ca, Al, and/or Na then may be removed from the mixture. For example, the oxidized at least one of Ca, Al, and/or Na may be removed using at least one of a deposition technique, and evaporation technique, or an acid cleaning technique. In some examples, the oxygen reduction process can be carried out by flowing hydrogen gas within the milling apparatus. The hydrogen may react with any oxygen present in the iron-containing raw material, and the oxygen may be removed from the iron-containing raw material. In some examples, this may form substantially pure iron (e.g., iron with less than about 10 at. % dopants). Additionally or alternatively, the iron-containing raw material may be cleaned using an acid cleaning technique. For example, diluted HCl, with a concentration between about 5% and about 50% can be used to wash oxygen from the iron-containing raw material. Milling iron precursors in a mixture with at least one of Ca, Al, and/or Na (or acid cleaning) may reduce iron oxidation and may be effective with many different iron precursors, including, for example, Fe, $FeCl_3$, $Fe_2O_3$, or $Fe_3O_4$, or combinations thereof. The milling of iron precursors may provide flexibility and cost advantages when preparing iron-containing raw materials for use in forming iron-nitride containing materials.

In other examples, the iron-containing raw material may be formed by melting spinning. In melting spinning, an iron precursor may be melted, e.g., by heating the iron precursor in a furnace to form molten iron precursor. The molten iron precursor then may be flowed over a cold roller surface to quench the molten iron precursor and form a brittle ribbon of material. In some examples, the cold roller surface may be cooled at a temperature below room temperature by a cooling agent, such as water. For example, the cold roller surface may be cooled at a temperature between about 10° C. and about 25° C. The brittle ribbon of material may then undergo a heat treatment step to pre-anneal the brittle iron material. In some examples, the heat treatment may be carried out at a temperature between about 200° C. and about 600° C. at atmospheric pressure for between about 0.1 hour and about 10 hours. In some examples, the heat treatment may be performed in a nitrogen or argon atmosphere. After heat-treating the brittle ribbon of material under an inert gas, the brittle ribbon of material may be shattered to form an iron-containing powder. This powder may be used as the iron-containing raw material 18 or 48 in the technique for forming iron nitride-containing powder.

In some examples, the disclosure describes techniques for forming a magnetic material including $Fe_{16}N_2$ phase domains from an iron nitride-containing material. In some examples, the iron nitride-containing powder formed by the techniques described above may be used to form the magnet including $Fe_{16}N_2$ phase domains. In other examples, iron-containing raw material may be nitrided using other techniques, as will be described below.

Regardless of the source of the iron nitride containing material, the iron nitride containing material may be melted and continuously casted, pressed, and quenched to form workpieces containing iron nitride. In some examples, the workpieces may have a dimension in one or more axis between about 0.001 mm and about 50 mm. For example, in some examples in which the workpieces include ribbons, the ribbons may have a thickness between about 0.001 mm and about 5 mm. As another example, in some examples in which the workpieces include wires, the wires may have a diameter between about 0.1 mm and about 50 mm. The workpieces then may be strained and post-annealed to form at least one phase domain including $Fe_{16}N_2$ (e.g., $\alpha''$-$Fe_{16}N_2$). In some examples, these workpieces including at least one phase domain including $Fe_{16}N_2$ (e.g., $\alpha''$-$Fe_{16}N_2$) then may be joined with other workpieces including at least one phase domain including $Fe_{16}N_2$ (e.g., $\alpha''$-$Fe_{16}N_2$) to form a magnet.

Figure 5:
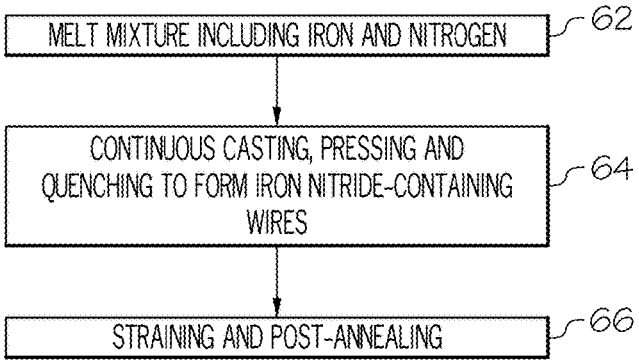
FIG. 5 is a flow diagram of an example technique for forming a workpiece including at least one phase domain including $Fe_{16}N_2$ (e.g., $\alpha''$-$Fe_{16}N_2$).

FIG. 5 is a flow diagram of an example technique for forming a workpiece including at least one phase domain including $Fe_{16}N_2$ (e.g., $\alpha''$-$Fe_{16}N_2$). The technique illustrated in FIG. 5 includes melting a mixture including iron and nitrogen to form a molten iron nitride-containing mixture (62). The mixture including iron and nitrogen may include, for example, including an approximately 8:1 iron-to-nitrogen atomic ratio. For example, the mixture may include between about 8 atomic percent (at. %) and about 15 at. % nitrogen, with a balance iron, other elements, and dopants. As another example, the mixture may include between about 10 at. % and about 13 at. % nitrogen, or about 11.1 at. % nitrogen.

In some examples, the mixture including iron and nitrogen may include at least one type of iron nitride, such as, for example, FeN, $Fe_2N$ (e.g., $\xi$-$Fe_2N$), $Fe_3N$ (e.g., $\epsilon$-$Fe_3N$), $Fe_4N$ (e.g., $\gamma'$-$Fe_4N$ and/or $\gamma$-$Fe_4N$), $Fe_2N_6$, $Fe_8N$, $Fe_{16}N_2$, or $FeN_x$ (where x is between about 0.05 and about 0.5), in addition to iron and/or nitrogen. In some examples, the mixture including iron and nitrogen may have a purity (e.g., collective iron and nitrogen content) of at least 92 atomic percent (at. %).

In some examples, the mixture including iron and nitrogen may include at least one dopant, such as a ferromagnetic or nonmagnetic dopant and/or a phase stabilizer. In some examples, at least one ferromagnetic or nonmagnetic dopant may be referred to as a ferromagnetic or nonmagnetic impurity and/or the phase stabilizer may be referred to as a phase stabilization impurity. A ferromagnetic or nonmagnetic dopant may be used to increase at least one of the magnetic moment, magnetic coercivity, or thermal stability of the magnetic material formed from the mixture including iron and nitrogen. Examples of ferromagnetic or nonmagnetic dopants include Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, and Ta. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms. In some examples, more than one (e.g., at least two) ferromagnetic or nonmagnetic dopants may be includes in the mixture including iron and nitrogen. In some examples, the ferromagnetic or nonmagnetic dopants may function as domain wall pinning sites, which may improve coercivity of the magnetic material formed from the mixture including iron and nitrogen. Table 1 includes example concentrations of ferromagnetic or nonmagnetic dopants within the mixture including iron and nitrogen.

TABLE 1

| Dopant | Concentration (at. %) |
|---|---|
| Sc | 0.1-33 |
| Ti | 0.1-28 |
| V | 0.1-25 |
| Nb | 0.1-27 |
| Cr | 0.1-10 |
| Mo | 0.1-3 |
| Mn | 0.1-28 |
| Ru | 2-28 |
| Co | 0.1-50 |
| Rh | 11-48 |
| Ni | 2-71 |
| Pd | 0.1-55 |
| Pt | 0.1-15 |
| Cu | 0.1-30 |
| Ag | 1-10 |
| Au | 1-10 |
| Zn | 0.1-30 |
| Cd | 0.1-35 |
| Zr | 0.1-33 |
| Pb | 0.1-60 |
| Mg | 0.1-60 |
| W | 0.1-20 |
| Ta | 0.1-20 |
| Ga | 0.1-10 |
| Sm | 0.1-11 |

Alternatively or additionally, the mixture including iron and nitrogen may include at least one phase stabilizer. The at least one phase stabilizer may be an element selected to improve at least one of $Fe_{16}N_2$ volume ratio, thermal stability, coercivity, and erosion resistance. When present in the mixture, the at least one phase stabilizer may be present in the mixture including iron and nitrogen at a concentration between about 0.1 at. % and about 15 at. %. In some examples in which at least two phase stabilizers at present in the mixture, the total concentration of the at least two phase stabilizers may be between about 0.1 at. % and about 15 at. %. The at least one phase stabilizer may include, for example, B, Al, C, Si, P, O, Co, Cr, Mn, and/or S. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms.

In some examples, melting the mixture including iron and nitrogen to form a molten iron nitride-containing mixture (62) may include heating the mixture including iron and nitrogen, and, optionally, at least one nonmagnetic or ferromagnetic dopant and/or at least one phase stabilizer at a temperature above about 1500° C. In some examples, the mixture including iron and nitrogen may be heated in a furnace using a radio frequency (RF) induction coil. In examples in which a bulk iron nitride-containing material is used, the furnace may be heated at a temperature greater than about 1600° C. In examples in which an iron-nitride containing powder is used, the furnace may be heated at a temperature greater than about 2000° C.

In other examples, the mixture including iron and nitrogen may be heated in a furnace using a low or mid-frequency induction coil. In some examples in which a low or mid-frequency induction coil is used to heat the furnace, the furnace may be heated at a temperature greater than about 1600° C., regardless of whether a bulk iron nitride-containing material or an iron-nitride containing powder is used as the mixture including iron and nitrogen. In some examples, the mixture including iron and nitrogen may be heated under an ambient atmosphere.

Once the mixture including iron and nitrogen is molten, the mixture may be subjected to a casting, quenching, and pressing process to form iron nitride-containing workpieces (64). In some examples, the casting, quenching, and pressing process may be continuous, as opposed to a batch process. The molten mixture including iron and nitrogen may be deposited in a mold, which may shape the mixture including iron and nitrogen into a predetermined shape, such as at least one wire, ribbon, or other article having length that is greater than its width or diameter. During the casting process, the temperature of the mold may be maintained at a temperature between about 650° C. and about 1200° C., depending on the casting speed. In some examples, during the casting process, the temperature of the mold may be maintained at a temperature between about 800° C. and about 1200° C. The casting process can be conducted in air, a nitrogen environment, an inert environment, a partial vacuum, a full vacuum, or any combination thereof. The casting process can be at any pressure, for example, between about 0.1 GPa and about 20 GPa. In some examples, the casting process can be assisted by a straining field, a temperature field, a pressure field, a magnetic field, an electrical field, or any combination thereof.

After casting is complete or while the casting process is being completed, the mixture including iron and nitrogen may be quenched to set the crystalline structure and phase composition of the iron-nitride containing material. In some examples, during the quenching process, the workpieces may be heated to a temperature above 650° C. for between about 0.5 hour and about 20 hours. In some examples, the temperature of the workpieces may be dropped abruptly below the martensite temperature of the workpiece alloy (Ms). For example, for $Fe_{16}N_2$, the martensite temperature (Ms) is about 250° C. The medium used for quenching can include a liquid, such as water, brine (with a salt concentration between about 1% and about 30%), a non-aqueous liquid or solution such as an oil, or liquid nitrogen. In other examples, the quenching medium can include a gas, such as nitrogen gas with a flow rate between about 1 sccm and about 1000 sccm. In other examples, the quenching medium can include a solid, such as salt, sand, or the like. In some examples, the workpieces including iron and nitrogen may be cooled at a rate of greater than 50° C. per second during the quenching process. In some examples, the casting process can be assisted by a magnetic field and/or an electrical field.

After quenching is complete, the iron nitride-containing material may be pressed to achieve the predetermined size of the iron nitride-containing material. During the pressing process, the temperature of the iron nitride-containing material may be maintained below about 250° C., and the iron nitride-containing material may be exposed to a pressure between about 5 tons and 50 tons, depending on the desired final dimension (e.g., thickness or diameter) of the iron nitride-containing material. When the pressing process is complete, the iron nitride-containing material may be in the shape of a workpiece with a dimension in one or more axis between about 0.001 mm and about 50 mm (e.g., a diameter between about 0.1 min and about 50 mm for a wire or a thickness between about 0.001 mm and about 5 mm for a ribbon). The iron nitride-containing workpiece may include at least one $Fe_8N$ iron nitride phase domain.

Figure 6:
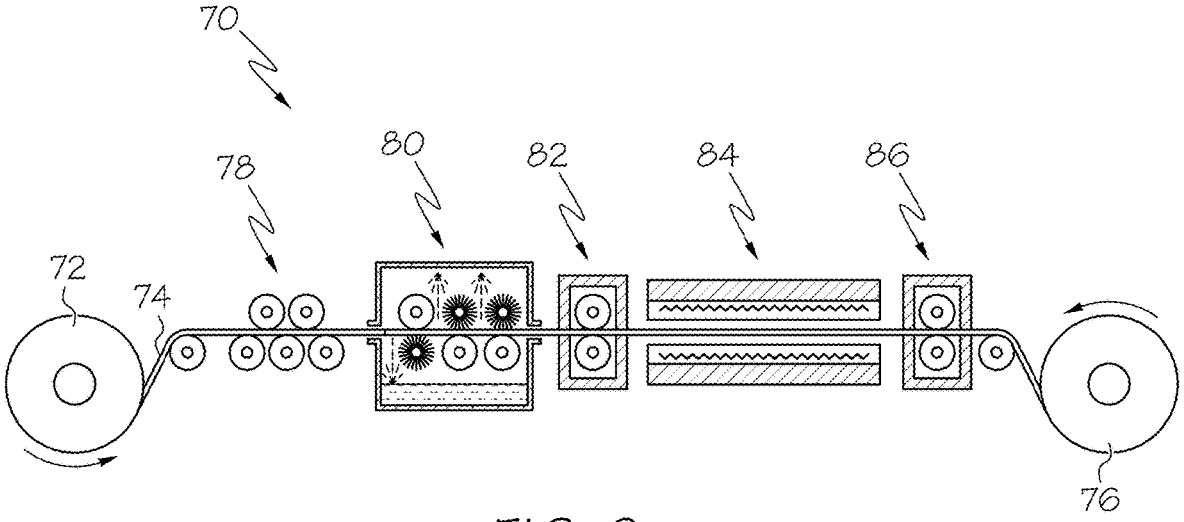
FIG. 6 is a conceptual diagram illustrating an example apparatus that may be used to strain and post-anneal an iron nitride-containing workpiece.

The technique illustrated in FIG. 5 further includes straining and post-annealing the iron nitride-containing workpiece (66). The straining and post-annealing process may convert at least some of the $Fe_8N$ iron nitride phase domains to $Fe_{16}N_2$ phase domains. FIG. 6 is a conceptual diagram illustrating an example apparatus that may be used to strain and post-anneal the iron nitride-containing workpiece (66). The apparatus 70 illustrated in FIG. 6 includes a first roller 72 from which the iron nitride-containing workpiece 74 is unrolled and a second roller 76 onto which the iron nitride-containing workpiece 74 is rolled after the post-annealing process is complete. Although the example illustrated in FIG. 6 is described with reference to iron nitride-containing workpiece 74, in other examples, the apparatus 70 and technique may be used with iron nitride-containing materials defining different shapes, such as any of the shapes for workpieces described above.

For example, workpieces include a dimension that is longer, e.g., much longer, than other dimensions of the workpiece. Example workpieces with a dimension longer than other dimensions include fibers, wires, filaments, cables, films, thick films, foils, ribbons, sheets, or the like. In other examples, workpieces may not have a dimension that is longer than other dimensions of the workpiece. For example, workpieces can include grains or powders, such as spheres, cylinders, flecks, flakes, regular polyhedra, irregular polyhedra, and any combination thereof. Examples of suitable regular polyhedra include tetrahedrons, hexahedrons, octahedron, decahedron, dodecahedron and the like, non-limiting examples of which include cubes, prisms, pyramids, and the like.

In general, any two-dimensional or three-dimensional shape that can be sufficiently stressed while it is being annealed can be incorporated in the techniques described herein. For example, with a sufficiently large press to create tensional stress, wires can become cylinders, In some examples, the workpieces may define have a non-circular cross section. Multiple workpieces having one or more types of shapes, cross sections, or both may also be used in combination in the techniques described herein. In some examples, the workpiece cross section can be arc-shaped, oval, triangular, square, rectangular, pentagonal, hexagonal, higher polygonal, as well as regular polygonal and irregular polygonal variations thereof. Accordingly, as long as the workpiece can be suitably stressed, the workpiece can be induced to form at least one $Fe_{16}N_2$ phase domain.

As iron nitride-containing workpiece 74 is unrolled from first roller 72, iron nitride-containing workpiece 74 travels through an optional straightening section 78, which may include a plurality of rollers that contact iron nitride-containing workpiece 74 to substantially straighten (e.g., straighten or nearly straighten) iron nitride-containing workpiece 74. After the optional straightening section 78, iron nitride-containing workpiece 74 may pass through an optional cleaning section 80, in which iron nitride-containing workpiece 74 may be cleaned using, e.g., scrubbing and water or another solvent that removes surface dopants but does not substantially react with the iron nitride-containing workpiece 74.

Upon exiting optional cleaning section 80, iron nitride-containing workpiece 74 passes between a first set of rollers 82 and to the straining and post-annealing section 84. In straining and post-annealing section 84, iron nitride-containing workpiece 74 is subjected to mechanical strain, e.g., by being stretched and/or pressed, while being heated. In some examples, iron nitride-containing workpiece 74 may be strained along a direction substantially parallel (e.g., parallel or nearly parallel) to a <001> axis of at least one iron crystal in iron nitride-containing workpiece 74. In some examples, iron nitride-containing workpiece 74 is formed of iron nitride having a body centered cubic (bcc) crystal structure. In some examples, iron nitride-containing workpiece 74 may be formed of a plurality of bcc iron nitride crystals. In some of these examples, the plurality of iron crystals are oriented such that at least some, e.g., a majority or substantially all, of the <001> axes of individual unit cells and/or crystals are substantially parallel to the direction in which strain is applied to iron nitride-containing workpiece 74. For example, when the iron is formed as iron nitride-containing workpiece 74, at least some of the <001> axes may be substantially parallel to the major axis of iron nitride-containing workpiece 74.

Figure 7:
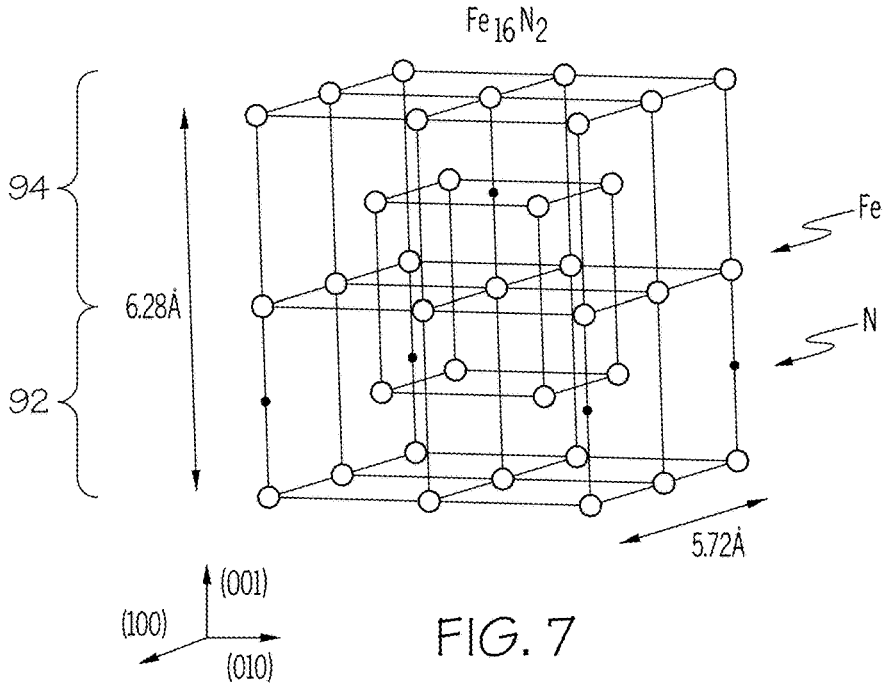
FIG. 7 is a conceptual diagram that shows eight (8) iron unit cells in a strained state with nitrogen atoms implanted in interstitial spaces between iron atoms.

In an unstrained iron bcc crystal lattice, the <100>, <010>, and <001> axes of the crystal unit cell may have substantially equal lengths. However, when a force, e.g., a tensile force, is applied to the crystal unit cell in a direction substantially parallel to one of the crystal axes, e.g., the <001> crystal axis, the unit cell may distort and the iron crystal structure may be referred to as body centered tetragonal (bct). For example, FIG. 7 is a conceptual diagram that shows eight (8) iron unit cells in a strained state with nitrogen atoms implanted in interstitial spaces between iron atoms. The example in FIG. 7 includes four iron unit cells in a first layer 92 and four iron unit cells in a second layer 94. Second layer 94 overlays first layer 92 and the unit cells in second layer 94 are substantially aligned with the unit cells in first layer 92 (e.g., the <001> crystal axes of the unit cells are substantially aligned between the layers). As shown in FIG. 7, the iron unit cells are distorted such that the length of the unit cell along the <001> axis is approximately 3.14 angstroms (Å) while the length of the unit cell along the <010> and <100> axes is approximately 2.86 Å. The iron unit cell may be referred to as a bct unit cell when in the strained state. When the iron unit cell is in the strained state, the <001> axis may be referred to as the c-axis of the unit cell.

The stain may be exerted on iron nitride-containing workpiece 74 using a variety of strain inducing apparatuses. For example, as shown in FIG. 6, iron nitride-containing workpiece 74 may be received by (e.g., wound around) first set of rollers 82 and second set of rollers 86, and sets of rollers 82, 86 may be rotated in opposite directions to exert a tensile force on the iron nitride-containing workpiece 74. In other examples, opposite ends of iron nitride-containing workpiece 74 may be gripped in mechanical grips, e.g., clamps, and the mechanical grips may be moved away from each other to exert a tensile force on the iron nitride-containing workpiece 74.

A strain inducing apparatus may strain iron nitride-containing workpiece 74 to a certain elongation. For example, the strain on iron nitride-containing workpiece 74 may be between about 0.3% and about 12%. In other examples, the strain on iron nitride-containing workpiece 74 may be less than about 0.3% or greater than about 12%. In some examples, exerting a certain strain on iron nitride-containing workpiece 74 may result in a substantially similar strain on individual unit cells of the iron, such that the unit cell is elongated along the <001> axis between about 0.3% and about 12%.

While iron nitride-containing workpiece 74 is strained, iron nitride-containing workpiece 74 may be heated to anneal iron nitride-containing workpiece 74. Iron nitride-containing workpiece 74 may be annealed by heating iron nitride-containing workpiece 74 to a temperature between about 100° C. and about 250° C., such as between about 120° C. and about 200° C. Annealing iron nitride-containing workpiece 74 while straining iron nitride-containing workpiece 74 may facilitate conversion of at least some of the iron nitride phase domains to $Fe_{16}N_2$ phase domains.

The annealing process may continue for a predetermined time that is sufficient to allow diffusion of the nitrogen atoms to the appropriate interstitial spaces. In some examples, the annealing process continues for between about 20 hours and about 100 hours, such as between about 40 hours and about 60 hours. In some examples, the annealing process may occur under an inert atmosphere, such as Ar, to reduce or substantially prevent oxidation of the iron. In some implementations, while iron nitride-containing workpiece 74 is annealed the temperature is held substantially constant.

Figure 8:
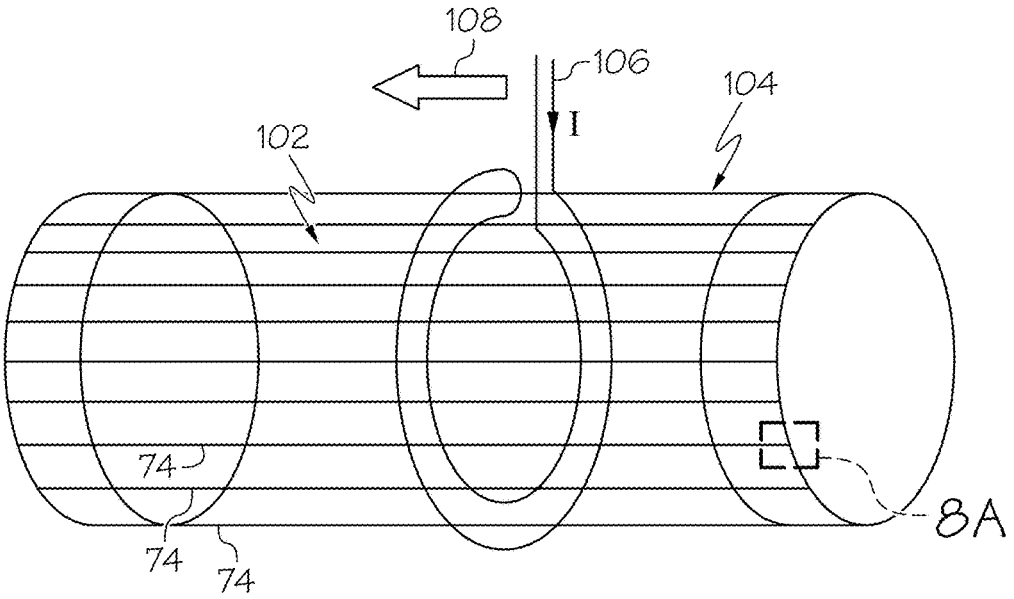
FIG. 8A illustrates straining an iron nitride-containing workpiece using rollers.

FIG. 8 is a conceptual diagram illustrating an example technique that may be used to strain and anneal a plurality of iron nitride-containing workpieces 74 in parallel. Although the example illustrated in FIG. 8 is described with reference to iron nitride-containing workpieces 74, in other examples, the technique of FIG. 8 may be used with iron nitride-containing materials defining different shapes, such as any of the shapes for workpieces described above. In the example technique illustrated in FIG. 8, a plurality of iron nitride-containing workpieces 74 are disposed in parallel, and each of iron nitride-containing workpieces 74 includes a region that includes polycrystalline iron nitride 102 and a region that consists essentially of a single $Fe_{16}N_2$ phase domain 104.

Figure 8A:
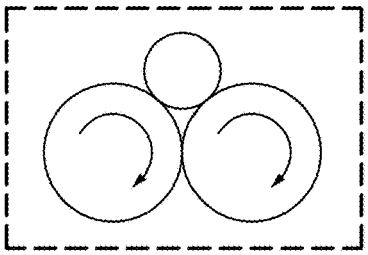

As shown in FIG. 8, a heating coil 106 is disposed adjacent to the plurality of iron nitride-containing workpieces 74 and moves relative to the plurality of iron nitride-containing workpieces 74 in a direction indicated by arrow 108, which may be substantially parallel to the major axes of the respective iron nitride-containing workpieces 74. Each of the plurality of iron nitride-containing workpieces 74 may be strained using rollers, as shown in the inset of FIG. 8A, and similar to the first and second sets of rollers 82 and 86 illustrated in FIG. 6. As the heating coil 106 moves relative to workpieces 74 (e.g., due to motion of coil 106 and/or workpieces 74), workpieces 74 are annealed under strain and at least some of the phase constitution of workpieces 74 changes from a different iron nitride phase (e.g., $Fe_8N$, FeN, $Fe_2N$ (e.g., $\xi$-$Fe_2N$), $Fe_3N$ (e.g., $\epsilon$-$Fe_3N$), $Fe_4N$ (e.g., $\gamma'$-$Fe_4N$), $Fe_2N_6$, $Fe_8N$, $Fe_{16}N_2$, and $FeN_x$ (where x is between about 0.05 and about 0.5)) to $Fe_{16}N_2$. In some examples, substantially all iron nitride present in the polycrystalline iron nitride region 102 is transformed to $Fe_{16}N_2$. In some instances, each of iron workpieces 74 consists essentially of a single $Fe_{16}N_2$ phase domain 104 after being annealed.

In some examples, regardless of the apparatus used to strain and anneal iron nitride-containing workpiece 74, the strain exerted on iron nitride-containing workpiece 74 is sufficient to reduce a dimension of iron nitride-containing workpiece 74 in at least one axis. As described above, in some examples, iron nitride-containing workpiece 74 may define a dimension in at least one axis of between about 1 mm and about 5 mm after being casted, quenched, and pressed. After the straining and annealing (66), in some examples, iron nitride-containing workpiece 74 may define a dimension in the at least one axis of less than about 0.1 mm. In some examples when iron nitride-containing workpiece 74 defines a dimension of less than about 0.1 mm in at least one axis, iron nitride-containing workpiece 74 may consist essentially of a single domain structure, such as a single $Fe_{16}N_2$ phase domain. This may contribute to high anisotropy, which may result in a higher energy product than an iron nitride magnet with lower anisotropy. For example, an iron-nitride containing workpiece that consists essentially of a single $Fe_{16}N_2$ phase domain may have a magnetic coercivity as high as 4000 Oe, and an energy product as high as 30 MGOe.

In some examples, after formation of the workpiece including at least one $Fe_{16}N_2$ phase domain, the workpiece may be magnetized by exposing the workpiece to a magnetic field having a predetermined, sufficiently large moment in a predetermined direction relative to the workpiece including at least one $Fe_{16}N_2$ phase domain. Additionally or alternatively, as will be described below, in some examples, the iron nitride-containing workpiece 74 may be assembled with other iron nitride-containing workpieces 74 to form a larger magnet.

In the example technique described with reference to FIG. 5, an iron nitride-containing material was used as an input. In other examples, an iron-containing material (as opposed to an iron nitride-containing material) may be used and may be nitridized as part of the process of forming the workpieces including $Fe_{16}N_2$. In some examples, the technique described above with respect to FIGS. 1-4 may be utilized to nitride an iron-containing raw material. The iron nitride-containing powder then may be used as an input for the technique illustrated in FIG. 5.

Figure 9:
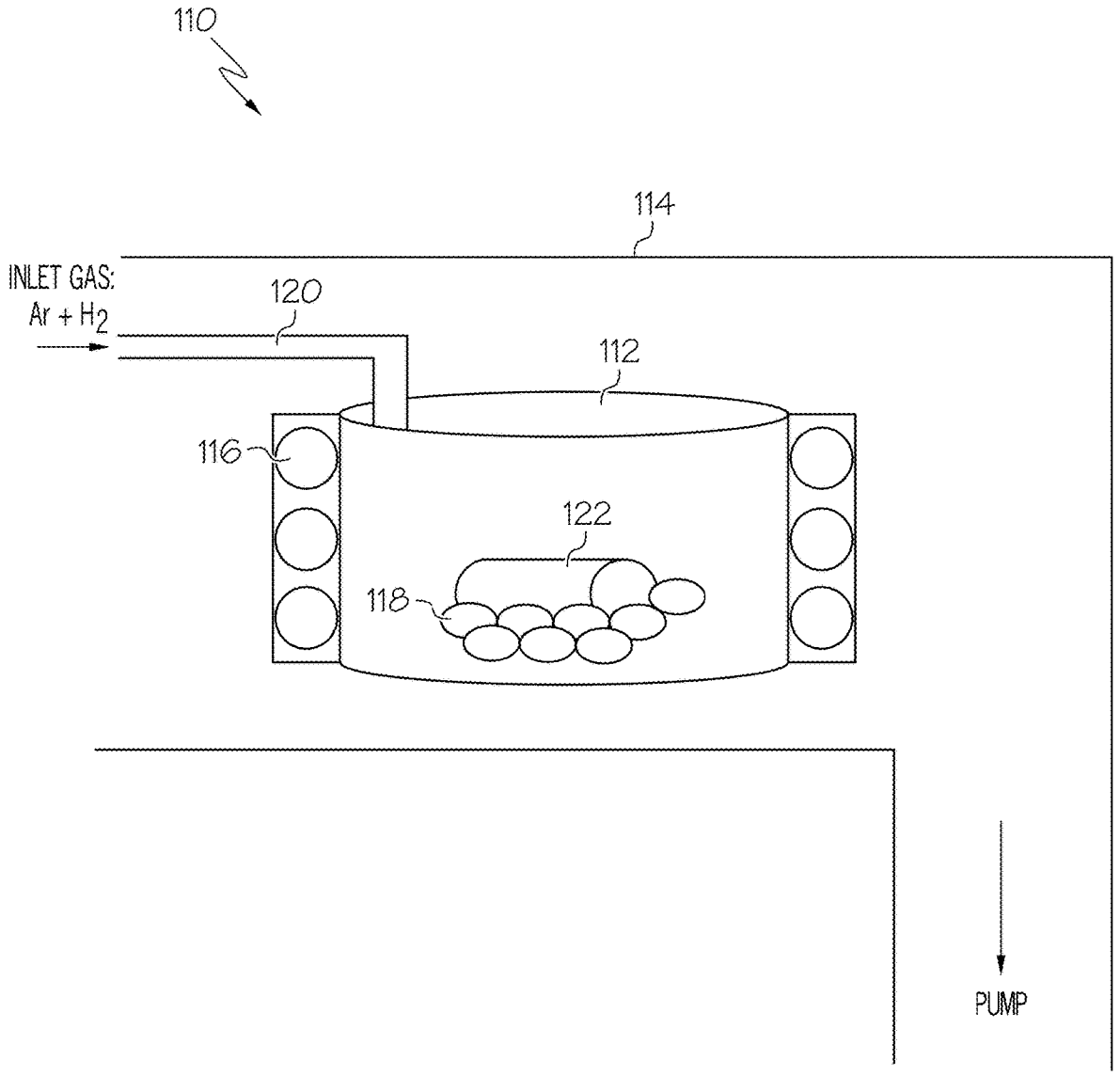
FIG. 9 is a conceptual diagram of an example apparatus that may be used to nitridize an iron-containing raw material using a urea diffusion process.

In other examples, a different technique may be used to nitridize an iron-containing material. FIG. 9 is a conceptual diagram of an example apparatus that may be used to nitridize an iron-containing raw material using a urea diffusion process. Such a urea diffusion process may be used to nitridize an iron-containing raw material, whether the iron-containing material includes single crystal iron, polycrystalline iron, or the like. Moreover, iron materials with different shapes, such as wires, ribbons, sheets, powders, or bulk, can also be infused with nitrogen using a urea diffusion process. For example, for some wire materials, the diameter of the wire may be between, e.g., several micrometers and several millimeters. As another example, for some sheet or ribbon materials, the sheet or ribbon thickness may be from, e.g., several nanometers to several millimeters. As a further example, for some bulk materials, the material may mass between, e.g., about 1 milligram and several kilograms.

As shown, apparatus 110 includes crucible 112 within vacuum furnace 114. Iron-containing material 122 is located within crucible 112 along with urea 118. As shown in FIG. 9, a carrier gas including Ar and hydrogen is fed into crucible 112 during the urea diffusion process. In other examples, a different carrier gas or even no carrier gas may be used. In some examples, the gas flow rate within vacuum furnace 114 during the urea diffusion process may be between approximately 5 sccm to approximately 50 sccm, such as, e.g., 20 sccm to approximately 50 sccm or 5 sccm to approximately 20 sccm.

Heating coils 116 may heat iron-containing material 122 and urea 118 during the urea diffusion process using any suitable technique, such as, e.g., eddy current, inductive current, radio frequency, and the like. Crucible 112 may be configured to withstand the temperature used during the urea diffusion process. In some examples, crucible 112 may be able to withstand temperatures up to approximately 1600° C.

Urea 118 may be heated with iron-containing material 122 to generate nitrogen that may diffuse into iron-containing material 122 to form an iron nitride-containing material. In some examples, urea 118 and iron-containing material 122 may heated to approximately 650° C. or greater within crucible 112 followed by cooling to quench the iron and nitrogen mixture to form an iron nitride material. In some examples, urea 118 and iron-containing material 122 may heated to approximately 650° C. or greater within crucible 112 for between approximately 5 minutes to approximately 1 hour. In some examples, urea 118 and iron-containing material 122 may be heated to between approximately 1000° C. to approximately 1500° C. for several minutes to approximately an hour. The time of heating may depend on nitrogen thermal coefficient in different temperature. For example, if iron-containing material 122 has thickness of about 1 micrometer, the diffusion process may be finished in about 5 minutes at about 1200° C., about 12 minutes at 1100° C., and so forth.

To cool the heated material during the quenching process, cold water may be circulated outside the crucible 112 to rapidly cool the contents. In some examples, the temperature may be decreased from 650° C. to room temperature in about 20 seconds.

The iron nitride-containing material formed by the urea diffusion process then may be used as an input to the technique illustrated in FIG. 5 for forming workpieces including at least one $Fe_{16}N_2$ phase domain. Hence, either iron nitride-containing material or iron-containing material may be used to form workpieces including at least one $Fe_{16}N_2$ phase domain. However, when iron nitride-containing material is used as the starting material, further nitriding may not be performed, which may lower costs of manufacturing workpieces including at least one $Fe_{16}N_2$ phase domain compared to techniques that include nitriding iron-containing raw materials.

Figure 10A:
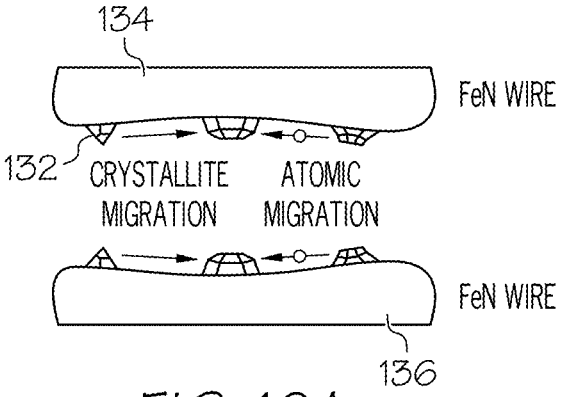
FIGS. 10A-10C are conceptual diagrams illustrating an example technique for joining at least two workpieces including at least one $Fe_{16}N_2$ phase domain.
Figure 10B:
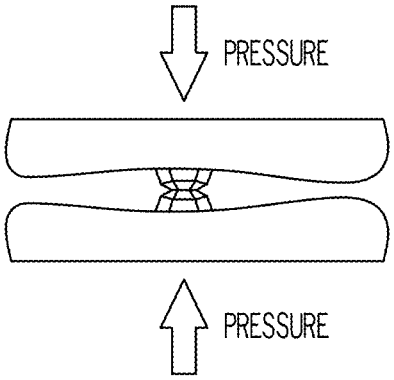
Figure 10C:
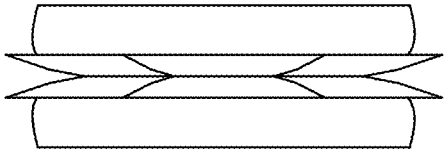

In some examples, the workpieces including at least one $Fe_{16}N_2$ phase domain may subsequently be joined to form a magnetic material of larger size than an individual workpiece. In some examples, as described above, the workpieces including at least one $Fe_{16}N_2$ phase domain may define a dimension of less than 0.1 mm in at least one axis. Multiple workpieces including at least one $Fe_{16}N_2$ phase domain may be joined to form a magnetic material having a size of greater than 0.1 mm in the at least one axis. FIGS. 10A-10C are conceptual diagrams illustrating an example technique for joining at least two workpieces including at least one $Fe_{16}N_2$ phase domain. As shown in FIG. 10A, tin (Sn) 132 may be disposed on a surface of at least one workpiece including at least one $Fe_{16}N_2$ phase domain, such as first workpiece 134 and second workpiece 136. As shown between FIGS. 10A and 10B, crystallite and atomic migration may cause the Sn to agglomerate. First workpiece 134 and second workpiece 136 then may be pressed together and heated to form an iron-tin (Fe—Sn) alloy. The Fe—Sn alloy may be annealed at a temperature between about 150° C. and about 400° C. to join first workpiece 134 and second workpiece 136. In some examples, the annealing temperature may be sufficiently low that magnetic properties of first workpiece 134 and second workpiece 136 (e.g., magnetization of the at least one $Fe_{16}N_2$ and proportion of $Fe_{16}N_2$ phase domains within workpieces 134 and 136) may be substantially unchanged. In some examples, rather than Sn 132 being used to join the at least to workpieces including at least one $Fe_{16}N_2$ phase domain, Cu, Zn, or Ag may be used.

In some examples, <001> crystal axes of the respective workpieces 134 and 136 may be substantially aligned. In examples in which the <001> crystal axes of the respective workpieces 134 and 136 are substantially parallel to a long axis of the respective workpieces 134 and 136, substantially aligning the long axes of workpieces 134 and 136 may substantially align the <001> crystal axes of workpieces 134 and 136. Aligning the <001> crystal axes of the respective workpieces 134 and 136 may provide uniaxial magnetic anisotropy to the magnet formed from workpieces 134 and 136.

Figure 11:
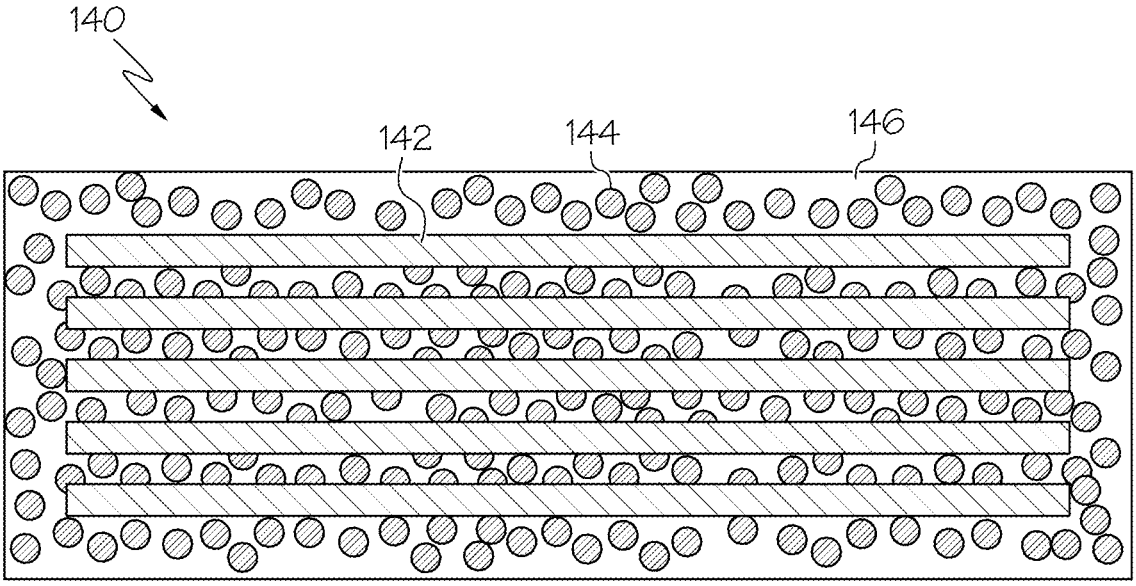
FIG. 11 is a conceptual diagram illustrating another example technique for joining at least two workpieces including at least one $Fe_{16}N_2$ phase domain.

FIG. 11 is a conceptual diagram illustrating another example technique for joining at least two workpieces including at least one $Fe_{16}N_2$ phase domain. As shown in FIG. 11, a plurality of workpieces including at least one $Fe_{16}N_2$ phase domain 142 are disposed adjacent to each other, with long axes substantially aligned. As described above, in some examples, substantially aligning the long axes of workpieces 142 may substantially align the <001> crystal axes of workpieces 142, which may provide uniaxial magnetic anisotropy to the magnet formed from workpieces 142.

In the example of FIG. 11, ferromagnetic particles 144 are disposed within a resin or other adhesive 146. Examples of resin or other adhesive 146 include natural or synthetic resins, including ion-exchange resins, such as those available under the trade designation Amberlite™, from The Dow Chemical Company, Midland, Mich.; epoxies, such as Bismaleimide-Triazine (BT)-Epoxy; a polyacrylonitrile; a polyester; a silicone; a prepolymer; a polyvinyl buryral; urea-formaldehyde, or the like. Because resin or other adhesive 146 substantially fully encapsulates the plurality of workpieces including at least one $Fe_{16}N_2$ phase domain 142, and ferromagnetic particles 144 may be disposed substantially throughout the volume of resin or other adhesive 146, at least some ferromagnetic particles 144 are disposed between adjacent workpieces of the plurality of workpieces including at least one $Fe_{16}N_2$ phase domain 142. In some examples, the resin or other adhesive 146 may be cured to bond the plurality of workpieces including at least one $Fe_{16}N_2$ phase domain 142 to each other.

The ferromagnetic particles 144 may be magnetically coupled to $Fe_{16}N_2$ hard magnetic material within the plurality of workpieces including at least one $Fe_{16}N_2$ phase domain 142 via exchange spring coupling. Exchange spring coupling may effectively harden the magnetically soft ferromagnetic particles 144 and provide magnetic properties for the bulk material similar to those of a bulk material consisting essentially of $Fe_{16}N_2$. To achieve exchange spring coupling throughout the volume of the magnetic material, the $Fe_{16}N_2$ domains may be distributed throughout the magnetic structure 140, e.g., at a nanometer or micrometer scale.

In some examples, magnetic materials including $Fe_{16}N_2$ domains and domains of ferromagnetic particles 144 and resin or other adhesive 146 may include a volume fraction of $Fe_{16}N_2$ domains of less than about 40 volume percent (vol. %) of the entire magnetic structure 140. For example, the magnetically hard $Fe_{16}N_2$ phase may constitute between about 5 vol. % and about 40 vol. % of the total volume of the magnetic structure 140, or between about 5 vol. % and about 20 vol. % of the total volume of the magnetic structure 140, or between about 10 vol. % and about 20 vol. % of the total volume of the magnetic structure 140, or between about 10 vol. % and about 15 vol. % of the total volume of the magnetic structure 140, or about 10 vol. % of the total volume of the magnetic structure 140, with the remainder of the volume being ferromagnetic particles 144 and resin or other adhesive 146. The ferromagnetic particles 144 may include, for example, Fe, FeCo, $Fe_8N$, or combinations thereof.

In some examples, the magnetic structure 140 may be annealed at a temperature between about 50° C. and about 200° C. for between about 0.5 hours and about 20 hours to form a solid magnetic structure 140.

Figure 12:
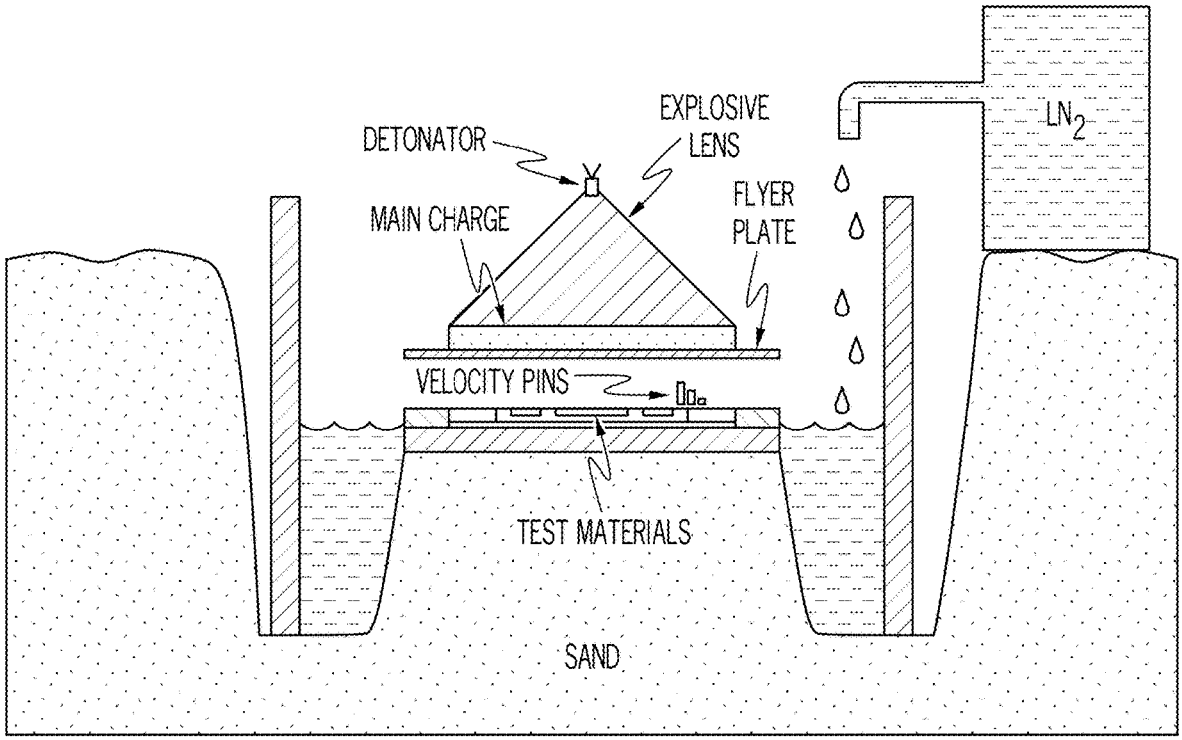
FIG. 12 is a conceptual diagram that illustrates another technique for joining at least two workpieces including at least one $Fe_{16}N_2$ phase domain.
Figure 13:
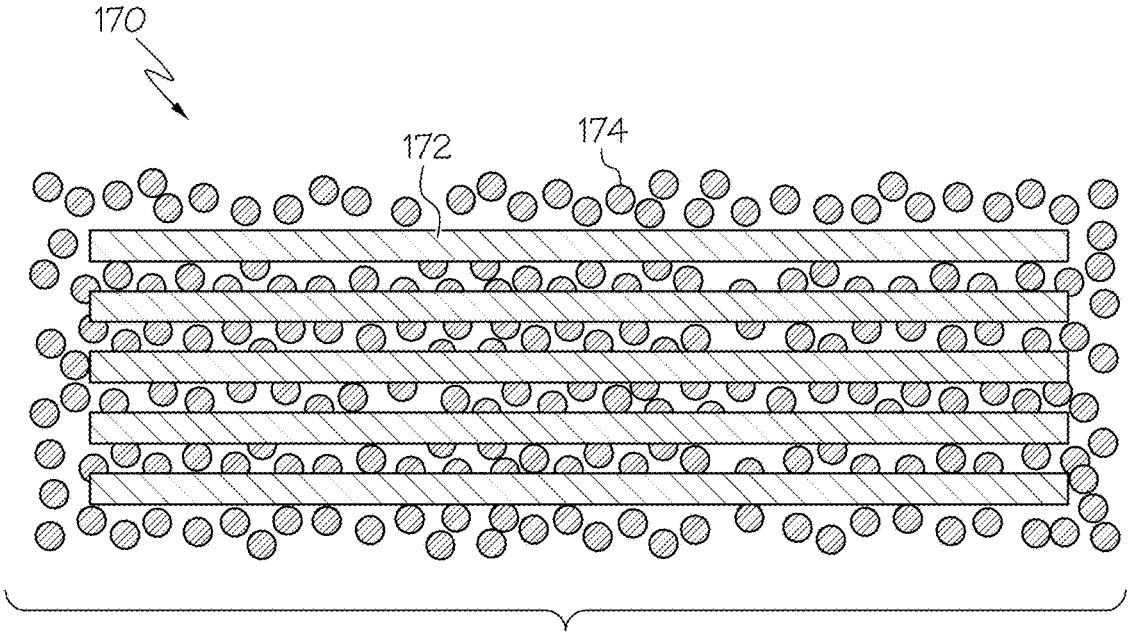
FIG. 13 is a conceptual diagram illustrating a plurality of workpieces including at least one $Fe_{16}N_2$ phase domain with ferromagnetic particles disposed about the plurality of workpieces including at least one $Fe_{16}N_2$ phase domain.

FIG. 12 is a conceptual diagram that illustrates another technique for joining at least two workpieces including at least one $Fe_{16}N_2$ phase domain. FIG. 12 illustrates a compression shock apparatus that may be used to generate a compression shock, which joins the at least two workpieces including at least one $Fe_{16}N_2$ phase domain. FIG. 13 is a conceptual diagram illustrating a plurality of workpieces including at least one $Fe_{16}N_2$ phase domain 172 with ferromagnetic particles 144 disposed about the plurality of workpieces including at least one $Fe_{16}N_2$ phase domain 172. As shown in FIG. 13, a plurality of workpieces including at least one $Fe_{16}N_2$ phase domain 172 are disposed adjacent to each other, with long axes substantially aligned. As described above, in some examples, substantially aligning the long axes of workpieces 172 may substantially align the <001> crystal axes of workpieces 172, which may provide uniaxial magnetic anisotropy to the magnet formed from workpieces 172. At least some ferromagnetic particles 174 are disposed between adjacent workpieces of the plurality of workpieces including at least one $Fe_{16}N_2$ phase domain 172.

In some examples, shock compression may include placing workpieces 172 between parallel plates. The workpieces 172 may be cooled by flowing liquid nitrogen through conduit coupled to a back side of one or both of the parallel plates, e.g., to a temperature below 0° C. A gas gun may be used to impact one of the parallel plates with a burst of gas at a high velocity, such as about 850 m/s. In some examples, the gas gun may have a diameter between about 40 mm and about 80 mm.

After the shock compression, the ferromagnetic particles 174 may be magnetically coupled to $Fe_{16}N_2$ hard magnetic material within the plurality of workpieces including at least one $Fe_{16}N_2$ phase domain 172 via exchange spring coupling. Exchange spring coupling may effectively harden the magnetically soft ferromagnetic particles 174 and provide magnetic properties for the bulk material similar to those of a bulk material consisting essentially of $Fe_{16}N_2$. To achieve exchange spring coupling throughout the volume of the magnetic material, the $Fe_{16}N_2$ domains may be distributed throughout the magnetic structure formed by the plurality of workpieces including at least one $Fe_{16}N_2$ phase domain 172 and ferromagnetic particles 174, e.g., at a nanometer or micrometer scale.

In some examples, magnetic materials including $Fe_{16}N_2$ domains and domains of ferromagnetic particles 174 may include a volume fraction of $Fe_{16}N_2$ domains of less than about 40 volume percent (vol. %) of the entire magnetic structure. For example, the magnetically hard $Fe_{16}N_2$ phase may constitute between about 5 vol. % and about 40 vol. % of the total volume of the magnetic structure, or between about 5 vol. % and about 20 vol. % of the total volume of the magnetic structure, or between about 10 vol. % and about 20 vol. % of the total volume of the magnetic structure, or between about 10 vol. % and about 15 vol. % of the total volume of the magnetic structure, or about 10 vol. % of the total volume of the magnetic structure, with the remainder of the volume being ferromagnetic particles 174. The ferromagnetic particles 174 may include, for example, Fe, FeCo, $Fe_8N$, or combinations thereof.

Figure 14:
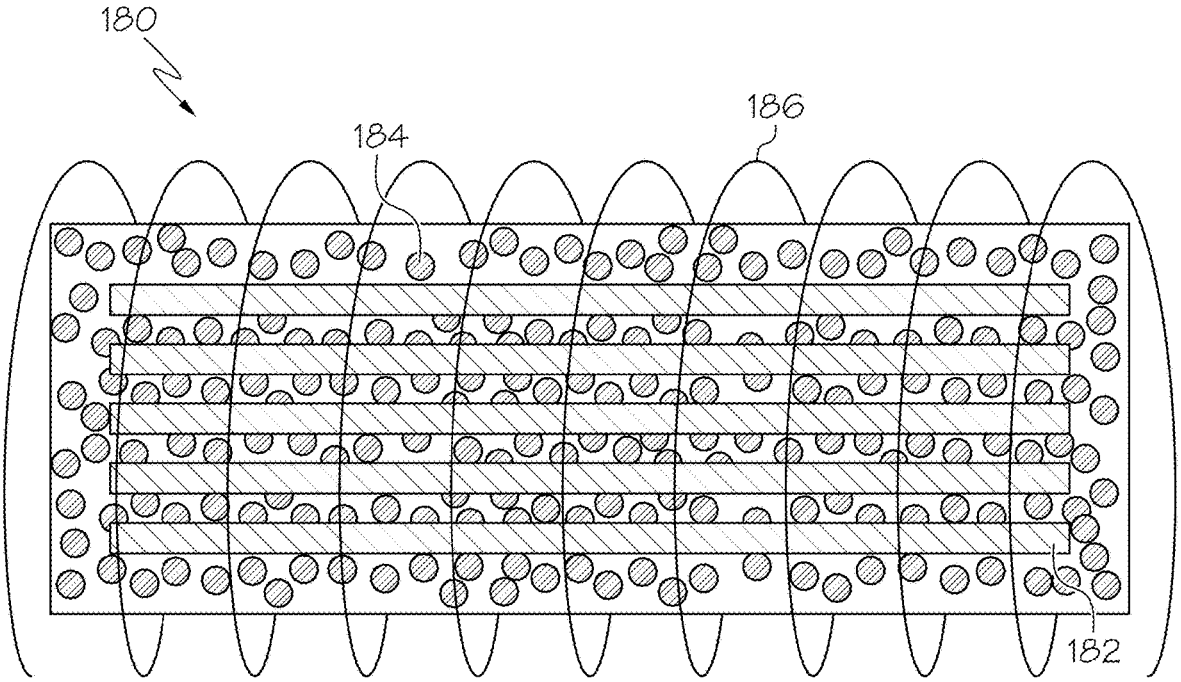
FIG. 14 is a conceptual diagram of another apparatus that may be used for joining at least two workpieces including at least one $Fe_{16}N_2$ phase domain.

FIG. 14 is a conceptual diagram of another apparatus that may be used for joining at least two workpieces including at least one $Fe_{16}N_2$ phase domain. The apparatus 180 of FIG. 14 includes a conductive coil 186 through which a current may be applied, which generates an electromagnetic field. The current may be generated in a pulse to generate an electromagnetic force, which may help to consolidate the at least two workpieces including $Fe_{16}N_2$ phase domains 182. In some examples, ferromagnetic particles 184 may be disposed about the at least two workpieces including $Fe_{16}N_2$ phase domains 182. In some examples, the at least two workpieces including $Fe_{16}N_2$ phase domains 182 may be disposed within an electrically conductive tube or container within the bore of conductive coil 186. Conductive coil 186 may be pulsed with a high electrical current to produce a magnetic field in the bore of conductive coil 186 that, in turn, induces electrical currents in the electrically conductive tube or container. The induced currents interact with the magnetic field generated by conductive coil 186 to produce an inwardly acting magnetic force that collapses the electrically conductive tube or container. The collapsing electromagnetic container or tubetransmits a force to the at least two workpieces including $Fe_{16}N_2$ phase domains 182 and joins the at least two workpieces including $Fe_{16}N_2$ phase domains 182. After the consolidation of the at least two workpieces including $Fe_{16}N_2$ phase domains 182 with the ferromagnetic particles 184, the ferromagnetic particles 184 may be magnetically coupled to $Fe_{16}N_2$ hard magnetic material within the plurality of workpieces including at least one $Fe_{16}N_2$ phase domain 182 via exchange spring coupling. In some examples, this technique may be used to produce workpieces that have at least one of cylindrical symmetry, a high aspect-ratio, or a net shape (a shape corresponding to a desired final shape of the workpiece).

In some examples, magnetic materials including $Fe_{16}N_2$ domains and domains of ferromagnetic particles 184 may include a volume fraction of $Fe_{16}N_2$ domains of less than about 40 volume percent (vol. %) of the entire magnetic structure. For example, the magnetically hard $Fe_{16}N_2$ phase may constitute between about 5 vol. % and about 40 vol. % of the total volume of the magnetic structure, or between about 5 vol. % and about 20 vol. % of the total volume of the magnetic structure, or between about 10 vol. % and about 20 vol. % of the total volume of the magnetic structure, or between about 10 vol. % and about 15 vol. % of the total volume of the magnetic structure, or about 10 vol. % of the total volume of the magnetic structure, with the remainder of the volume being ferromagnetic particles 184. The ferromagnetic particles 184 may include, for example, Fe, FeCo, $Fe_8N$, or combinations thereof.

In any of the above examples, other techniques for assisting consolidation of a plurality of workpieces including at least one $Fe_{16}N_2$ phase domain may be used, such as pressure, electric pulse, spark, applied external magnetic fields, a radio frequency signal, laser heating, infrared heating, for the like. Each of these example techniques for joining a plurality of workpieces including at least one $Fe_{16}N_2$ phase domain may include relatively low temperatures such that the temperatures use may leave the $Fe_{16}N_2$ phase domains substantially unmodified (e.g., by converting $Fe_{16}N_2$ phase domains to other types of iron nitride).

In some examples, the disclosure describes techniques for forming a magnet including $Fe_{16}N_2$ phase domains from a powder including iron nitride. By using iron nitride-containing raw materials to form the permanent magnet including $Fe_{16}N_2$ phase domains, further nitriding of iron may be avoided, which may reduce a cost of forming the permanent magnet including $Fe_{16}N_2$ phase domains, e.g., compared to techniques which include nitriding pure iron.

Figure 15:
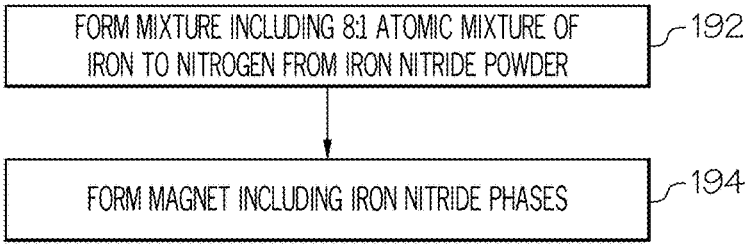
FIG. 15 is a flow diagram that illustrates an example technique for forming a magnet including iron nitride.

FIG. 15 is a flow diagram that illustrates an example technique for forming a magnet including iron nitride (e.g., $Fe_{16}N_2$ phase domains). As shown in FIG. 15, the technique includes forming a mixture including an approximately 8:1 iron-to-nitrogen atomic ratio (192). For example, the mixture may include between about 8 atomic percent (at. %) and about 15 at. % nitrogen, with a balance iron, other elements, and dopants. As another example, the mixture may include between about 10 at. % and about 13 at. % nitrogen, or about 11.1 at. % nitrogen.

In some examples, the iron nitride-containing powder formed by milling iron in a nitrogen source (e.g., an amide- or hydrazine-containing liquid or solution), described above, may be used in the mixture including the approximately 8:1 iron-to-nitrogen atomic ratio. The iron nitride-containing powder may include at least one of FeN, $Fe_2N$, $Fe_3N$, $Fe_4N$, $Fe_8N$, $FeN_6$, $Fe_8N$, $Fe_{16}N_2$, or $FeN_x$ (where x is between about 0.05 and about 0.5). Additionally, the iron nitride powder may include other materials, such as pure iron, cobalt, nickel, dopants, or the like.

In some examples, the iron nitride-containing powder may be mixed with pure iron to establish the desired iron to nitrogen atomic ratio. The specific proportion of the different types of iron nitride-containing powder and pure iron may be influenced by the type and proportion of iron nitride in the iron-nitride-containing powder. As described above, the iron-nitride containing powder may include at least one of FeN, $Fe_2N$ (e.g., $\xi$-$Fe_2N$), $Fe_3N$ (e.g., $\epsilon$-$Fe_3N$), $Fe_4N$ (e.g., $\gamma'$-$Fe_4N$), $FeN_6$, $Fe_8N$, $Fe_{16}N_2$, and $FeN_x$ (where x is between about 0.05 and about 0.5).

Figure 16:
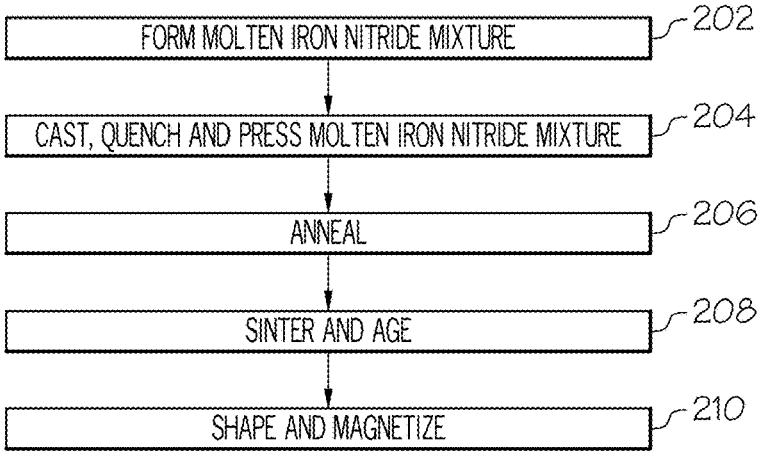
FIGS. 16-18 are flow diagrams illustrating example techniques for forming a magnet including iron nitride phase domains from a mixture including an iron to nitride ratio of about 8:1.
Figure 17:
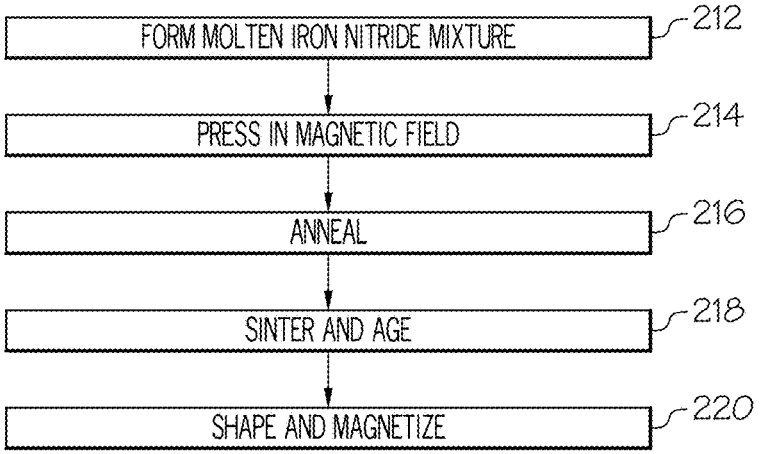
Figure 18:
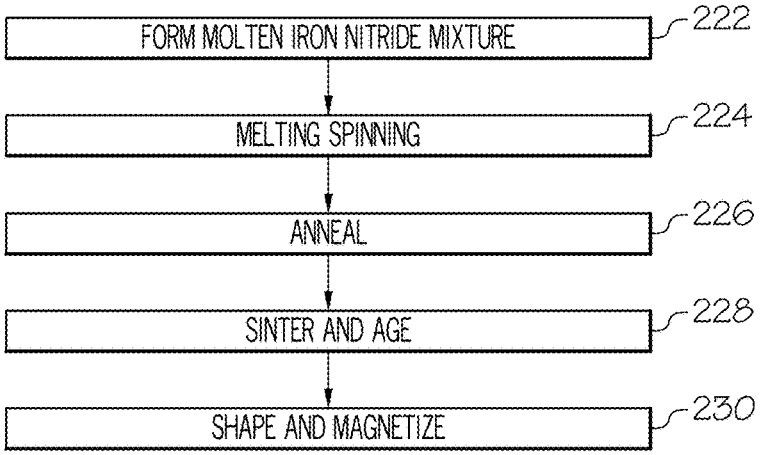

The resulting mixture including the approximately 8:1 iron to nitrogen ratio then may be formed into a magnet that includes iron nitride phase domains (194). The mixture including the approximately 8:1 iron to nitrogen ratio may be, for example, melted, formed into an article with a predetermined shape, and annealed to form $Fe_{16}N_2$ phase domains (e.g., $\alpha''$-$Fe_{16}N_2$ phase domains) within the article. FIGS. 16-18 are flow diagrams illustrating three example techniques for forming a magnet including iron nitride phase domains (94).

As shown in FIG. 16, a first example technique includes forming a molten iron nitride mixture (202). In some examples, the mixture including iron and nitrogen may have a purity (e.g., collective iron and nitrogen content) of at least 92 atomic percent (at. %).

In some examples, the mixture including iron and nitrogen may include at least one dopant, such as a ferromagnetic or nonmagnetic dopant and/or a phase stabilizer. In some examples, at least one ferromagnetic or nonmagnetic dopant may be referred to as a ferromagnetic or nonmagnetic impurity and/or the phase stabilizer may be referred to as a phase stabilization impurity. A ferromagnetic or nonmagnetic dopant may be used to increase at least one of the magnetic moment, magnetic coercivity, or thermal stability of the magnetic material formed from the mixture including iron and nitrogen. Examples of ferromagnetic or nonmagnetic dopants include Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, and Ta. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms. In some examples, more than one (e.g., at least two) ferromagnetic or nonmagnetic dopants may be includes in the mixture including iron and nitrogen. In some examples, the ferromagnetic or nonmagnetic dopants may function as domain wall pinning sites, which may improve coercivity of the magnetic material formed from the mixture including iron and nitrogen.

Alternatively or additionally, the mixture including iron and nitrogen may include at least one phase stabilizer. The at least one phase stabilizer may be an element selected to improve at least one of $Fe_{16}N_2$ volume ratio, thermal stability, coercivity, and erosion resistance. When present in the mixture, the at least one phase stabilizer may be present in the mixture including iron and nitrogen at a concentration between about 0.1 at. % and about 15 at. %. In some examples in which at least two phase stabilizers at present in the mixture, the total concentration of the at least two phase stabilizers may be between about 0.1 at. % and about 15 at. %. The at least one phase stabilizer may include, for example, B, Al, C, Si, P, O, Co, Cr, Mn, and/or S. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms.

In some examples, forming the molten iron nitride mixture (202) may include heating the mixture including iron and nitrogen, and, optionally, at least one nonmagnetic or ferromagnetic dopant and/or at least one phase stabilizer at a temperature above about 1500° C. In some examples, the mixture including iron and nitrogen may be heated in a furnace using a radio frequency (RF) induction coil. In examples in which a bulk iron nitride-containing material is used, the furnace may be heated at a temperature greater than about 1600° C. In examples in which an iron-nitride containing powder is used, the furnace may be heated at a temperature greater than about 2000° C.

In other examples, the mixture including iron and nitrogen may be heated in a furnace using a low or mid-frequency induction coil. In some examples in which a low or mid-frequency induction coil is used to heat the furnace, the furnace may be heated at a temperature greater than about 1600° C., regardless of whether a bulk iron nitride-containing material or an iron-nitride containing powder is used as the mixture including iron and nitrogen. In some examples, the mixture including iron and nitrogen may be heated under an ambient atmosphere.

Once the mixture including iron and nitrogen is molten, the mixture may be subjected to a casting, quenching, and pressing process to form iron nitride-containing workpieces (204). The molten mixture including iron and nitrogen may be deposited in a mold, which may shape the mixture including iron and nitrogen into a predetermined shape, such as at least one workpiece or other article having length that is greater than its width or diameter. During the casting process, the temperature of the mold may be maintained at a temperature between about 650° C. and about 1200° C., depending on the casting speed. In some examples, during the casting process, the temperature of the mold may be maintained at a temperature between about 800° C. and about 1200° C. In some examples, the casting process can be conducted in air, a nitrogen environment, an inert environment, a partial vacuum, a full vacuum, or any combination thereof. In some examples, the pressure during casting can be between about 0.1 GPa and about 20 GPa. In some implementations, the casting and quenching process can be assisted by a straining field, a temperature field, a pressure field, a magnetic field, and/or an electrical field, or any combination thereof.

After casting is complete or while the casting process is being completed, the mixture including iron and nitrogen may be quenched to set the crystalline structure and phase composition of the iron-nitride containing material. In some examples, the quenching process includes heating the workpieces to a temperature above 650° C. for between about 0.5 hour and about 20 hours. In some examples, the temperature of the workpieces may be dropped abruptly below the martensite temperature of the workpiece alloy (Ms). For example, for $Fe_{16}N_2$, the martensite temperature (Ms) is about 250° C. In some examples, the mixture including iron and nitrogen may be cooled at a rate of greater than 50° C. per second during the quenching process. The medium used for quenching can include a liquid, such as water, brine (with a salt concentration between about 1% and about 30%), a non-aqueous liquid or solution such as an oil, or liquid nitrogen. In other examples, the quenching medium can include a gas, such as nitrogen gas with a flow rate between about 1 sccm and about 1000 sccm. In other examples, the quenching medium can include a solid, such as salt, sand, or the like. In some implementations, an electrical field or a magnetic field can be applied to assist the quenching process.

After quenching is complete, the iron nitride-containing material may be pressed to achieve the predetermined size of the iron nitride-containing material. During the pressing process, the temperature of the iron nitride-containing material may be maintained below about 250° C., and the iron nitride-containing material may be exposed to a pressure between about 5 tons and 50 tons, depending on the desired final dimension of the iron nitride-containing material. In some examples, to facilitate the reduction of the dimension of the workpiece in at least one axis, a roller may be used to exert a pressure on the iron nitride-containing material. In some examples, the temperature of the iron nitride-containing material may be between about −150° C. and about 300° C. during the pressing process. When the pressing process is complete, the iron nitride-containing material may be in the shape of a workpiece with a dimension in at least one axis between about 0.01 mm and about 50 mm, as described above. The iron nitride-containing workpiece may include at least one $Fe_8N$ iron nitride phase domain.

The technique illustrated in FIG. 16 further includes annealing the iron nitride-containing workpiece (206). The annealing process may convert at least some of the $Fe_8N$ iron nitride phase domains to $Fe_{16}N_2$ phase domains. In some examples, the annealing process may be similar to or substantially the same (e.g., the same or nearly the same) as the straining and annealing step (66) described with respect to FIG. 5. A strain inducing apparatus may strain the iron nitride-containing workpiece to a certain elongation. For example, the strain on the iron nitride-containing workpiece may be between about 0.3% and about 12%. In other examples, the strain on the iron nitride-containing workpiece may be less than about 0.3% or greater than about 12%. In some examples, exerting a certain strain on iron nitride-containing workpiece may result in a substantially similar strain on individual unit cells of the iron, such that the unit cell is elongated along the <001> axis between about 0.3% and about 12%.

While the iron nitride-containing workpiece is strained, the iron nitride-containing workpiece may be heated to anneal the iron nitride-containing. The iron nitride-containing workpiece may be annealed by heating the iron nitride-containing workpiece to a temperature between about 100° C. and about 250° C., such as between about 120° C. and about 200° C. Annealing the iron nitride-containing workpiece while the straining iron nitride-containing workpiece may facilitate conversion of at least some of the iron nitride phase domains to $Fe_{16}N_2$ phase domains.

The annealing process may continue for a predetermined time that is sufficient to allow diffusion of the nitrogen atoms to the appropriate interstitial spaces. In some examples, the annealing process continues for between about 20 hours and about 100 hours, such as between about 40 hours and about 60 hours. In some examples, the annealing process may occur under an inert atmosphere, such as Ar, to reduce or substantially prevent oxidation of the iron. In some implementations, while the iron nitride-containing workpiece is annealed the temperature is held substantially constant.

Once the annealing process has been completed, a plurality of workpieces including at least one $Fe_{16}N_2$ phase domain may be sintered together to form a magnetic material and aged (208). The plurality of workpieces including at least one $Fe_{16}N_2$ phase domain may be pressed together and sintered. During the sintering process, <001> crystal axes of the respective workpieces may be substantially aligned. In examples in which the <001> crystal axes of the respective workpieces are substantially parallel to a long axis of the respective workpieces, substantially aligning the long axes of workpieces may substantially align the <001> crystal axes of the workpieces. Aligning the <001> crystal axes of the respective workpieces may provide uniaxial magnetic anisotropy to the magnetic material formed from the workpieces.

The sintering pressure, temperature and duration may be selected to mechanically join the workpieces while maintaining the crystal structure of the plurality of workpieces including at least one $Fe_{16}N_2$ phase domain (e.g., as including the $Fe_{16}N_2$ phase domains). Thus, in some examples, the sintering may be performed at a relatively low temperature. For example, the sintering temperature may be below about 250° C., such as between about 120° C. and about 250° C., between about 150° C. and about 250° C., between about 120° C. and about 200° C., between about 150° C. and about 200° C., or about 150° C. The sintering pressure may be between, for example, about 0.2 GPa and about 10 GPa. The sintering time may be at least about 5 hours, such as at least about 20 hours, or between about 5 hours and about 100 hours, or between about 20 hours and about 100 hours, or about 40 hours. The sintering time, temperature, and pressure may be affected by the materials in plurality of workpieces including at least one $Fe_{16}N_2$ phase domain. The sintering may be performed in an ambient atmosphere, a nitrogen atmosphere, a vacuum, or another inert atmosphere.

The sintered material including $Fe_{16}N_2$ phase domains may then be aged. In some examples, aging the sintered material is conducted at a temperature between about 100° C. and about 500° C. for between about 0.5 hour and about 50 hours. The aging step may to stabilize the sintered material and achieve a stable phase domain structure.

After the sintered material including $Fe_{16}N_2$ phase domains has been aged, the sintered material may be shaped and magnetized. In some examples, the sintered material may be shaped to a final shape of the permanent magnet, e.g., depending upon the desired final shape. The sintered material may be shaped by, for example, cutting the sintered material to the final shape. The sintered material or the magnetic material in the final shape may be magnetized using a magnetizer. The magnetic field for magnetizing the magnetic material may be between about 10 kOe and about 100 kOe. In some examples, relatively short-duration pulse may be used to magnetize the sintered material or the magnetic material in the final shape.

FIG. 17 is a flow diagram illustrating another example technique for forming a magnet including iron nitride phase domains from a mixture including an iron to nitride ratio of about 8:1. Like the technique described with reference to FIG. 16, the technique illustrated in FIG. 17 includes forming a molten iron nitride mixture (212). Forming the molten iron nitride mixture (212) may be similar to forming the molten iron nitride mixture (202) described with reference to FIG. 16. For example, in some implementations, the mixture may include at least on ferromagnetic or nonmagnetic dopant and/or at least one phase stabilizer. Unlike the technique described with reference to FIG. 16, the technique illustrated in FIG. 17 includes pressing the molten iron nitride mixture in the presence of a magnetic field (214).

Pressing the molten iron nitride mixture in the presence of a magnetic field (214) may assist the formation of $Fe_{16}N_2$ phase during casting and annealing. In some examples, a 9 Tesla (T) magnetic field may be applied to the molten iron nitride mixture while pressing the molten iron nitride mixture. In some examples, pressing the molten iron nitride mixture in the presence of a magnetic field (214) may be combined with annealing the iron nitride mixture (216). For example, the iron nitride mixture may be annealed at a temperature of about 150° C. while being exposed to an about 9 T magnetic field for about 20 hours. In some examples, the magnetic field may be applied in the plane of the iron nitride mixture to reduce eddy currents and the demagnetization factor.

In some examples, pressing (214) and/or annealing (216) the iron nitride mixture in the presence of an applied magnetic field may facilitate control over the phase constitution and crystalline orientation of the iron nitride mixture. For example, the $Fe_{16}N_2$ content may increase due to an increase in the amount of iron nitride from $\alpha'$ phase to $\alpha''$ phase. This may result in an increased saturation magnetization (Ms) and/or coercivity of the iron nitride mixture.

After pressing the molten iron nitride mixture in the presence of a magnetic field (214), the technique illustrated in FIG. 17 includes annealing (216), sintering and aging (218), and shaping and magnetizing (220). Each of these steps may be similar to or substantially the same as the corresponding steps (206)-(210) described with reference to FIG. 16.

FIG. 18 is a flow diagram illustrating another example technique for forming a magnet including iron nitride phase domains from a mixture including an iron to nitride ratio of about 8:1. Like the technique described with reference to FIG. 16, the technique illustrated in FIG. 17 includes forming a molten iron nitride mixture (222). Forming the molten iron nitride mixture (222) may be similar to forming the molten iron nitride mixture (202) described with reference to FIG. 16. For example, in some implementations, the mixture may include at least on ferromagnetic or nonmagnetic dopant and/or at least one phase stabilizer.

Unlike the technique described with reference to FIG. 16, the technique illustrated in FIG. 18 includes melting spinning the molten iron nitride mixture (224). In melting spinning, the molten iron nitride mixture may be flowed over a cold roller surface to quench the molten iron nitride mixture and form a brittle ribbon of material. In some examples, the cold roller surface may be cooled at a temperature below room temperature by a cooling agent, such as water. For example, the cold roller surface may be cooled at a temperature between about 10° C. and about 25° C. The brittle ribbon of material may then undergo a heat treatment step to pre-anneal the brittle iron material. In some examples, the heat treatment may be carried out at a temperature between about 200° C. and about 600° C. at atmospheric pressure for between about 0.1 hour and about 10 hours. In some examples, the heat treatment may be performed in a nitrogen or argon atmosphere. After heat-treating the brittle ribbon of material under an inert gas, the brittle ribbon of material may be shattered to form an iron-containing powder. After melting spinning the molten iron nitride mixture (224), the technique illustrated in FIG. 18 includes annealing (226), sintering and aging (228), and shaping and magnetizing (230). Each of these steps may be similar to or substantially the same as the corresponding steps (206)-(210) described with reference to FIG. 16.

In some examples, the disclosure describes techniques for incorporating at least one of a ferromagnetic or nonmagnetic dopant into iron nitride and/or incorporating at least one phase stabilizer into iron nitride. In some examples, the at least one of a ferromagnetic or nonmagnetic dopant may be used to increase at least one of the magnetic moment, magnetic coercivity, or thermal stability of the magnetic material formed from the mixture including iron and nitrogen. Examples of ferromagnetic or nonmagnetic dopants include Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, and Ta. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms. In some examples, more than one (e.g., at least two) ferromagnetic or nonmagnetic dopants may be includes in the mixture including iron and nitrogen. In some examples, the ferromagnetic or nonmagnetic dopants may function as domain wall pinning sites, which may improve coercivity of the magnetic material formed from the mixture including iron and nitrogen. Table 1 (above) includes example concentrations of ferromagnetic or nonmagnetic dopants within the mixture including iron and nitrogen.

Alternatively or additionally, the mixture including iron and nitrogen may include at least one phase stabilizer. The at least one phase stabilizer may be selected to stabilize a bct phase, of which $Fe_{16}N_2$ is one type. The at least one phase stabilizer may be an element selected to improve at least one of $Fe_{16}N_2$ volume ratio, thermal stability, coercivity, and erosion resistance. When present in the mixture, the at least one phase stabilizer may be present in the mixture including iron and nitrogen at a concentration between about 0.1 at. % and about 15 at. %. In some examples in which at least two phase stabilizers at present in the mixture, the total concentration of the at least two phase stabilizers may be between about 0.1 at. % and about 10 at. %. The at least one phase stabilizer may include, for example, B, Al, C, Si, P, O, Co, Cr, Mn, and/or S. For example, including Mn dopant atoms at levels between about 5 at. % and about 15 at. % in an iron nitride material including at least one $Fe_{16}N_2$ phase domain may improve thermal stability of the $Fe_{16}N_2$ phase domains and magnetic coercivity of the material compared to an iron nitride material not including Mn dopant atoms.

In some examples, as described above, the at least one of a ferromagnetic or nonmagnetic dopant and/or at least one phase stabilizer may be incorporated into a mixture including an iron nitride powder. The mixture then may be processed to form a magnetic material including at least one $Fe_{16}N_2$ phase domain. In other examples, also described above, the at least one of a ferromagnetic or nonmagnetic dopant and/or at least one phase stabilizer may be incorporated into a mixture including an iron-containing raw material. The mixture including the at least one of a ferromagnetic or nonmagnetic dopant and/or at least one phase stabilizer and the iron-containing raw material then may be nitrided, e.g., by milling the mixture in the presence of a nitrogen source such as an amide- or hydrazine-containing liquid or solution, or using urea diffusion.

Figure 19A:
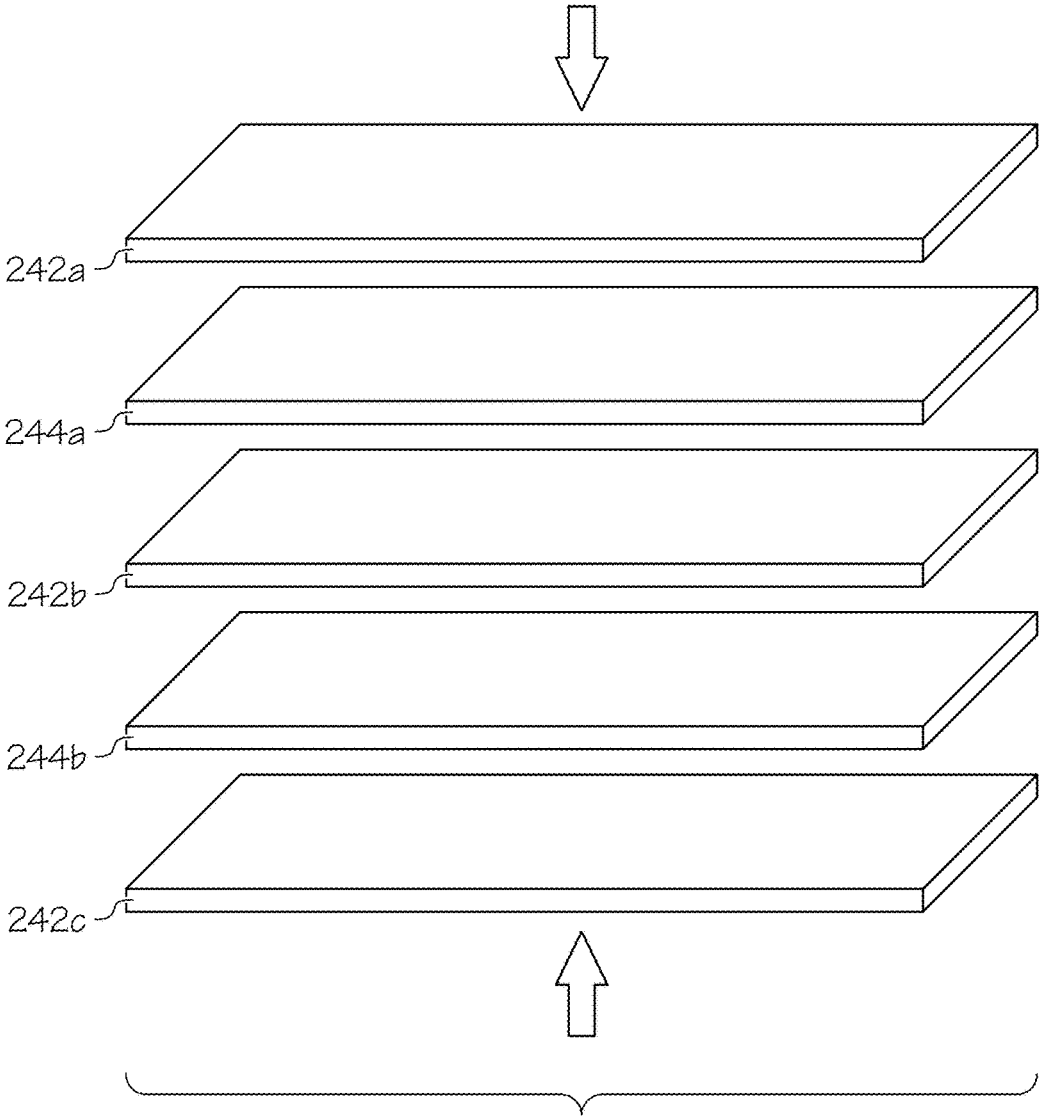
FIGS. 19A and 19B are conceptual diagrams illustrating another example technique for forming a magnetic material including $Fe_{16}N_2$ phase domains and at least one of a ferromagnetic or nonmagnetic dopant and/or at least one phase stabilizer.
Figure 19B:
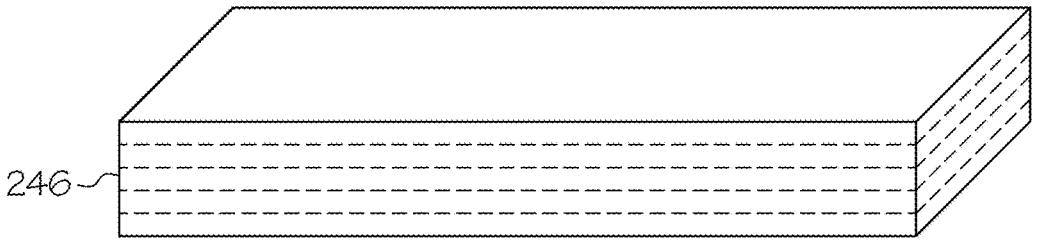

In other examples, the at least one of a ferromagnetic or nonmagnetic dopant and/or at least one phase stabilizer may incorporated into a magnetic material using a different technique. FIGS. 19A and 19B are conceptual diagrams illustrating another example technique for forming a magnetic material including $Fe_{16}N_2$ phase domains and at least one of a ferromagnetic or nonmagnetic dopant and/or at least one phase stabilizer.

As shown in FIGS. 19A and 19B, the at least one of a ferromagnetic or nonmagnetic dopant and/or at least one phase stabilizer may be introduced as sheets 242*a*, 242*b*, 242*c* (collectively, "sheets 242") of material, and may be introduced between sheets 244*a*, 244*b* (collectively, sheets "244") including at least one $Fe_{16}N_2$ phase domain. The sheets 244 including at least one $Fe_{16}N_2$ phase domain may be formed by any of the techniques described herein.

The sheets 242 including at least one of a ferromagnetic or nonmagnetic dopant and/or at least one phase stabilizer may have sizes (e.g., thicknesses) ranging from several nanometers to several hundred nanometers. In some examples, the sheets 242 including at least one of a ferromagnetic or nonmagnetic dopant and/or at least one phase stabilizer may be formed separately from the sheets 244 including at least one $Fe_{16}N_2$ phase domain. In other examples, the sheets 242 including at least one of a ferromagnetic or nonmagnetic dopant and/or at least one phase stabilizer may be formed on a surface of at least one of the sheets 244 including at least one $Fe_{16}N_2$ phase domain, e.g., using a deposition process such as CVD, PVD, sputtering, or the like.

The sheets 244 including at least one $Fe_{16}N_2$ phase domain may be arranged so the <001> axes of the respective sheets 244 including at least one $Fe_{16}N_2$ phase domain are substantially aligned. In examples in which the <001> axes of the respective sheets 244 including at least one $Fe_{16}N_2$ phase domain are substantially parallel to a long axis of the respective one of the sheets 244 including at least one $Fe_{16}N_2$ phase domain, substantially aligning the sheets 244 including at least one $Fe_{16}N_2$ phase domain may include overlying one of the sheets 244 including at least one $Fe_{16}N_2$ phase domain on another of the sheets 244 including at least one $Fe_{16}N_2$ phase domain. Aligning the <001> axes of the respective sheets 244 including at least one $Fe_{16}N_2$ phase domain may provide uniaxial magnetic anisotropy to magnet material 246 (FIG. 19B).

The sheets 244 including at least $Fe_{16}N_2$ phase domain and the sheets 242 including at least one of a ferromagnetic or nonmagnetic dopant and/or at least one phase stabilizer may be bonded using one of a variety of processes. For example, the sheets 242 and 244 may be bonded using one of the techniques described above for joining workpieces including at least one $Fe_{16}N_2$ phase domain, such as alloying, compression shock, resin or adhesive bonding, or electromagnetic pulse bonding. In other examples, the sheets 242 and 244 may be sintered.

The sintering pressure, temperature and duration may be selected to mechanically join the sheets 242 and 244 while maintaining the crystal structure of the plurality of workpieces including at least one $Fe_{16}N_2$ phase domain (e.g., as including the $Fe_{16}N_2$ phase domains). Thus, in some examples, the sintering may be performed at a relatively low temperature. For example, the sintering temperature may be below about 250° C., such as between about 120° C. and about 250° C., between about 150° C. and about 250° C., between about 120° C. and about 200° C., between about 150° C. and about 200° C., or about 150° C. The sintering pressure may be between, for example, about 0.2 gigapascal (GPa) and about 10 GPa. The sintering time may be at least about 5 hours, such as at least about 20 hours, or between about 5 hours and about 100 hours, or between about 20 hours and about 100 hours, or about 40 hours. The sintering time, temperature, and pressure may be affected by the materials in the sheets 242 and 244. The sintering may be performed in an ambient atmosphere, a nitrogen atmosphere, a vacuum, or another inert atmosphere.

The disclosure has described various techniques for forming materials, powders, magnetic materials, and magnets including iron nitride. In some examples, various techniques described herein may be used together, in combinations described herein and in other combinations that will be apparent to those of ordinary skill in the art.

Clause 1: A method comprising milling, in a bin of a rolling mode milling apparatus, a stirring mode milling apparatus, or a vibration mode milling apparatus, an iron-containing raw material in the presence of a nitrogen source to generate a powder including iron nitride.

Clause 2: The method of clause 1, wherein the nitrogen source comprises at least one of an amide-containing or hydrazine-containing material.

Clause 3: The method of clause 2, wherein the at least one of the amide-containing or hydrazine-containing material comprises at least one of a liquid amide, a solution containing an amide, a hydrazine, or a solution containing hydrazine.

Clause 4: The method of clause 2, wherein the at least one of the amide-containing or hydrazine-containing material comprises at least one of methanamide, benzamide, or acetamide.

Clause 5: The method of any one of clauses 1 to 4, wherein the iron-containing raw material comprises substantially pure iron.

Clause 6: The method of any one of clauses 1 to 5, further comprising adding a catalyst to the iron-containing raw material.

Clause 7: The method of clause 6, wherein the catalyst comprises at least one of nickel or cobalt.

Clause 8: The method of any one of clauses 1 to 7, wherein the iron-containing raw material comprises a powder with an average diameter of less than about 100 μm.

Clause 9: The method of any of clauses 1 to 8, wherein the iron nitride comprises at least one of FeN, $Fe_2N$, $Fe_3N$, $Fe_4N$, $Fe_2N_6$, $Fe_8N$, $Fe_{16}N_2$, and $FeN_x$ wherein x is between about 0.05 and about 0.5.

Clause 10: The method of any one of clauses 1 to 9, further comprising milling an iron precursor to form the iron-containing raw material.

Clause 11: The method of clause 10, wherein the iron precursor comprises at least one of Fe, $FeCl_3$, $Fe_2O_3$, or $Fe_3O_4$.

Clause 12: The method of clause 10 or 11, wherein milling the iron precursor to form the iron-containing raw material comprises milling the iron precursor in the presence of at least one of Ca, Al, and Na under conditions sufficient to cause an oxidation reaction oxygen present in the iron precursor.

Clause 13: The method of any one of clauses 1 to 9, further comprising melting spinning an iron precursor to form the iron-containing raw material.

Clause 14: The method of clause 13, wherein melting spinning the iron precursor comprises: forming molten iron precursor; cold rolling the molten iron precursor to form a brittle ribbon of material; heat treating the brittle ribbon of material; and shattering the brittle ribbon of material to form the iron-containing raw material.

Clause 15: A method comprising: heating a mixture including iron and nitrogen to form a molten iron nitride-containing material; and continuously casting, quenching, and pressing the molten iron nitride-containing material to form a workpiece including at least one $Fe_8N$ phase domain.

Clause 16: The method of clause 15, wherein the mixture including iron and nitrogen is formed by the method of any of clauses 1 to 14.

Clause 17: The method of clause 15 or 16, wherein a dimension of the workpiece in at least one axis including at least one $Fe_8N$ phase domain is less than about 50 millimeters.

Clause 18: The method of any one of clauses 15 to 17, wherein the molten iron nitride-containing material includes an iron atom-to-nitrogen atom ratio of about 8:1.

Clause 19: The method of any one of clauses 15 to 18, wherein the molten iron-nitride containing material includes at least one ferromagnetic or nonmagnetic dopant.

Clause 20: The method of clause 19, wherein the at least one ferromagnetic or nonmagnetic dopant comprises at least one of Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, or Ta.

Clause 21: The method of clause 19 or 20, wherein the molten iron-nitride containing material comprises less than about 10 atomic percent of the at least one ferromagnetic or nonmagnetic dopant.

Clause 22: The method of any one of clauses 15 to 21, wherein the molten iron-nitride containing material further comprises at least one phase stabilizer.

Clause 23: The method of clause 22, wherein the at least one phase stabilizer comprises at least one of B, Al, C, Si, P, O, Co, Cr, Mn, or S.

Clause 24: The method of clause 22 or 23, wherein the molten iron-nitride containing material comprises between about 0.1 atomic percent and about 15 atomic percent of the at least one phase stabilizer.

Clause 25: The method of any one of clauses 15 to 24, wherein heating the mixture including iron and nitrogen to form the molten iron nitride-containing material comprises heating the mixture at a temperature greater than about 1500° C.

Clause 26: The method of any one of clauses 15 to 25, wherein continuously casting, quenching, and pressing the molten iron nitride-containing material comprises casting the molten iron nitride-containing material at a temperature between about 650° C. and about 1200° C.

Clause 27: The method of any one of clauses 15 to 26, wherein continuously casting, quenching, and pressing the molten iron nitride-containing material comprises quenching the iron nitride-containing material to a temperature above about 650° C.

Clause 28: The method of any one of clauses 15 to 27, wherein continuously casting, quenching, and pressing the molten iron nitride-containing material comprises pressing the iron nitride-containing material at a temperature below about 250° C. and a pressure between about 5 tons and about 50 tons.

Clause 29: The method of any one of clauses 15 to 28, further comprising straining and post-annealing the workpiece including at least one $Fe_8N$ phase domain to form a workpiece including at least one $Fe_{16}N_2$ phase domain.

Clause 30: The method of clause 29, wherein straining and post-annealing the workpiece including at least one $Fe_8N$ phase domain reduces the dimension of the workpiece.

Clause 31: The method of clause 30, wherein the dimension of the workpiece including at least one $Fe_{16}N_2$ phase domain in the at least one axis following straining and post-annealing is less than about 0.1 mm.

Clause 32: The method of any one of clauses 29 to 31, wherein, after straining and post-annealing, the workpiece consists of a single $Fe_{16}N_2$ phase domain.

Clause 33: The method of any one of clauses 29 to 32, wherein straining the workpiece including at least one $Fe_8N$ phase domain comprises exerting a tensile strain on the workpiece of between about 0.3% and about 12%.

Clause 34: The method of clause 33, wherein the tensile strain is applied in a direction substantially parallel to at least one <001> crystal axis in the workpiece including at least one $Fe_8N$ phase domain.

Clause 35: The method of any one of clauses 29 to 34, wherein post-annealing the workpiece including at least one $Fe_8N$ phase domain comprises heating the workpiece including at least one $Fe_8N$ phase domain to a temperature between about 100° C. and about 250° C.

Clause 36: The method of any one of clauses 15 to 35, further comprising forming the mixture including iron and nitrogen by exposing an iron-containing material to a urea diffusion process.

Clause 37: The method of any one of clauses 29 to 36, wherein the workpiece including at least one $Fe_{16}N_2$ phase domain is characterized as being magnetically anisotropic.

Clause 38: The method of clause 37, wherein the energy product, coercivity and saturation magnetization of the workpiece including at least one $Fe_{16}N_2$ phase domain are different at different orientations.

Clause 39: The method of any one of clauses 15 to 38, wherein the workpiece including at least one $Fe_8N$ phase domain comprises at least one of a fiber, a wire, a filament, a cable, a film, a thick film, a foil, a ribbon, and a sheet.

Clause 40: A rolling mode milling apparatus comprising a bin configured to contain an iron-containing raw material and a nitrogen source and mill the iron-containing raw material in the presence of the nitrogen source to generate a powder including iron nitride.

Clause 41: A vibration mode milling apparatus comprising a bin configured to contain an iron-containing raw material and a nitrogen source and mill the iron-containing raw material in the presence of the nitrogen source to generate a powder including iron nitride.

Clause 42: A stirring mode milling apparatus comprising a bin configured to contain an iron-containing raw material and a nitrogen source and mill the iron-containing raw material in the presence of the nitrogen source to generate a powder including iron nitride.

Clause 43: An apparatus configured to perform any one of the methods of clauses of 1 to 39.

Clause 44: A workpiece made according to the method of any one of clauses 15 to 39.

Clause 45. A bulk magnetic material comprising the workpiece formed by any one of clauses 29 to 35, 37, or 38.

Clause 46: A method comprising: disposing a plurality of workpieces including at least one $Fe_{16}N_2$ phase domain adjacent to each other with respective long axes of the plurality of workpieces being substantially parallel to each other; disposing at least one of Sn, Cu, Zn, or Ag on a surface of at least one workpiece of the plurality of workpieces including at least one $Fe_{16}N_2$ phase domain; and heating the plurality of workpieces including at least one $Fe_{16}N_2$ phase domain and the at least one of Sn, Cu, Zn, or Ag under pressure to form an alloy between Fe and the at least one of Sn, Cu, Zn, or Ag at the interfaces between adjacent workpieces of the plurality of workpieces including at least one $Fe_{16}N_2$ phase domain.

Clause 47: A method comprising: disposing a plurality of workpieces including at least one $Fe_{16}N_2$ phase domain adjacent to each other with respective long axes of the plurality of workpieces being substantially parallel to each other; disposing a resin about the plurality of workpieces including at least one $Fe_{16}N_2$ phase domain, wherein the resin includes a plurality particles of ferromagnetic material; and curing the resin to bond the plurality of workpieces including at least one $Fe_{16}N_2$ phase domain using the resin.

Clause 48: A method comprising: disposing a plurality of workpieces including at least one $Fe_{16}N_2$ phase domain adjacent to each other with respective long axes of the plurality of workpieces being substantially parallel to each other; disposing a plurality particles of ferromagnetic material about the plurality of workpieces including at least one $Fe_{16}N_2$ phase domain; and joining the plurality of workpieces including at least one $Fe_{16}N_2$ phase domain using a compression shock.

Clause 49: A method comprising: disposing a plurality of workpieces including at least one $Fe_{16}N_2$ phase domain adjacent to each other with respective long axes of the plurality of workpieces being substantially parallel to each other; disposing a plurality particles of ferromagnetic material about the plurality of workpieces including at least one $Fe_{16}N_2$ phase domain; and joining the plurality of workpieces including at least one $Fe_{16}N_2$ phase domain using an electromagnetic pulse.

Clause 50: The method of any one of clauses 46 to 49, wherein a workpiece of the plurality of workpiece comprises at least one of a fiber, a wire, a filament, a cable, a film, a thick film, a foil, a ribbon, and a sheet.

Clause 51: A bulk magnetic made according to the method of any one of clauses 46 to 50.

Clause 52: An apparatus configured to perform any one of the methods of clauses of 46 to 50.

Clause 53: A method comprising: mixing an iron nitride-containing material with substantially pure iron to form a mixture including an iron atom-to-nitrogen atom ratio of about 8:1; and forming a bulk magnetic material comprising at least one $Fe_{16}N_2$ phase domain from the mixture.

Clause 54: The method of clause 53, wherein the iron nitride-containing material comprises iron nitride-containing powder.

Clause 55: The method of clause 53 or 54, wherein the iron nitride-containing material includes one or more of $\epsilon$-$Fe_3N$, $\gamma'$-$Fe_4N$ and $\xi$-$Fe_2N$ phases.

Clause 56: The method of any one of clauses 53 to 55, wherein forming the bulk magnetic material including at least one $Fe_{16}N_2$ phase domain comprises: melting the mixture to create a molten mixture; continuously casting, quenching, and pressing the molten mixture to form a workpiece including at least one $Fe_8N$ phase domain; and straining and post-annealing the workpiece including at least one $Fe_8N$ phase domain to form the bulk magnetic material comprising the at least one $Fe_{16}N_2$ phase domain.

Clause 57: The method of any one of clauses 53 to 55, wherein forming the bulk magnetic material including at least one $Fe_{16}N_2$ phase domain comprises: melting the mixture to create a molten mixture; annealing the mixture in the presence of an applied magnetic field; and straining and post-annealing the workpiece including at least one $Fe_8N$ phase domain to form the bulk magnetic material comprising the at least one $Fe_{16}N_2$ phase domain.

Clause 58: The method of any one of clauses 53 to 55, wherein forming the bulk magnetic material including at least one $Fe_{16}N_2$ phase domain comprises: melting spinning the mixture; and straining and post-annealing the workpiece including at least one $Fe_8N$ phase domain to form the magnetic material comprising the at least one $Fe_{16}N_2$ phase domain.

Clause 59: The method of any one of clauses 56 to 58, further comprising sintering a plurality of bulk magnetic materials comprising at least one $Fe_{16}N_2$ phase domain.

Clause 60: A method comprising: adding at least one ferromagnetic or nonmagnetic dopant into an iron nitride-containing material; and forming a bulk magnetic material including at least one $Fe_{16}N_2$ phase domain from the iron-nitride containing material including the at least one ferromagnetic or nonmagnetic dopant.

Clause 61: The method of clause 60, wherein the at least one ferromagnetic or nonmagnetic dopant includes at least one of Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, or Ta.

Clause 62: The method of clause 60 or 61, wherein adding the at least one ferromagnetic or nonmagnetic dopant into the iron nitride-containing material comprises mixing the at least one ferromagnetic or nonmagnetic dopant with an iron nitride-containing powder.

Clause 63: The method of clause 60 or 61, wherein adding the at least one ferromagnetic or nonmagnetic dopant into the iron nitride-containing material comprises mixing the at least one ferromagnetic or nonmagnetic dopant with a molten iron nitride-containing material.

Clause 64: The method of clause 60 or 61, wherein adding the at least one ferromagnetic or nonmagnetic dopant into the iron nitride-containing material comprises: disposing a plurality of sheets including the iron nitride-containing material adjacent to each other with the at least one ferromagnetic or nonmagnetic dopant disposed between respective sheets of the plurality of sheets including the iron nitride-containing material; and joining the plurality of sheets of the iron nitride-containing material.

Clause 65: A method comprising: adding at least one phase stabilizer for bct phase domains into an iron nitride material; and forming a bulk magnetic material including at least one $Fe_{16}N_2$ phase domain from the iron-nitride containing material including the at least one phase stabilizer for bct phase domains.

Clause 66: The method of clause 65, wherein the least one phase stabilizer includes at least one of B, Al, C, Si, P, O, Co, Cr, Mn, or S.

Clause 67: The method of clause 65 or 66, wherein the at least one phase stabilizer is present in a concentration between about 0.1 atomic percent and about 15 atomic percent.

Clause 68: The method of any of clauses 65 to 67, wherein adding the at least one phase stabilizer for bct phase domains into the iron nitride-containing material comprises mixing the at least one phase stabilizer for bct phase domains with an iron nitride-containing powder.

Clause 69: The method of any one of clauses 65 to 67, wherein adding the at least one phase stabilizer for bct phase domains into the iron nitride-containing material comprises mixing the at least one phase stabilizer for bct phase domains with a molten iron nitride-containing material.

Clause 70: The method of any one of clauses 65 to 67, wherein adding the at least one phase stabilizer for bct phase domains into the iron nitride-containing material comprises: disposing a plurality of sheets including the iron nitride-containing material adjacent to each other with the at least one phase stabilizer for bct phase domains disposed between respective sheets of the plurality of sheets including the iron nitride-containing material; and joining the plurality of sheets of the iron nitride-containing material.

Clause 71: The method of any one of clauses 53 to 70, wherein the bulk magnetic material comprising at least one $Fe_{16}N_2$ phase domain is characterized as being magnetically anisotropic.

Clause 72: The method of clause 71, wherein the energy product, coercivity and saturation magnetization of the magnetic material comprising at least one $Fe_{16}N_2$ phase domain are different at different orientations.

Clause 73: An apparatus configured to perform any one of the methods of clauses of 53 to 72.

Clause 74: A magnetic material comprising at least one $Fe_{16}N_2$ phase domain made according to the method of any one of clauses 53 to 72.

Clause 75: A bulk permanent magnet made according to the method of any one of clauses 53 to 72.

Clause 76: A workpiece comprising at least one of a fiber, a wire, a filament, a cable, a film, a thick film, a foil, a ribbon, or a sheet, wherein the workpiece is characterized as having a long direction, and wherein the workpiece comprises at least one iron nitride phase domain oriented along the long direction of the workpiece. In some examples, the workpiece may be formed using any one of the techniques described herein. Additionally, in some examples, any of the precursor materials, including iron or iron nitride powders, may be used to form the workpiece.

Clause 77: The workpiece of clause 76, wherein the at least one iron nitride phase domain comprises one or more of the following phases: FeN, $Fe_2N$, $Fe_3N$, $Fe_4N$, $Fe_2N_6$, $Fe_8N$, $Fe_{16}N_2$, and $FeN_x$, and wherein x is in the range of from about 0.05 to about 0.5.

Clause 78: The workpiece of clause 76 or 77, wherein the workpiece comprises one or more dopants, one or more phase stabilizers, or both.

Clause 79: The workpiece of clause 78, wherein the one or more dopants, the one or more phase stabilizers, or both, are present in the range of from 0.1 at. % to 15 at. %, based on at. % of the at least one iron nitride phase domain.

Clause 80: The workpiece of any one of clauses 76 to 79, wherein the workpiece is characterized as being a bulk permanent magnet.

Clause 81: A bulk permanent magnet comprising iron nitride, wherein the bulk permanent magnet is characterized as having a major axis extending from a first end of the bulk permanent magnet to a second end of the bulk permanent magnet, wherein the bulk permanent magnet comprises at least one body centered tetragonal (bct) iron nitride crystal, and wherein a <001> axis of the at least one bct iron nitride crystal is substantially parallel to the major axis of the bulk permanent magnet. In some examples, the bulk permanent magnet may be formed using any one of the techniques described herein. Additionally, in some examples, any of the precursor materials, including iron or iron nitride powders, may be used to form the bulk permanent magnet.

EXAMPLES

Example 1

Figure 20:
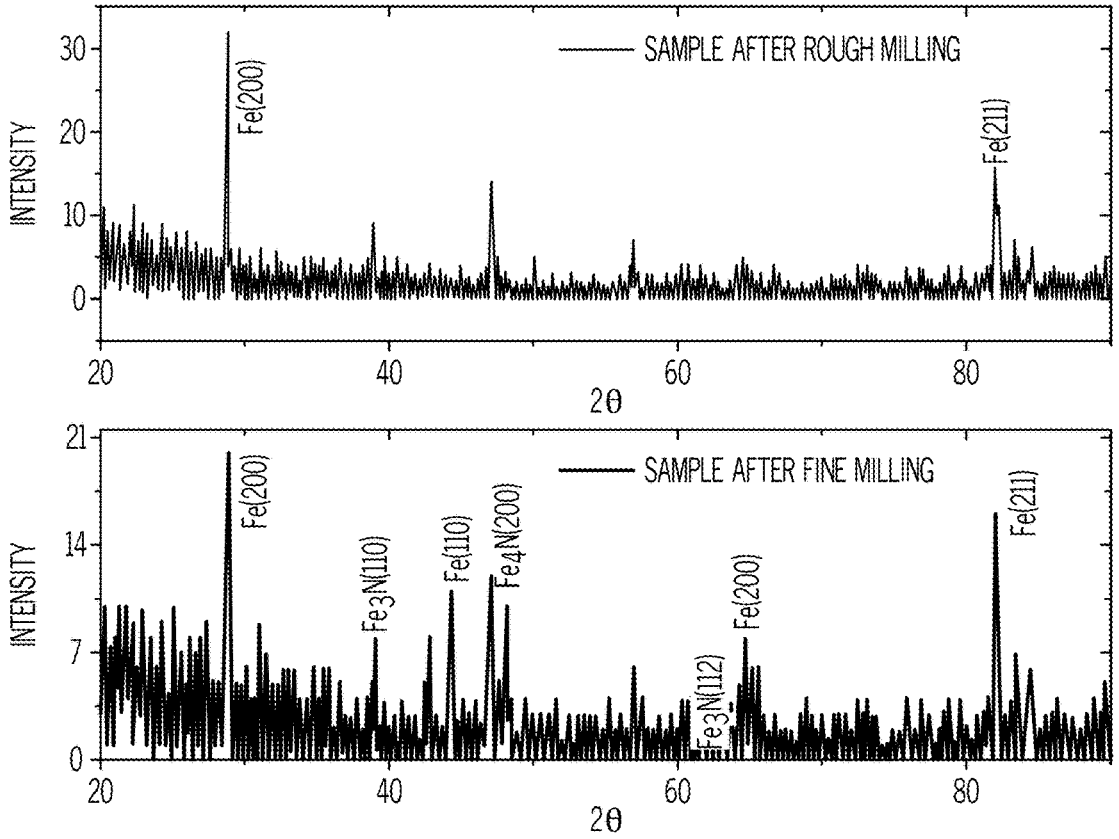
FIG. 20 illustrates example XRD spectra for a sample prepared by first milling an iron precursor material to form an iron-containing raw material, then milling the iron-containing raw material in a formamide solution.

FIG. 20 illustrates example XRD spectra for a sample prepared by first milling an iron precursor material to form an iron-containing raw material, then milling the iron-containing raw material in a formamide solution. During the milling of the iron precursor material, the ball milling apparatus was filled with a gas including 90% nitrogen and 10% hydrogen. Milling balls with a diameter of between about 5 mm and about 20 mm were used to mill, and the ball-to-powder mass ratio was about 20:1. During the milling of the iron-containing raw material, the ball milling apparatus was filled with the formamide solution. Milling balls with a diameter of between about 5 mm and about 20 mm were used to mill, and the ball-to-powder mass ratio was about 20:1. As shown in the upper XRD spectrum shown in FIG. 20, after milling the iron precursor material, an iron-containing raw material was formed that included Fe(200) and Fe(211) crystal phases. The XRD spectrum was collected using a D5005 x-ray diffractometer available from Siemens USA, Washington, D.C. As shown in the lower XRD spectrum illustrated in FIG. 20, a powder containing iron nitride was formed after milling the iron-containing raw material in the formamide solution. The powder containing iron nitride included Fe(200), $Fe_3N$(110), Fe(110), $Fe_4N$ (200), $Fe_3N$(112), Fe, (200), and Fe(211) crystal phases.

Example 2

Figure 21:
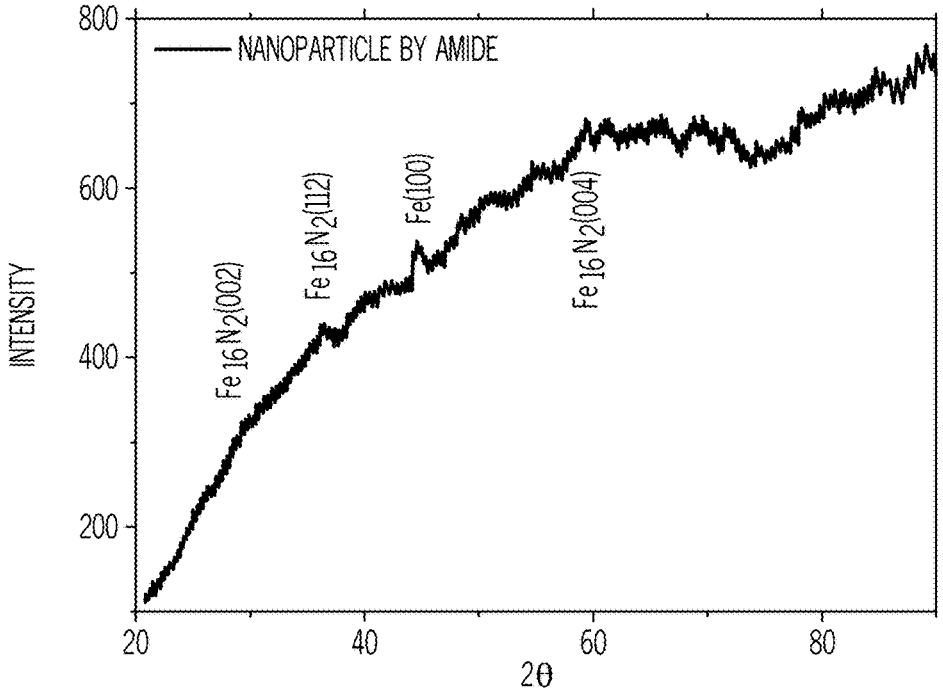
FIG. 21 illustrates an example XRD spectrum for a sample prepared by milling an iron-containing raw material in an acetamide solution.

FIG. 21 illustrates an example XRD spectrum for a sample prepared by milling an iron-containing raw material in an acetamide solution. During the milling of the iron precursor material, the ball milling apparatus was filled with a gas including 90% nitrogen and 10% hydrogen. Milling balls with a diameter of between about 5 mm and about 20 mm were used to mill, and the ball-to-powder mass ratio was about 20:1. During the milling of the iron-containing raw material, the ball milling apparatus was filled with the acetamide solution. Milling balls with a diameter of between about 5 mm and about 20 mm were used to mill, and the ball-to-powder mass ratio was about 20:1. The XRD spectrum was collected using a D5005 x-ray diffractometer available from Siemens USA, Washington, D.C. As shown in the XRD spectrum illustrated in FIG. 21, a powder containing iron nitride was formed after milling the iron-containing raw material in the acetamide solution. The powder containing iron nitride included $Fe_{16}N_2$(002), $Fe_{16}N_2$(112), Fe(100), $Fe_{16}N_2$(004) crystal phases.

Example 3

Figure 22:
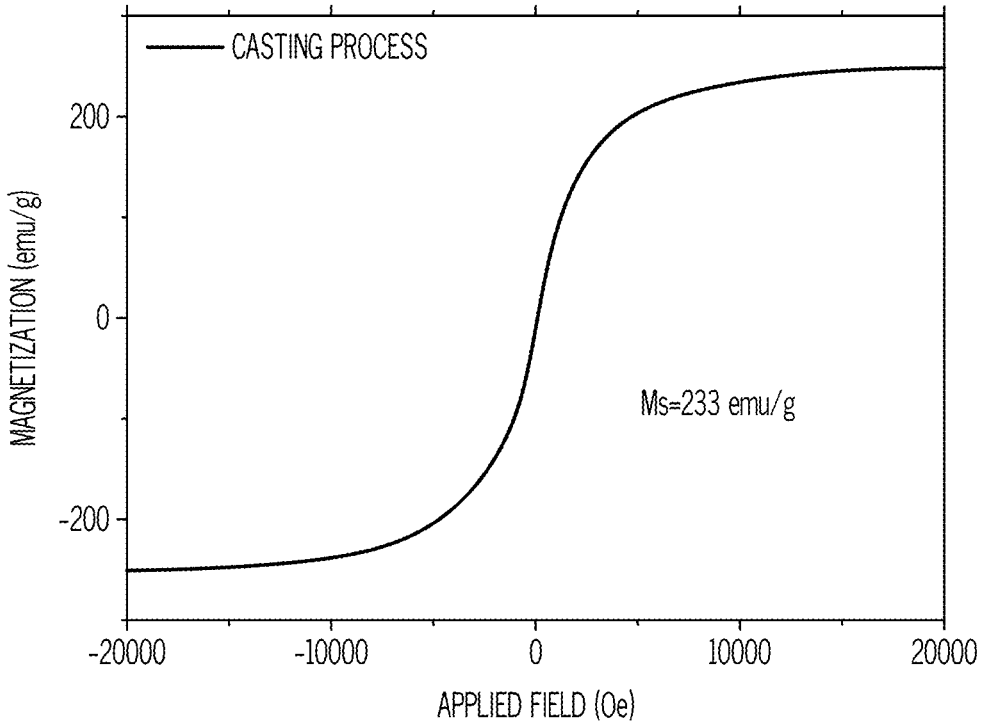
FIG. 22 is a diagram of magnetization versus applied magnetic field for an example magnetic material including $Fe_{16}N_2$ prepared by a continuous casting, quenching, and pressing technique.

FIG. 22 is a diagram of magnetization versus applied magnetic field for an example magnetic material including $Fe_{16}N_2$ prepared by a continuous casting, quenching, and pressing technique. First, an iron-nitrogen mixture including an iron-to-nitrogen atomic ratio of about 9:1 was formed by milling an iron powder in the presence of an amide. The average iron particle size in was about 50 nm±5 nm, as measured using scanning electron microscopy. The milling was performed at a temperature of about 45° C. for about 50 hours with a nickel catalyst in the mixture. The weight ratio nickel to iron was about 1:5. The iron-to-nitrogen atomic ratio was measured using Auger Electron Spectroscopy (AES).

The iron nitride powder was then placed in a glass tube and heated using a torch. The torch used a mixture of natural gas and oxygen as a fuel and heated at a temperature of about 2300° C. to melt the iron nitride powder. The glass tube was then tiled and the molten iron nitride cooled to room temperature to cast the iron nitride. The magnetization curve was measured using a superconducting susceptometer (a Superconducting Quantum Interference Device (SQUID)) available under the trade designation MPMS®-5S from Quantum Design, Inc., San Diego, Calif. As shown in FIG. 22, the saturation magnetization (Ms) value for the sample was about 233 emu/g.

Example 4

Figure 23:
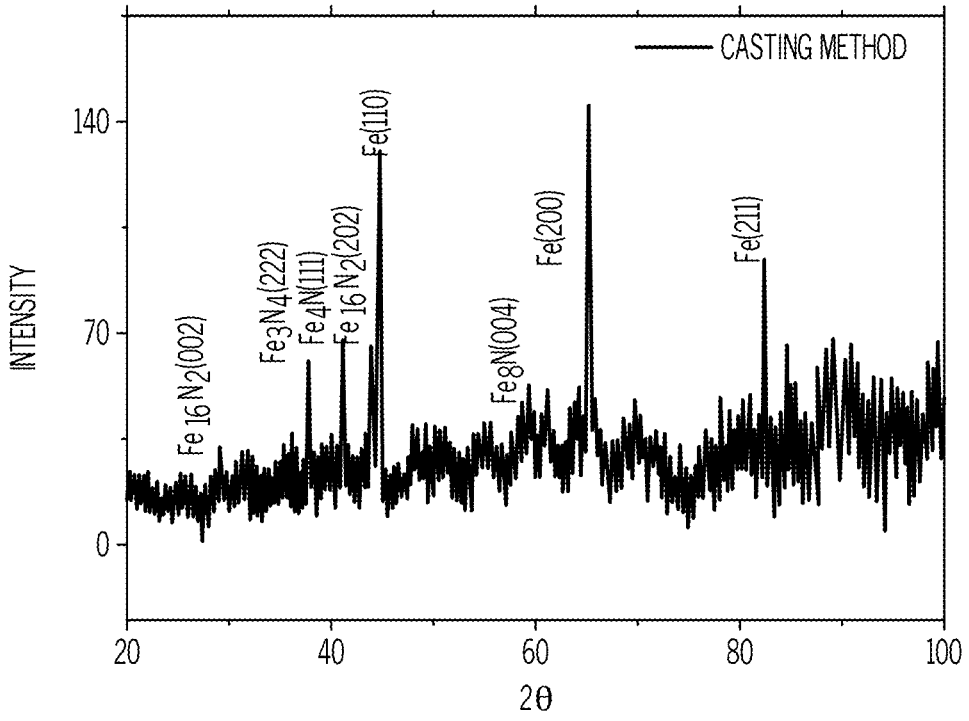
FIG. 23 is a an X-ray Diffraction spectrum of an example wire including at least one $Fe_{16}N_2$ phase domain prepared by a continuous casting, quenching, and pressing technique.

FIG. 23 is a an X-ray Diffraction spectrum of an example wire including at least one $Fe_{16}N_2$ phase domain prepared by a continuous casting, quenching, and pressing technique. The sample included $Fe_{16}N_2$(002), $Fe_3O_4$(222), $Fe_4N$(111), $Fe_{16}N_2$(202), Fe(110), $Fe_8N$(004), Fe(200), and Fe(211) phase domains. Table 2 illustrates the volume ratios of the different phase domains.

TABLE 2

| Phase | Volume ratio |
|---|---|
| Fe | 48% |
| $Fe_{16}N_2$ + $Fe_8N$ | 35% |
| $Fe_4N$ | 11% |
| $Fe_3O_4$ | 6% |

Example 5

Figure 24:
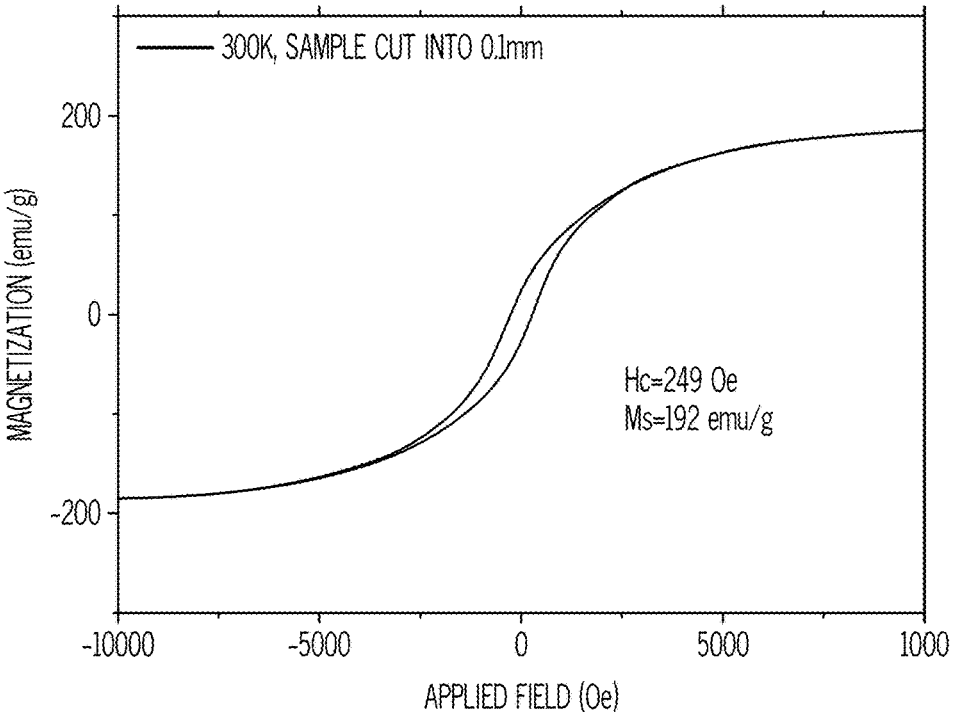
FIG. 24 is a diagram of magnetization versus applied magnetic field for an example magnetic material including $Fe_{16}N_2$ prepared by the continuous casting, quenching, and pressing technique, followed by straining and post-annealing.

An FeN bulk sample prepared by a continuous casting, quenching, and pressing technique described in Example 3 was cut into wires with a diameter of about 0.8 mm and a length of about 10 mm. A wire was strained along the long axis of the wire with a force of about 350 N and post-annealed at a temperature between about 120° C. and about 160° C. while being strained to form at least one $Fe_{16}N_2$ phase domain within the wire. FIG. 24 is a diagram of magnetization versus applied magnetic field for the wire, measured using a superconducting susceptometer (a Superconducting Quantum Interference Device (SQUID)) available under the trade designation MPMS®-5S from Quantum Design, Inc., San Diego, Calif. As shown in FIG. 24, the sample had a coercivity of about 249 Oe and a saturation magnetization of about 192 emu/g.

Figure 25:
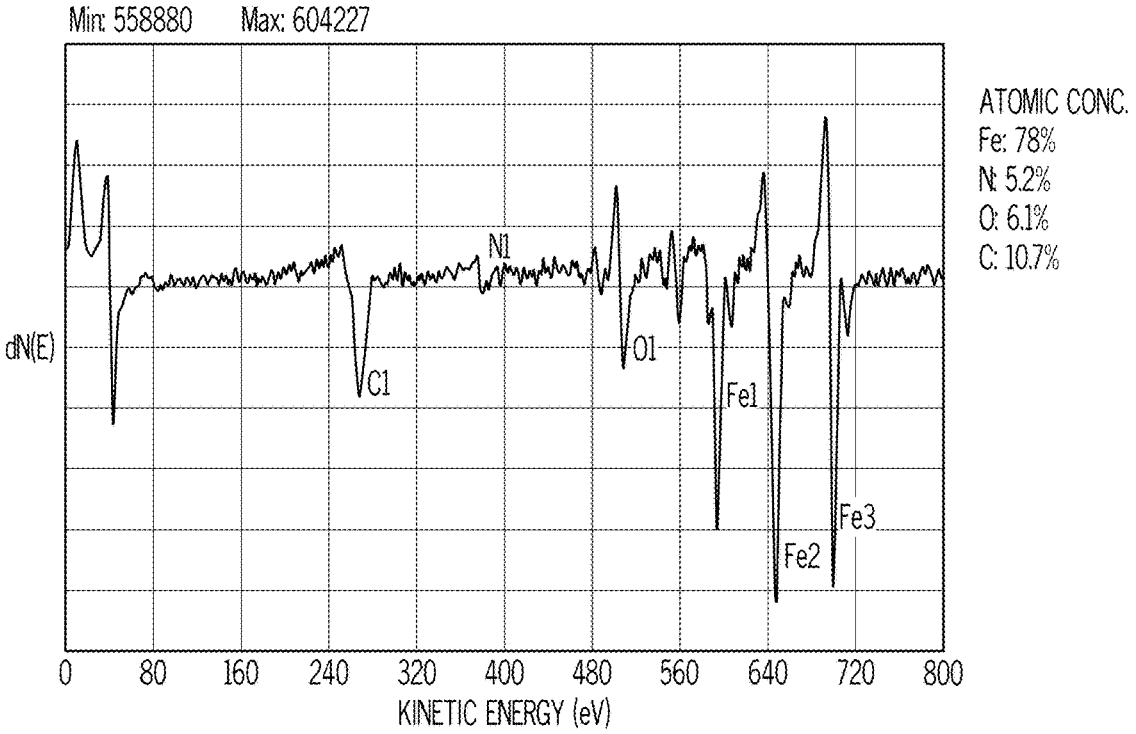
FIG. 25 is a diagram illustrating auger electron spectrum (AES) testing results for the sample magnetic material including $Fe_{16}N_2$ prepared by the continuous casting, quenching, and pressing technique, followed by straining and post-annealing.

FIG. 25 is a diagram illustrating auger electron spectrum (AES) testing results for the sample. The composition of the sample was about 78 at. % Fe, about 5.2 at. % N, about 6.1 at. % O, and about 10.7 at. % C.

Figure 26A:
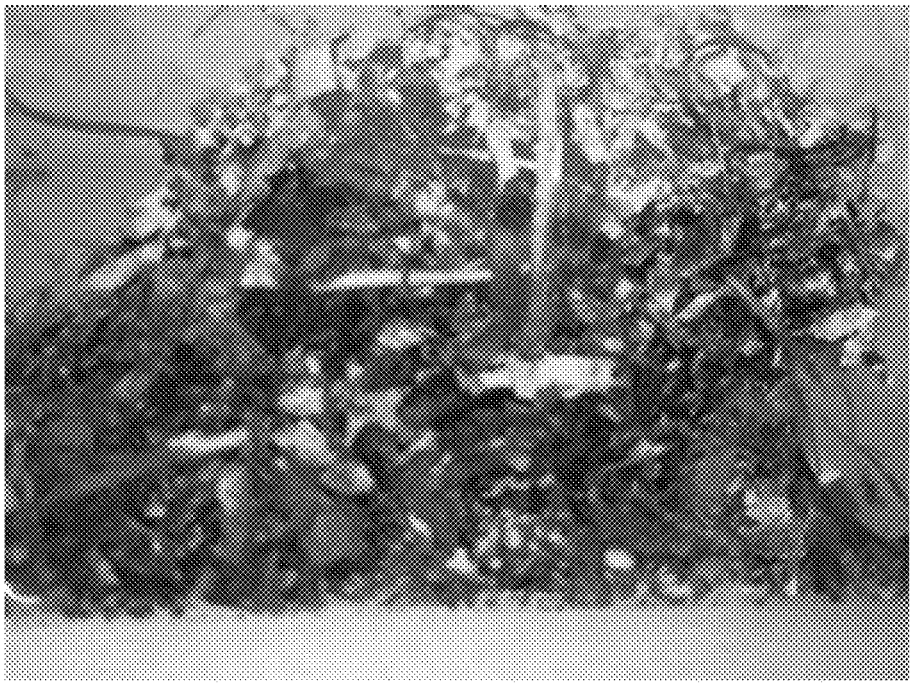
FIGS. 26A and 26B are images showing examples of iron nitride foil and iron nitride bulk material formed in accordance with the techniques described herein.
Figure 26B:
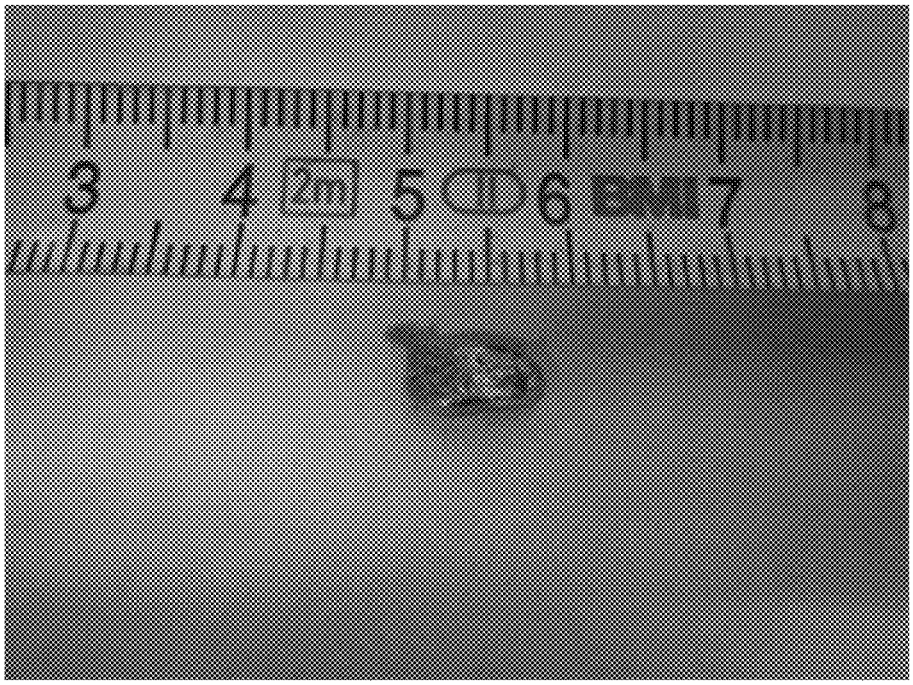

FIGS. 26A and 26B are images showing examples of iron nitride foil and iron nitride bulk material forming using the continuous casting, quenching, and pressing technique described in Examples 3 and 5.

Example 6

Figure 27:
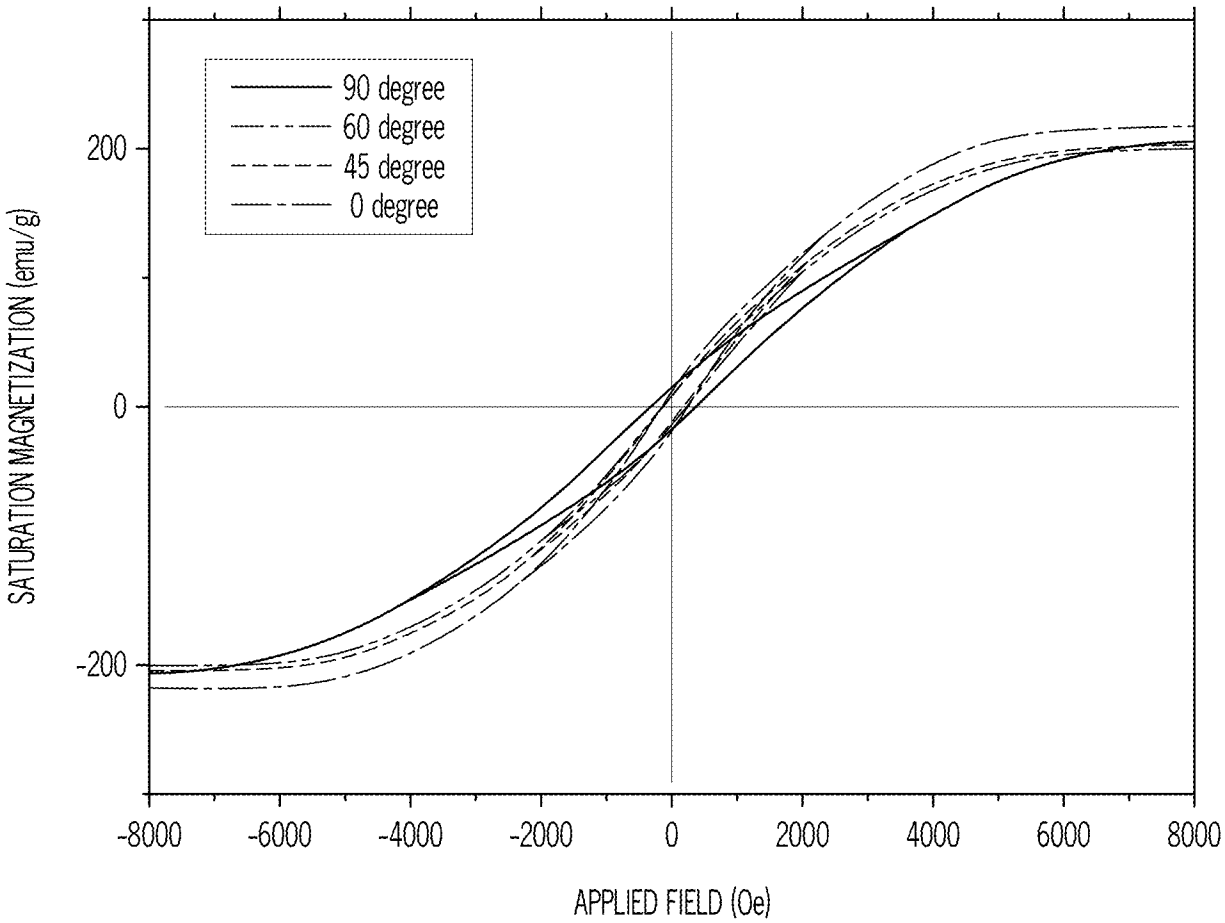
FIG. 27 is a diagram of magnetization versus applied magnetic field for an example wire-shaped magnetic material including $Fe_{16}N_2$, showing different hysteresis loops for different orientations of external magnetic fields relative to the sample.

FIG. 27 is a diagram of magnetization versus applied magnetic field for an example of a wire-shaped magnetic material including $Fe_{16}N_2$, showing different hysteresis loops for different orientations of external magnetic fields relative to the long axis of the wire-shaped sample. The sample was prepared using a strained wire technique with a cold crucible system. The $\alpha''$-$Fe_{16}N_2$ bulk permanent magnet was prepared from commercially available bulk iron of high purity (99.99%). Urea was used as the nitrogen provider in the cold crucible system. First, bulk iron was melted in the cold crucible system with a predetermined percentage of urea. Urea was chemically decomposed to generate nitrogen atoms, which could diffuse into the melted iron. The prepared FeN mixture was taken out and heated to about 660° C. for about 4 hours, then quenched using water at room temperature. The quenched sample was flattened and cut into wires, with a square column shape, about 10 mm in length and 0.3-0.4 mm in square side length. Finally, the wire was strained in the length direction to induce lattice elongation along the length direction, and the wire was annealed at about 150° C. for 40 about hours.

The wire-shaped sample was placed inside a vibrating sample magnetomer at different orientations with respect to the external magnetic field, varied from 0° to 90°. The results show different hysteresis loops for different orientations of the sample relative to the external magnetic field. The results also demonstrate experimentally that the FeN magnet sample has anisotropic magnetic properties.

Figure 28:
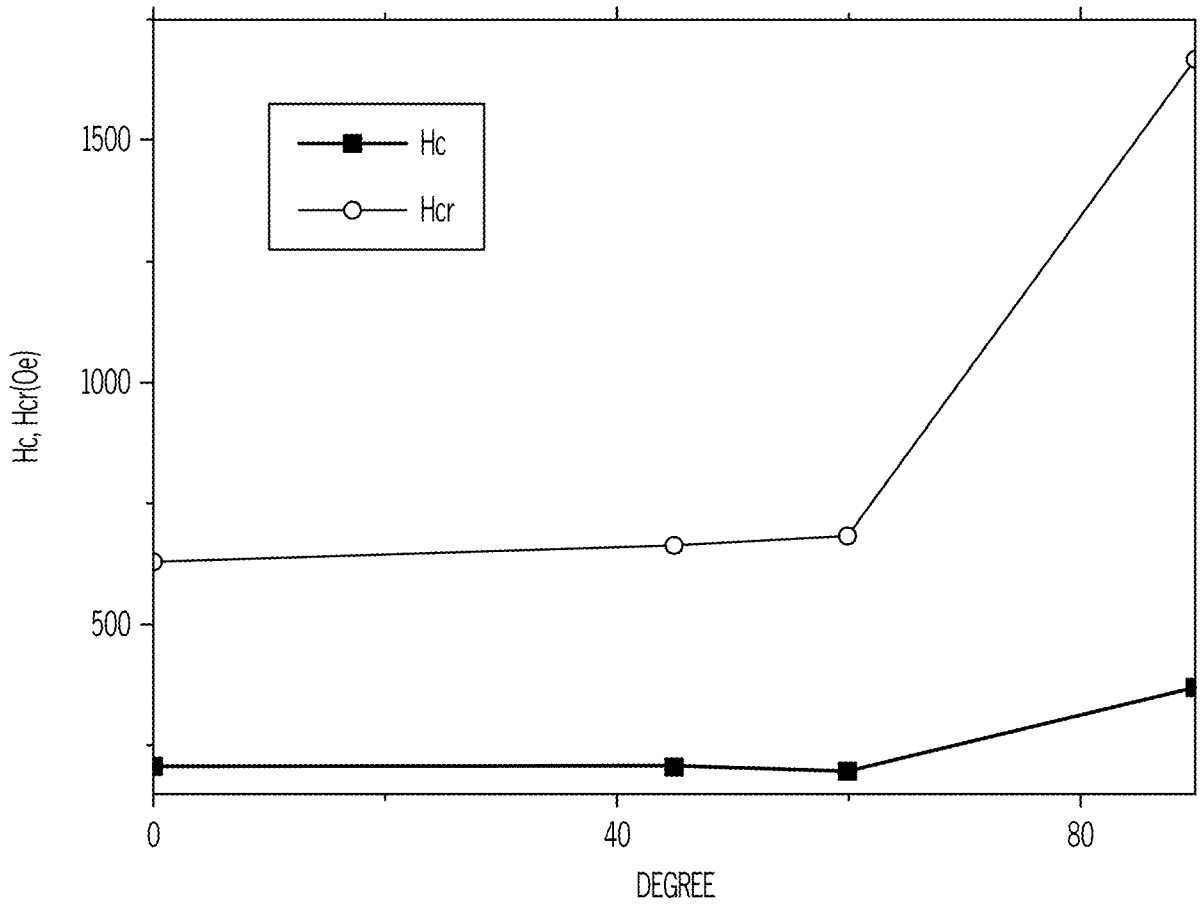
FIG. 28 is a diagram illustrating the relationship between the coercivity of an example wire-shaped FeN magnet and its orientation relative to an external magnetic field.

FIG. 28 is a diagram illustrating the relationship between the coercivity of a wire-shaped FeN magnet prepared using the cold crucible technique described with respect to FIG. 27 and its orientation relative to an external magnetic field. The angle between the long axis of the wire-shaped sample and the external magnetic field was varied changed between 0°, 45°, 60°, and 90°. When the long axis of the wire-shaped sample was substantially perpendicular to the magnetic field, the sample's coercivity increased abruptly, demonstrating the sample's anisotropic magnetic properties.

Example 7

Table 3 illustrates a comparison between theoretical and experimental values of magnetic properties in $Fe_{16}N_2$ containing iron nitride permanent magnets formed by different methods. The "Cold Crucible" magnet was formed by a technique similar to those described in International Patent Application No. PCT/US2012/051382, filed on Aug. 17, 2012, and entitled "IRON NITRIDE PERMANENT MAGNET AND TECHNIQUE FOR FORMING IRON NITRIDE PERMANENT MAGNET," and described with respect to Example 6.

The "Nitrogen Ion Implantation" magnet was formed by a technique similar to those described in U.S. Provisional Patent Application No. 61/762,147, filed Feb. 7, 2013, and entitled, "IRON NITRIDE PERMANENT MAGNET AND TECHNIQUE FOR FORMING IRON NITRIDE PERMANENT MAGNET." In particular, pure (110) iron foils with about 500 nm thickness were positioned on a mirror-polished (111) Si substrate. The surfaces of the (111) Si substrate and the iron foil were cleaned beforehand. The foil was directly bonded with the substrate by using a wafer bonder in fusion mode (SB6, Karl Suss Wafer Bonder) at about 450° C. for about 30 minutes. Nitrogen ion implantation was conducted using ions of atomic N+ accelerated to 100 keV and implanted into these foils vertically with fluences ranging from $2\times10^{16}/cm^2$ to $5\times10^{17}/cm^2$ at room temperature. After that, a two-step post-annealing process is applied on the implanted foils. The first step is pre-annealing at about 500° C. in an $N_2$ and Ar mixed atmosphere for about 0.5 hour. Then, a subsequent post-annealing followed at about 150° C. for about 40 hours in vacuum.

The "Continuous Casting" magnet was formed by a technique similar to that described above with respect to Example 3.

TABLE 3

| | Coercivity (Oe) | Saturation Magnetization (emu/g) | Energy Product (MGOe) |
|---|---|---|---|
| Theoretical | 17,500 | 316 | 135 |
| Cold Crucible (Experimental) | 1,480 | 202 | 7.2 |
| Nitrogen Ion Implantation (Experimental) | 1,200 | 232 | 20 |
| Continuous Casting (Experimental) | 400 | 250 | 2.5 |
| Continuous Casting (Predicted) | 2,000 | 250 | 15 |
| Attained Degree (Maximum) | 8.5% | 63% | 8% |

Example 8

In this example, use of Manganese (Mn) as a dopant atom in an $Fe_{16}N_2$ iron nitride bulk sample was investigated. Density functional theory (DFT) calculations were used to determine the likely positions of Mn atoms within the $Fe_{16}N_2$ iron nitride crystalline lattice and the magnetic coupling between the Mn atoms and Fe atoms in the $Fe_{16}N_2$ crystalline lattice. The thermal stability and magnetic properties of $Fe_{16}N_2$ iron nitride doped with Mn atoms were also experimentally observed. All DFT calculations were performed using the Quantum Espresso software package, available from www.quantum-espresso.org. Information regarding Quantum Espresso may be found in P. Gianozzi et al. J. Phys.: Condens. Matter, 21, 395502 (2009) http://dx.doi.org/10.1088/0953-8984/21/39/395502.

Figure 29:
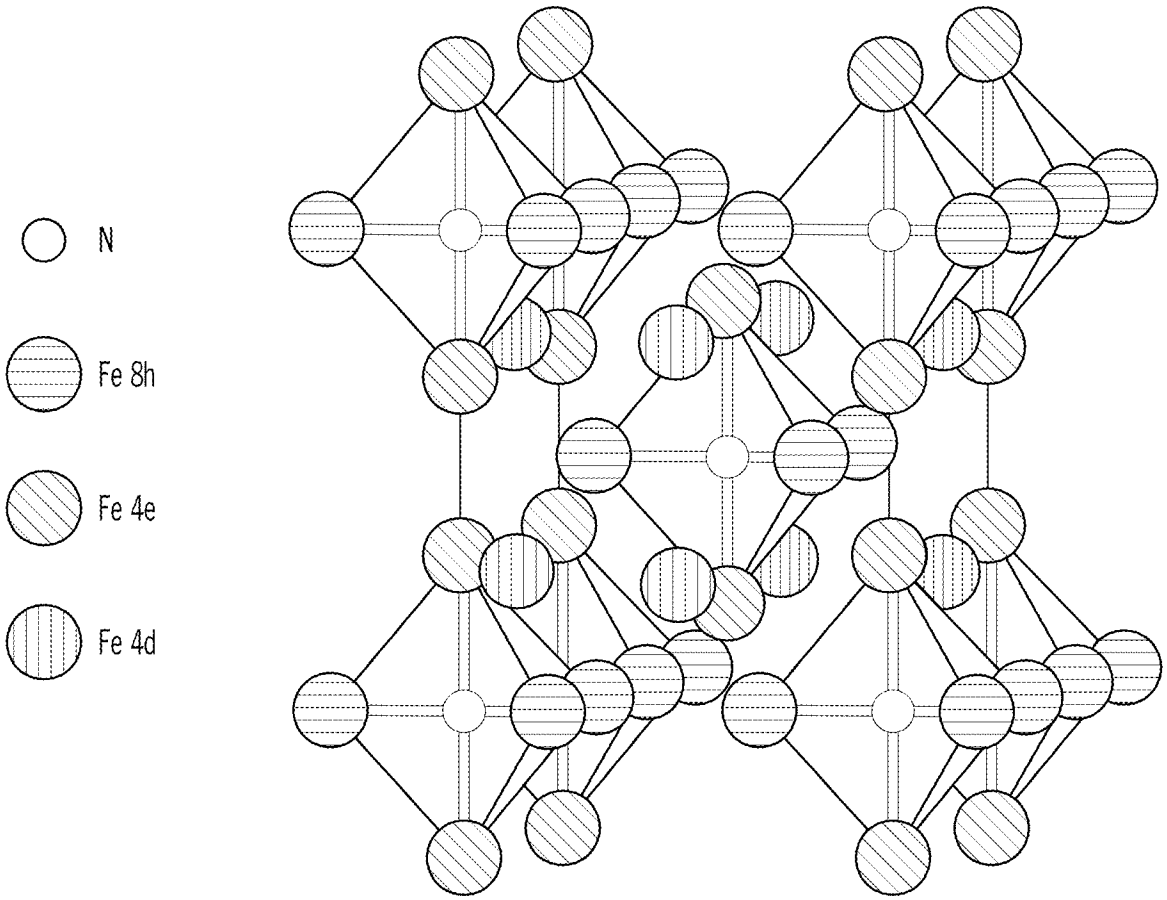
FIG. 29 is a conceptual diagram illustrating an example $Fe_{16}N_2$ crystallographic structure.

In the DFT calculations, Mn was inserted into the tetragonal unit cell of the $\alpha''$-$Fe_{16}N_2$ phase, replacing one of the Fe atoms. As seen from the periodic table, Mn is similar to Fe and was predicted to show affinity with the host $Fe_{16}N_2$ structure and possible contribute to magnetic properties of the material. Mn may be inserted at one or more of three different crystallographic positions of Fe. FIG. 29 is a conceptual diagram illustrating an example $Fe_{16}N_2$ crystallographic structure. As shown in Fe atoms exist at three different distances from N atoms, Fe 8h, Fe 4e, and Fe 4d. Fe 8h iron atoms are closest to N atoms, Fe 4d iron atoms are furthest from N atoms, and Fe 4e iron atoms are a middle distance from N atoms. The effects of Mn insertion at each of these crystallographic positions were investigated using DFT calculations. In particular, three DFT calculations were used to estimate the respective total energy of the system for an Mn atom inserted at each of the three crystallographic positions. DFT calculations were also used to estimate the results of doping bulk iron with Mn atoms. The results of these calculations were then compared to assess the role of N atoms in determining the position and the magnetization of the Mn dopant atoms and to evaluate the thermodynamic stability of the doped systems.

Figure 30:
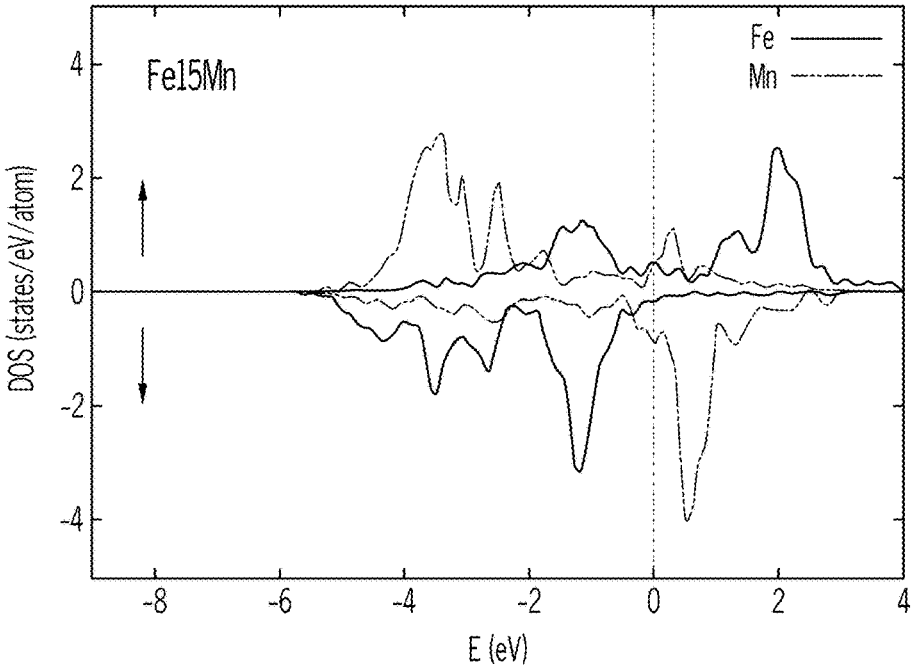
FIG. 30 is a plot illustrating results of an example calculation of densities of states of Mn doped bulk Fe.

In bulk Fe, Mn dopants or impurities couple anti-ferromagnetically to Fe atoms. FIG. 30 is a plot illustrating results of an example calculation of densities of states of Mn doped bulk Fe. The calculation was made using Quantum Espresso. As shown in FIG. 30, Mn dopants are more likely to be found in the $Fe_1$ (Fe 8h) site in bulk iron. Additionally, FIG. 30 shows that the density of states of Fe is always reverse to the density of states of Mn. At positive density of states of Fe, Mn density of states are negative, indicating that Mn atoms are antiferromagnetically coupled to Fe atoms in the bulk Fe sample.

Figure 31:
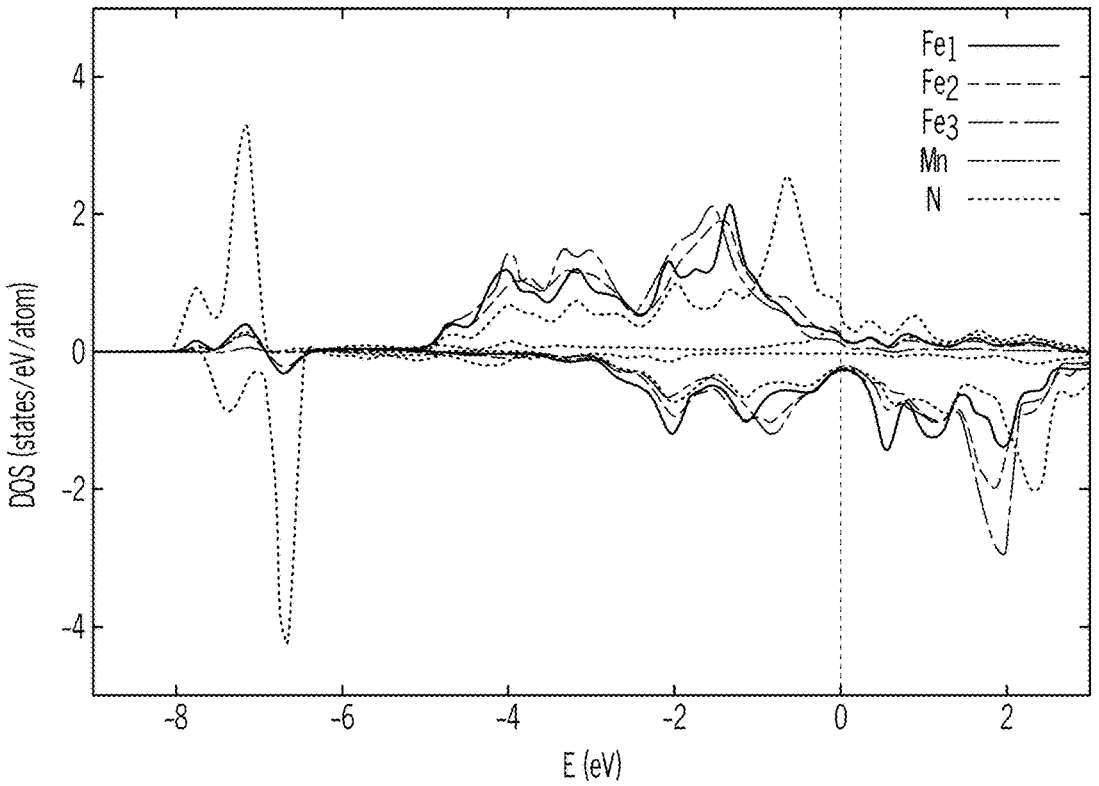
FIG. 31 is a plot illustrating results of an example calculation of densities of states of Mn doped bulk $Fe_{16}N_2$.

FIG. 31 is a plot illustrating results of an example calculation of densities of states of Mn doped bulk $Fe_{16}N_2$. The calculation was made using Quantum Espresso. As shown in FIG. 31, Mn dopants are not anti-ferromagnetically coupled to the rest of the Fe atoms in the $Fe_{16}N_2$ bulk sample, as the density of states of Mn is always the same sign as the density of states of Fe. Because the density of states of Mn are generally closest to the density of states of $Fe_1$ (Fe 8h) at the same energy in FIG. 31, FIG. 31 indicates that the Mn dopants are more likely to be found in the $Fe_1$ (Fe 8h) site in $Fe_{16}N_2$. This suggests that N atoms have a non-trivial effect on the inter-site magnetic couplings.

Figure 32:
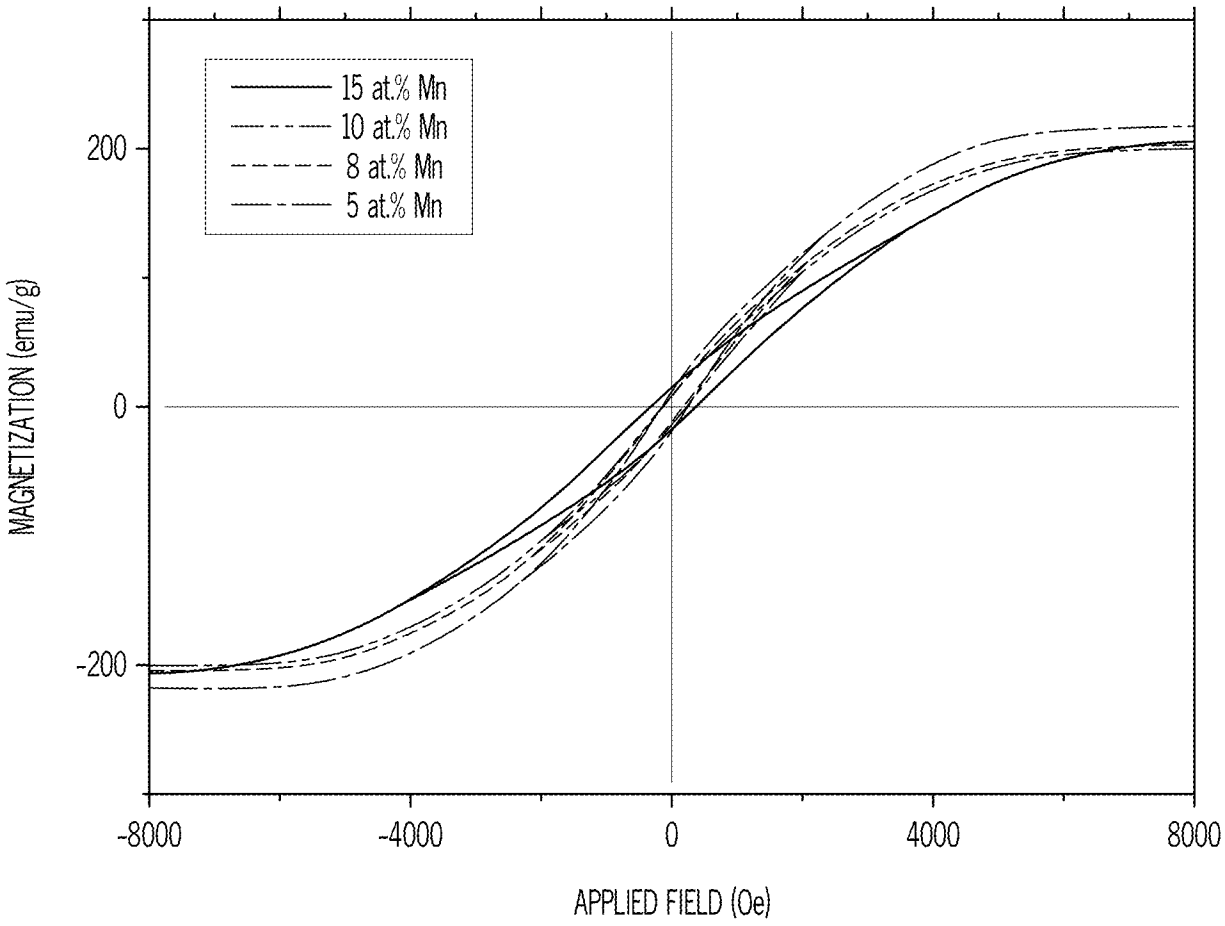
FIG. 32 is a plot of magnetic hysteresis loops of prepared Fe—Mn—N bulk samples with concentrations of Mn dopant of 5 at. %, 8 at. %, 10 at. %, and 15 at. %.

FIG. 32 is a plot of magnetic hysteresis loops of prepared Fe—Mn—N bulk samples with concentrations of Mn dopant of 5 at. %, 8 at. %, 10 at. %, and 15 at. %. The samples were prepared using a cold crucible system. Four mixtures including Fe, Mn, and urea precursors with Mn concentrations (based on Fe and Mn atoms) of 5 at %, 8 at. %, 10 at. %, and 15 at. %, respectively, were each placed into a cold crucible a melted to form respective mixtures of FeMnN. The respective mixtures of FeMnN were heated at 650° C. for about 4 hours and quenched at room temperature in cold water. The quenched FeMnN materials were then cut into wires with dimensons of about 1 mm by 1 mm by 8 mm. The wires were then heated at about 180° C. for about 20 hours and strained to form $Fe_{16}N_2$ phase domains including Mn dopant (replacing some Fe atoms). FIG. 32 shows that the saturation magnetization ($M_s$) decreases with increasing Mn dopant concentrations. However, the magnetic coercivity ($H_c$) increases with increasing Mn dopant concentrations. This indicates that Mn doping of $Fe_{16}N_2$ can increase the magnetic coercivity. The value of magnetic coercivity for samples with a concentration of Mn between 5 at. % and 15 at. % is larger than that of the sample without Mn dopant.

The thermal stability of Mn-doped $Fe_{16}N_2$ bulk material was investigated by observing its crystalline structure at elevated temperatures. Samples with Mn dopants showed an improved thermal stability compared to samples without Mn dopants. An FeN bulk sample without Mn dopant may show changes in phase volume ratios (e.g., $Fe_{16}N_2$ phase volume fraction), observed by changes in relative intensities of corresponding peaks in an x-ray diffraction spectra, at a temperature of about 160° C. The changes in phase volume ratios may indicate decreased stability of $Fe_{16}N_2$ phases at this temperature. However, the samples with Mn dopant concentrations between 5 at. % and 15 at. % demonstrated substantially stable phase volume ratios (e.g., $Fe_{16}N_2$ phase volume fraction), observed by changes in relative intensities of corresponding peaks in an x-ray diffraction spectra, at 180° C. for about 4 hours in an air atmosphere. In some examples, a temperature of about 220° C. may lead to completely decomposition of $Fe_{16}N_2$ phase.

Example 9

A ball milling system available under the trade designation Retsch® Planetary Ball Mill PM 100 (Retsch®, Haan, Germany) was used will steel balls to mill Fe with an ammonium nitrate ($NH_4NO_3$) nitrogen source in a 1:1 weight ratio. For each sample, 10 steel balls, each having a diameter of about 5 mm, were used. Each time 10 hours of milling was complete, the milling systems was stopped for 10 minutes to allow the system to cool. Table 4 summarizes the processing parameters for each of the samples:

TABLE 4

| | Sample 1 | Sample 2 | Sample 3 | Sample 4 |
|---|---|---|---|---|
| Milling RPM | 650 | 600 | 650 | 600 |
| Milling Time (hours) | 60 | 90 | 90 | 60 |
| Annealing Temperature (° C.) | 180 | 180 | 200 | 180 |
| Annealing Time (hours) | 20 | 20 | 20 | 20 |
| Coercivity (Oe) | 540 | 380 | 276 | 327 |
| Saturation Magnetization (emu/g) | 209 | 186 | 212 | 198 |

Figure 33:
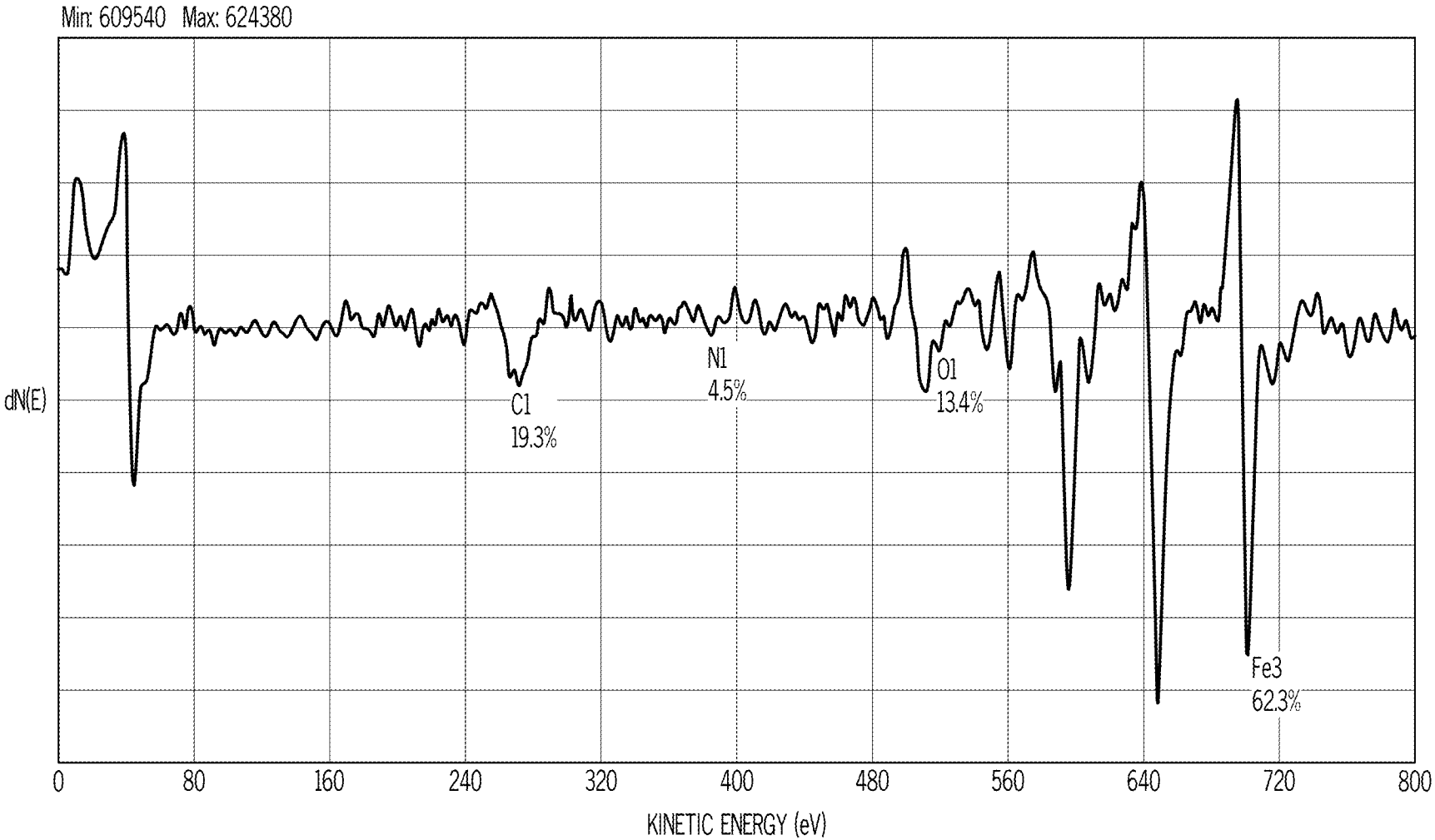
FIG. 33 is a plot of elemental concentration of the powder of Sample 1 after ball milling in the presence of a urea nitrogen source, collected using Auger electron spectroscopy (AES).

FIG. 33 is a plot of elemental concentration of the powder of Sample 1 after ball milling in the presence of a urea nitrogen source, collected using Auger electron spectroscopy (AES). As shown in FIG. 33, the powder included carbon, nitrogen, oxygen, and iron.

Figure 34:
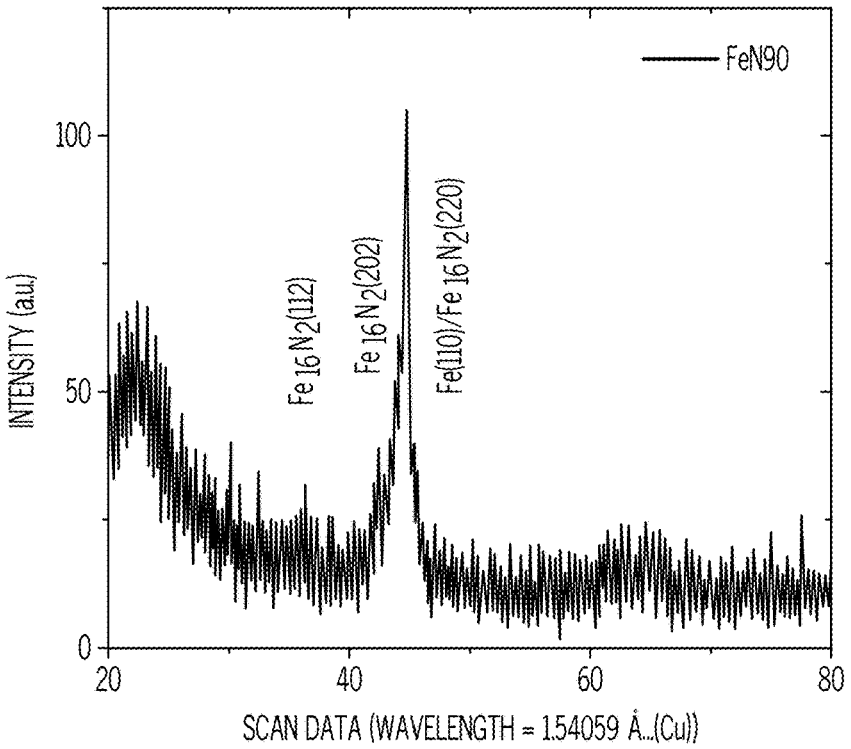
FIG. 34 is a plot showing an x-ray diffraction spectrum of powder from Sample 1 after annealing.

FIG. 34 is a plot showing an x-ray diffraction spectrum of powder from Sample 1 after annealing. As shown in FIG. 34, the powder included $Fe_{16}N_2$ phase iron nitride.

Figure 35:
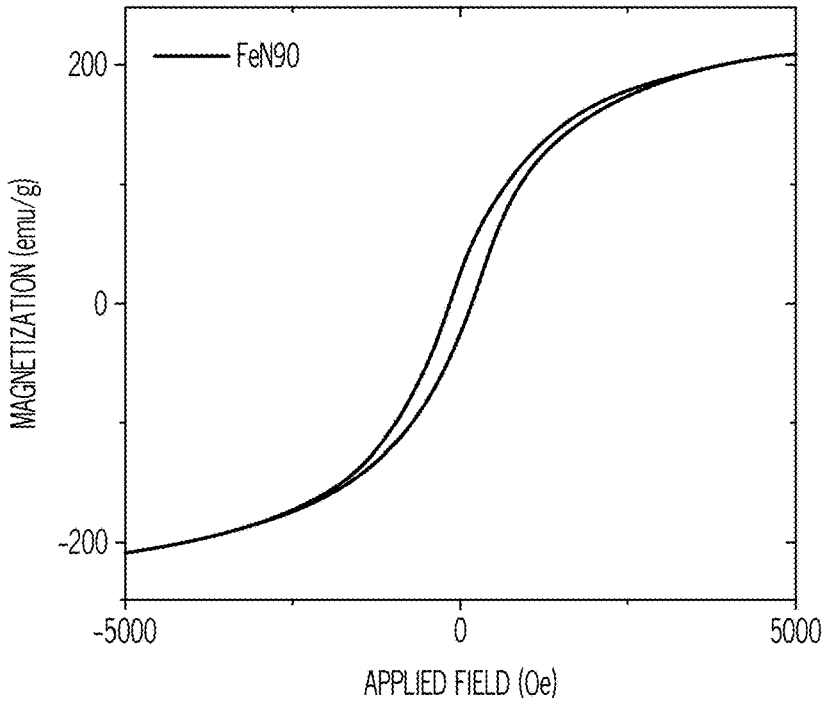
FIG. 35 is a plot of a magnetic hysteresis loop of prepared iron nitride formed using ball milling in the presence of ammonium nitrate.

FIG. 35 is a plot of a magnetic hysteresis loop of prepared iron nitride formed using ball milling in the presence of ammonium nitrate. The magnetic hysteresis loop was measured at room temperature. The iron nitride sample with which the magnetic hysteresis loop was measured was prepared using the processing parameters listed above for Sample 1. In particular, FIG. 35 illustrates an example magnetic hysteresis loop for Sample 1, after annealing. FIG. 35 shows a coercivity ($H_c$) for Sample 1 of about 540 Oe and a saturation magnetization of about 209 emu/g.

Example 10

Powder samples are placed in an electrically conductive container or armature. The samples included iron nitride powder formed using the same processing parameters listed above for Sample 1. The electrically conductive container was placed in the bore of a high magnetic field coil. The magnetic field coil was pulsed with a high electrical current (e.g., between 1 amp and 100 amps and a pulse ratio between about 0.1% and about 10%) to produce a magnetic field in the bore that, in turn, induces electrical currents in the armature. The induced currents interact with the applied magnetic field to produce an inwardly acting magnetic force that collapses the armature and compacts the samples. The compaction occurs in less than one millisecond.

The density of the part formed by the compaction was estimated to be 7.2 g/cc, almost 90% of the theoretical density.

Figure 36:
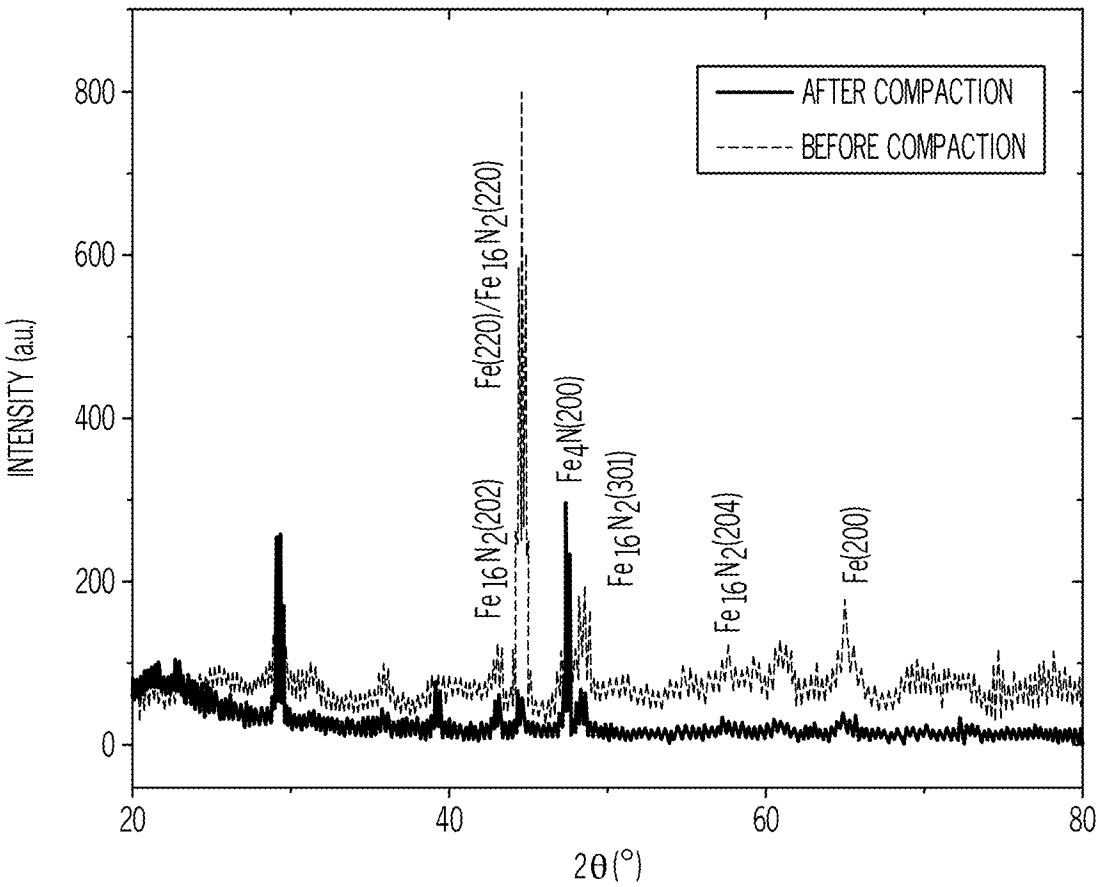
FIG. 36 is a plot showing an x-ray diffraction spectrum for the sample before and after consolidation.

FIG. 36 is a plot showing an x-ray diffraction spectrum for the sample before and after consolidation. FIG. 36 shows that $Fe_{16}N_2$ phase still existed in the sample after consolidation. Although the intensity of the $Fe_{16}N_2$ peaks decreased, $Fe_{16}N_2$ phase was still present.

When ranges are used herein for physical properties, such as molecular weight, or chemical properties, such as chemical formulae, all combinations and subcombinations of ranges for specific examples therein are intended to be included.

Various examples have been described. Those skilled in the art will appreciate that numerous changes and modifications can be made to the examples described in this disclosure and that such changes and modifications can be made without departing from the spirit of the disclosure. These and other examples are within the scope of the following claims.

The disclosure of each patent, patent application, and publication cited or described in this document are hereby incorporated herein by reference, in its entirety.

What is claimed is:

1. A method comprising:

heating a mixture including iron and nitrogen to form a molten iron nitride-containing material and thereby forming the molten iron nitride-containing material; and casting, quenching, and pressing the molten iron nitride-containing material to form a workpiece including at least one $Fe_8N$ phase domain.

2. The method of claim 1, wherein casting, quenching, and pressing comprises continuously casting, quenching, and pressing the molten iron nitride-containing material to form a workpiece having a dimension that is longer than other dimensions of the workpiece.

3. The method of claim 1, further comprising:

milling, in a bin of a rolling mode milling apparatus, a stirring mode milling apparatus, or a vibration mode milling apparatus, an iron-containing raw material in the presence of a nitrogen source to generate a powder including iron nitride, and wherein heating the mixture including iron and nitrogen comprises heating the powder including iron nitride.

4. The method of claim 3, wherein the nitrogen source comprises at least one of ammonium nitrate, an amide-containing material, or a hydrazine-containing material.

5. The method of claim 4, wherein the at least one of the amide-containing or hydrazine-containing material comprises at least one of a liquid amide, a solution containing an amide, a hydrazine, or a solution containing hydrazine.

6. The method of claim 4, wherein the at least one of the amide-containing or hydrazine-containing material comprises at least one of carbamide, methanamide, benzamide, or acetamide.

7. The method of claim 3, wherein the iron-containing raw material comprises substantially pure iron.

8. The method of claim 3, further comprising adding a catalyst to the iron-containing raw material.

9. The method of claim 8, wherein the catalyst comprises at least one of nickel or cobalt.

10. The method of claim 3, wherein the iron-containing raw material comprises a powder with an average diameter of less than about 100 μm.

11. The method of claim 3, wherein the powder including iron nitride comprises at least one of FeN, $Fe_2N$, $Fe_3N$, $Fe_4N$, $Fe_2N_6$, $Fe_8N$, $Fe16N_2$, or $FeN_x$, wherein x is in the range of from about 0.05 to about 0.5.

12. The method of claim 3, further comprising milling an iron precursor to form the iron-containing raw material.

13. The method of claim 12, wherein the iron precursor comprises at least one of Fe, $FeCl_3$, $Fe_2O_3$, or $Fe_3O_4$.

14. The method of claim 12, wherein milling the iron precursor to form the iron-containing raw material comprises milling the iron precursor in the presence of at least one of Ca, Al, or Na under conditions sufficient to cause an oxidation reaction between the at least one of Ca, Al, or Na and oxygen present in the iron precursor.

15. The method of claim 3, further comprising melting spinning an iron precursor to form the iron-containing raw material.

16. The method of claim 15, wherein melting spinning the iron precursor comprises:

forming molten iron precursor;

cold rolling the molten iron precursor to form a brittle ribbon of material;

heat treating the brittle ribbon of material; and shattering the brittle ribbon of material to form the iron-containing raw material.

17. The method of claim 1, wherein a dimension of the workpiece including at least one $Fe_8N$ phase domain is less than about 50 millimeters in at least one axis.

18. The method of claim 1, wherein the molten iron nitride-containing material includes an iron atom-to-nitrogen atom ratio of about 8:1.

19. The method of claim 1, wherein the molten iron-nitride containing material includes at least one ferromagnetic or nonmagnetic dopant.

20. The method of claim 19, wherein the at least one ferromagnetic or nonmagnetic dopant comprises at least one of Sc, Ti, V, Cr, Mn, Co, Ni, Cu, Zn, Zr, Nb, Mo, Ru, Rh, Pd, Ag, Cd, Pt, Au, Sm, C, Pb, W, Ga, Y, Mg, Hf, or Ta.

21. The method of claim 19, wherein the molten iron-nitride containing material comprises less than about 10 atomic percent of the at least one ferromagnetic or nonmagnetic dopant.

22. The method of claim 1, wherein the molten iron-nitride containing material further comprises at least one phase stabilizer.

23. The method of claim 22, wherein the at least one phase stabilizer comprises at least one of B, Al, C, Si, P, O, Co, Cr, Mn, or S.

24. The method of claim 22, wherein the molten iron-nitride containing material comprises between about 0.1 atomic percent and about 15 atomic percent of the at least one phase stabilizer.

25. The method of claim 1, wherein heating the mixture including iron and nitrogen to form the molten iron nitride-containing material comprises heating the mixture at a temperature greater than about 1500° C.

26. The method of claim 1, wherein continuously casting, quenching, and pressing the molten iron nitride-containing material comprises casting the molten iron nitride-containing material at a temperature in the range of from about 650° C. to about 1200° C.

27. The method of claim 1, wherein continuously casting, quenching, and pressing the molten iron nitride-containing material comprises quenching the iron nitride-containing material to a temperature above about 650° C.

28. The method of claim 1, wherein continuously casting, quenching, and pressing the molten iron nitride-containing material comprises pressing the iron nitride-containing material at a temperature below about 250° C. and a pressure in the range of from about 5 tons to about 50 tons.

29. The method of claim 1, further comprising straining and post-annealing the workpiece including at least one $Fe_8N$ phase domain to form a workpiece including at least one $Fe_{16}N_2$ phase domain.

30. The method of claim 29, wherein straining and post-annealing the workpiece including at least one $Fe_8N$ phase domain reduces the dimension of the workpiece.

31. The method of claim 30, wherein the dimension of the workpiece including at least one $Fe_{16}N_2$ phase domain in the at least one axis following straining and post-annealing is less than about 0.1 mm.

32. The method of claim 29, wherein, after straining and post-annealing, the workpiece consists essentially of a single $Fe_{16}N_2$ phase domain.

33. The method of claim 29, wherein straining the workpiece including at least one $Fe_8N$ phase domain comprises exerting a tensile strain on the workpiece in the range of from about 0.3% to about 12%.

34. The method of claim 33, wherein the tensile strain is applied in a direction substantially parallel to at least one <001> crystal axis in the workpiece including at least one $Fe_8N$ phase domain.

35. The method of claim 29, wherein post-annealing the workpiece including at least one $Fe_8N$ phase domain comprises heating the workpiece including at least one $Fe_8N$ phase domain to a temperature in the range of from about 100° C. to about 250° C.

36. The method of claim 29, wherein the workpiece including at least one $Fe_{16}N_2$ phase domain is characterized as being magnetically anisotropic.

37. The method of claim 36, wherein the energy product, coercivity and saturation magnetization of the workpiece including at least one $Fe_{16}N_2$ phase domain are different at different orientations.

38. The method of claim 1, further comprising forming the mixture including iron and nitrogen by exposing an iron-containing material to a urea diffusion process.

39. The method of claim 1, wherein the workpiece including at least one $Fe_8N$ phase domain comprises at least one of a fiber, a wire, a filament, a cable, a film, a thick film, a foil, a ribbon, or a sheet.

* * * * *